US009213263B2

(12) United States Patent
Matsuzaki et al.

(10) Patent No.: US 9,213,263 B2
(45) Date of Patent: Dec. 15, 2015

(54) FLEXIBLE DEVELOPER ACCOMMODATING CONTAINER WITH UNSEALABLE OPENINGS

(71) Applicant: CANON KABUSHIKI KAISHA, Tokyo (JP)

(72) Inventors: Hiroomi Matsuzaki, Mishima (JP); Masaaki Matsushita, Yokohama (JP); Tatsuo Fujisaki, Yokohama (JP); Masaki Furutani, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/951,563

(22) Filed: Jul. 26, 2013

(65) Prior Publication Data

US 2013/0308979 A1 Nov. 21, 2013

Related U.S. Application Data

(63) Continuation of application No. PCT/JP2012/068530, filed on Jul. 13, 2012.

(30) Foreign Application Priority Data

Jul. 14, 2011 (JP) ..... 2011-155832
Jun. 25, 2012 (JP) ..... 2012-142181

(51) Int. Cl.
*G03G 15/08* (2006.01)
*G03G 21/16* (2006.01)

(52) U.S. Cl.
CPC ..... *G03G 15/0874* (2013.01); *G03G 15/0882* (2013.01); *G03G 2215/0682* (2013.01)

(58) Field of Classification Search
CPC ..... G03G 15/0881; G03G 15/0882; G03G 2215/0687; G03G 2215/0682
USPC ..... 399/102, 103, 105, 106
See application file for complete search history.

(56) References Cited

U.S. PATENT DOCUMENTS 2,904,000 A * 9/1959 Fisher et al. ..... 399/260
4,615,608 A * 10/1986 Mizutani ..... 399/103

(Continued)

FOREIGN PATENT DOCUMENTS

EP 0 583 019 A2 2/1994
EP 0 777 157 A2 6/1997

(Continued)

OTHER PUBLICATIONS

U.S. Appl. No. 13/951,663, filed Jul. 26, 2013.

(Continued)

*Primary Examiner* — David Gray
*Assistant Examiner* — Tyler Hardman
(74) *Attorney, Agent, or Firm* — Fitzpatrick, Cella, Harper & Scinto

(57) ABSTRACT

A developer accommodating container for accommodating a developer includes a flexible container including an injection port for permitting entrance of the developer and a plurality of openings for permitting discharge of the developer, and a sealing member mounted on the flexible container in a state in which the sealing member seals the plurality of openings and capable of exposing the plurality of openings by being moved in an unsealing direction. The plurality of openings are provided at different positions along an axial direction perpendicular to the unsealing direction in which exposure of the plurality of openings advances.

48 Claims, 51 Drawing Sheets

(56) References Cited

U.S. PATENT DOCUMENTS

| | | | | | |
|---|---|---|---|---|---|
| 5,142,335 | A | * | 8/1992 | Sakata et al. | 399/106 |
| 5,579,101 | A | * | 11/1996 | Omata et al. | 399/114 |
| 5,729,797 | A | * | 3/1998 | Okada et al. | 399/120 |
| 5,737,675 | A | * | 4/1998 | Okada et al. | 399/258 |
| 5,802,441 | A | | 9/1998 | Okada | |
| 5,832,343 | A | | 11/1998 | Kobayashi et al. | |
| 5,832,349 | A | * | 11/1998 | Nagashima | 399/262 |
| 6,058,278 | A | * | 5/2000 | Tsuda et al. | 399/106 |
| 6,208,817 | B1 | | 3/2001 | Chadani et al. | |
| 2002/0018667 | A1 | * | 2/2002 | Hashimoto et al. | 399/106 |
| 2004/0165913 | A1 | * | 8/2004 | Hattori | 399/258 |

FOREIGN PATENT DOCUMENTS

| | | | | |
|---|---|---|---|---|
| EP | 0 798 603 | A2 | | 10/1997 |
| EP | 0581199 | B1 | | 5/2006 |
| JP | 04-066980 | A | | 3/1992 |
| JP | H05-142940 | A | | 6/1993 |
| JP | 07044004 | A | * | 2/1995 |
| JP | 07044004 | A | * | 2/1995 |
| JP | H09-106156 | A | | 4/1997 |
| JP | H09-152765 | A | | 6/1997 |
| JP | 2003-263014 | A | | 9/2003 |
| JP | 2003263014 | A | * | 9/2003 |
| JP | 2006-178187 | A | | 7/2006 |
| TW | 378284 | B | | 1/2000 |

OTHER PUBLICATIONS

Taiwanese Office Action dated Jul. 16, 2014, in related Taiwanese Patent Application No. 101125355.

Russian Office Action dated Apr. 16, 2015, in related Russian Patent Application No. 2014105465 (with English translation).

Korean Office Action dated May 13, 2015, in related Korean Patent Application No. 10-2014-7003141.

European Search Report dated Jul. 1, 2015, in related European Patent Application No. 12811330.5.

* cited by examiner (a)

(b)

FLEXIBLE DEVELOPER ACCOMMODATING CONTAINER WITH UNSEALABLE OPENINGS

This application is a continuation of PCT Application No. PCT/JP2012/068530, filed on Jul. 13, 2012.

TECHNICAL FIELD

The present invention relates to an image forming apparatus, and a developer accommodating container, a developer accommodating unit, a developing device and a cartridge which are to be used in the image forming apparatus.

Here, the image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine, and the like.

Further, the cartridge refers to a cartridge including at least a developing means and the developing device which are integrally constituted to be made detachably mountable to an image forming apparatus main assembly and a cartridge including the developing device and at least a photosensitive member unit including a photosensitive member which are integrally constituted to be made detachably mountable to the image forming apparatus main assembly.

Further, the developer accommodating container and the developer accommodating unit are accommodated in the image forming apparatus or the cartridge. The developer accommodating container and the developer accommodating unit are at least provided with a flexible container for accommodating the developer.

BACKGROUND ART

In a conventional electrophotographic image forming apparatus using the electrophotographic image forming process, a process cartridge type in which an electrophotographic photosensitive member and process means actable on the photosensitive member are integrally assembled into a cartridge and this cartridge is detachably mountable to a main assembly of the electrophotographic image forming apparatus is employed.

In such a process cartridge, as shown in FIG. 52, an opening provided to a developer accommodating frame 31 for accommodating the developer (toner, carrier, etc.) is sealed with a sealing member. Further, a type in which a bonding portion 33 of a toner seal 32 which is the sealing member is pulled and peeled during use, thus unsealing the opening to enable supply of the developer has been widely employed (Japanese Laid-Open Patent Application (JP-A) Hei 4-66980).

Further, against a problem such that the developer is scattered in the process cartridge in a developer filling step during manufacturing of the process cartridge, a constitution in which a deformable inner container is used has been devised (JP-A Hei 4-69980).

However, as in JP-A Hei 4-66980, it is difficult to provide an elastic member inside the inner container in manufacturing, and there is the case where it takes a cost.

DISCLOSURE OF THE INVENTION

Therefore, an object of the present invention is, in a constitution different from the conventional constitution, to propose a developer accommodating unit using a flexible container and being excellent in an unsealing property.

One of constitutions of the inventions according to the present invention is as follows:

A developer accommodating container for accommodating a developer, the developer accommodating container comprising: a flexible container including an injection port for permitting entrance of the developer and a plurality of openings for permitting discharge of the developer; and a sealing member, mounted on the flexible container in a state in which the sealing member seals the plurality of openings, capable of exposing the plurality of openings by being moved, wherein the plurality of openings are provided at different positions with respect to a perpendicular direction to an unsealing direction in which exposure of the plurality of openings advances.

According to the present invention, in the accommodating container using the flexible container for accommodating the developer, the developer accommodating container or the developer accommodating unit, an unsealing characteristic of the sealing member for sealing the flexible container openings can be improved.

BEST MODE FOR CARRYING OUT THE INVENTION

Figure 1:
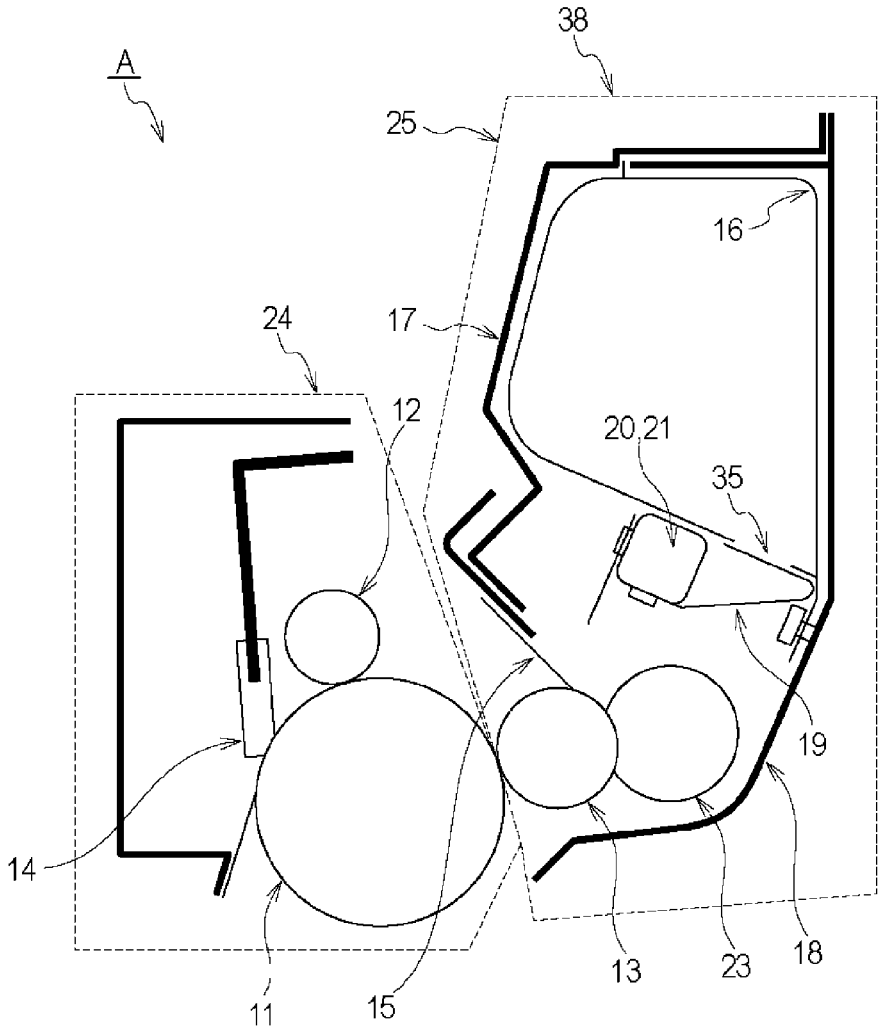
FIG. 1 is a principal sectional view of a process cartridge in an embodiment of the present invention.

In the following description, a developer accommodating container refers to at least a flexibility container and a sealing member for sealing an opening, provided to the flexible container, for permitting discharge of a developer. The developer accommodating container before the developer is accommodated therein is referred to as a developer accommodating container 37 for accommodating the developer. The developer accommodating container which accommodates the developer and which is provided with an unsealing member for unsealing the sealing member is referred to as a developer accommodating container 30 including the unsealing member. The developer accommodating container which accommodates the developer and which is not provided with the sealing member is referred to as a developer accommodating container 26 accommodating the developer.

Incidentally, for simplification, these developer accommodating containers will be described as the developer accommodating container 37, the developer accommodating container 30 and the developer accommodating container 26 by using different reference numerals.

A developer accommodating unit includes at least the developer accommodating container and a frame for accommodating the developer accommodating container.

Embodiment 1

Figure 2:
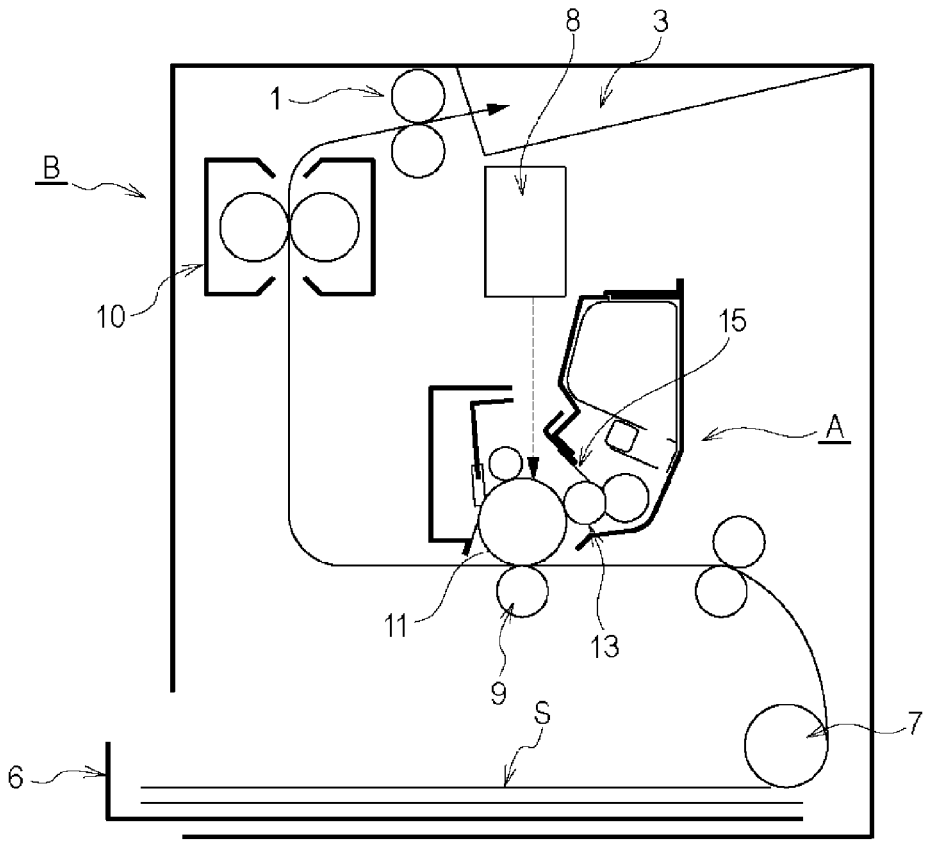
FIG. 2 is a principal sectional view of an image forming apparatus in the embodiment of the present invention.

FIG. 1 illustrates a principal sectional view of a process cartridge including the developer accommodating unit to which the present invention is applicable, and FIG. 2 illustrates a principal sectional view of an image forming apparatus to which the present invention is applicable.

<Summary of Structure of Process Cartridge>

The process cartridge includes an image bearing member and process means actable on the image bearing member. Here, as the process means, there are, e.g., a charging means for electrically charging a surface of the image bearing member, a developing device for forming an image on the image bearing member, and a cleaning means for removing a developer (containing toner, carrier, etc.) remaining on the image bearing member surface.

The process cartridge A in this embodiment includes, as shown in FIG. 1, includes a photosensitive (member) drum 11 as the image bearing member and includes, at a periphery of the photosensitive drum 11, a charging roller 12 as the charging means and a cleaner unit 24 including a cleaning blade 14, having elasticity, as the cleaning means. Further, the process cartridge A includes a developing device 38 including a first frame 17 and a second frame 18. The process cartridge A integrally includes the cleaner unit 24 and the developing device 38, and is constituted so as to be detachably mountable to an image forming apparatus main assembly B as shown in FIG. 2. The developing device 38 includes a developing roller 13 as the developing means, a developing blade 15, a developer supplying roller 23, and a developer accommodating container 26, for accommodating the developer, in which the developer is accommodated. The developing roller 13 and the developing blade are supported by the first frame 17.

<Summary of Structure of Image Forming Apparatus>

The process cartridge A is mounted in the image forming apparatus main assembly B as shown in FIG. 2 and is used for image formation. In the image formation, a sheet S is fed by a feeding roller 7 from a sheet cassette 6 mounted at a lower portion of the apparatus, and in synchronism with this sheet feeding, the photosensitive drum 11 is selectively exposed to light by an exposure device 8 to form a latent image. The developer is supplied to the developing roller 13 (developer carrying member) by the sponge-like developer supplying roller 23 and is carried in a thin layer on the surface of the developing roller 13. By applying a developing bias to the developing roller 13, the developer is supplied depending on the latent image and thus the latent image is developed into a developer image. This (developer) image is transferred onto the fed sheet S by bias voltage application to a transfer roller 9. The sheet S is conveyed to a fixing device 10 to be subjected to image fixing, and the sheet S is discharged by a sheet discharging roller 1 to a sheet discharge portion 3 at an upper portion of the apparatus.

<Summary of Structure of Developer Accommodating Unit>

Figure 3:
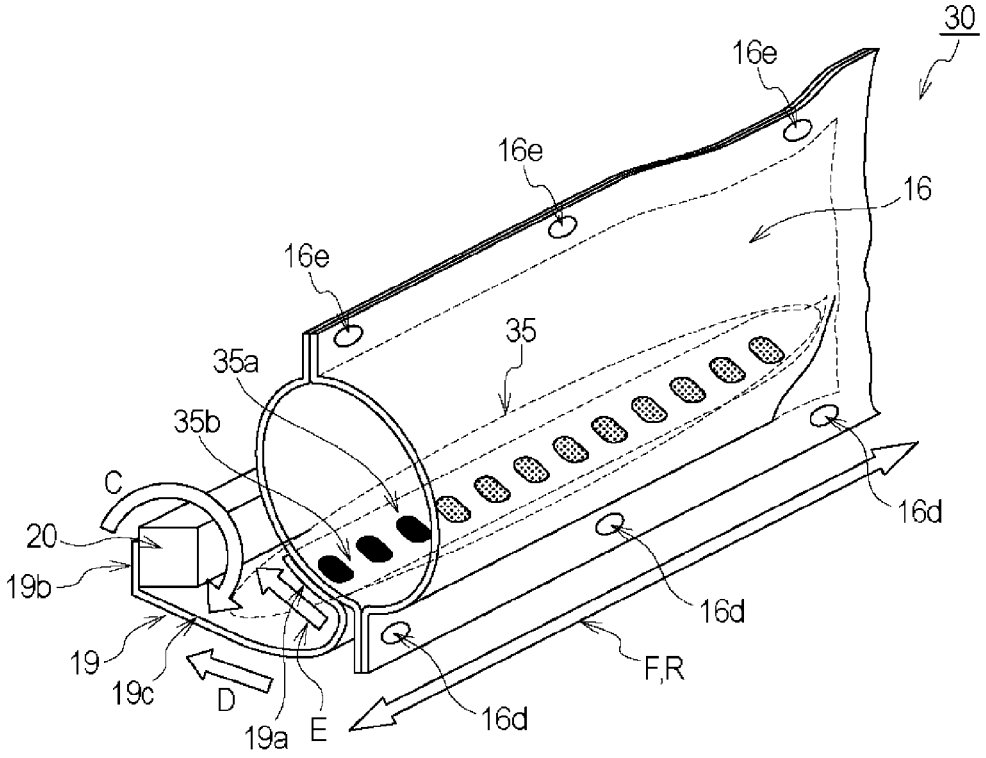
FIG. 3 is a perspective view from a cross section of a developer accommodating container including an unsealing member in the embodiment of the present invention.
Figure 4:
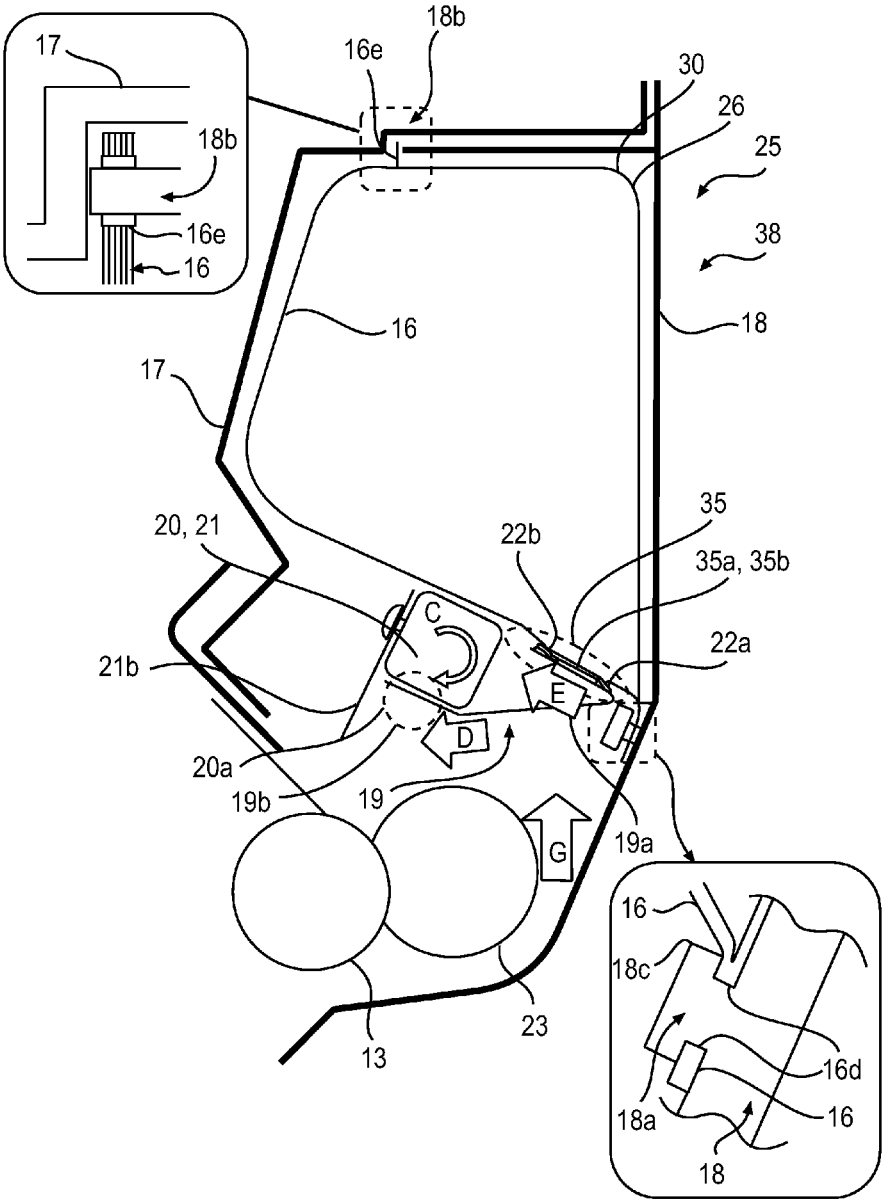
FIG. 4 is a sectional view of a developer accommodating unit before unsealing in the embodiment of the present invention.
Figure 7:
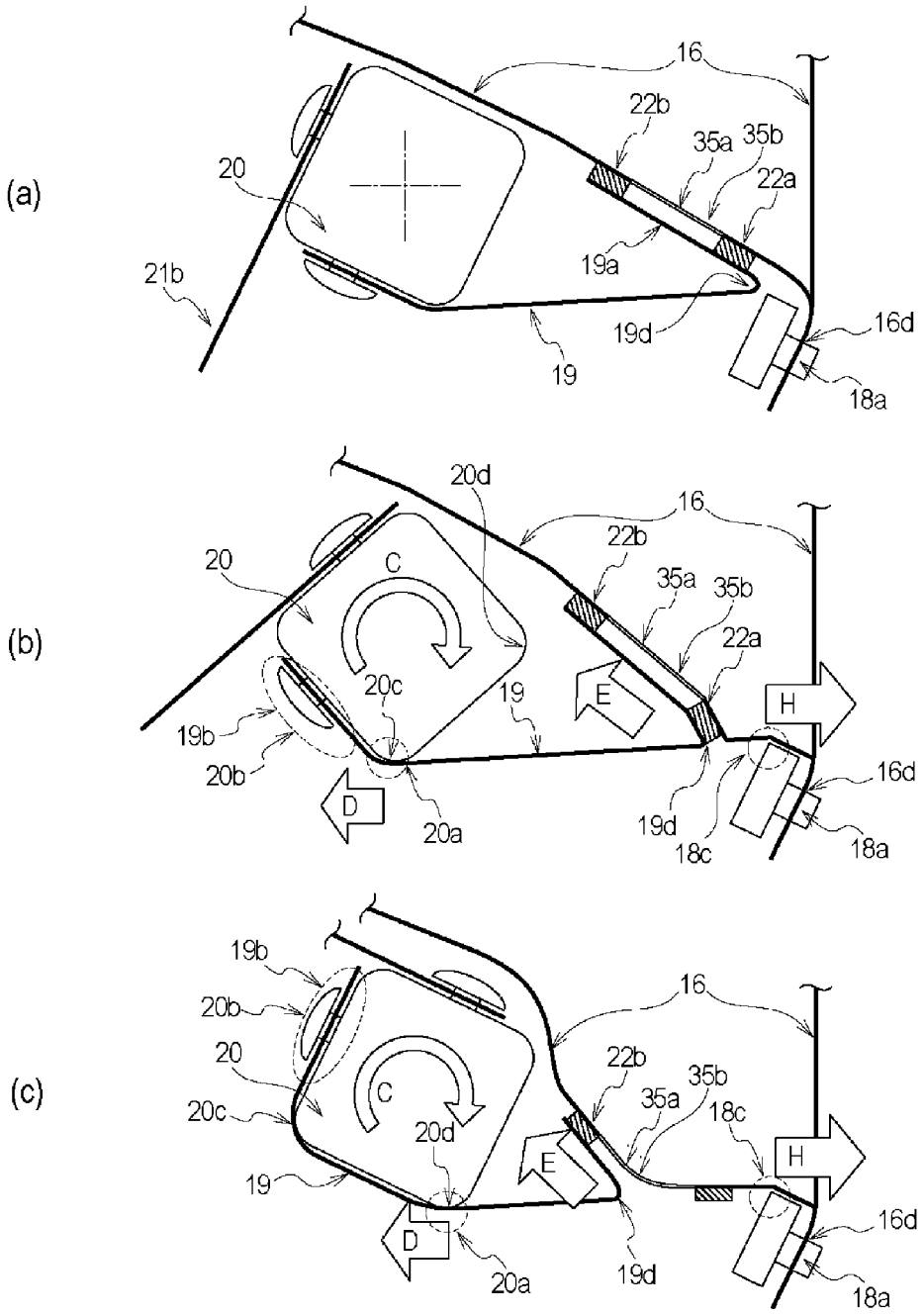
FIG. 7 includes sectional views for illustrating a process of unsealing a discharging portion in the embodiment of the present invention.
Figure 20:
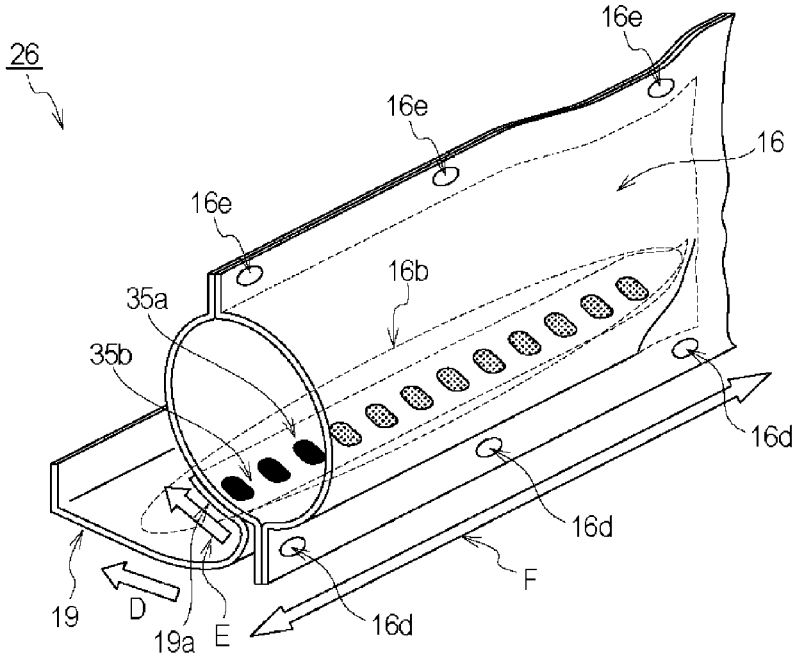
FIG. 20 is an illustration of the developer accommodating container in the embodiment of the present invention.

Next, a structure of a developer accommodating unit 25 will be described with reference to FIG. 3, FIG. 4, (a) of FIG. 7 and FIG. 20. Here, FIG. 3 is a perspective view of the developer accommodating container 30 from cross section, FIG. 4 is a sectional view of the developing device 38, FIG. 7 is a detailed sectional view in the neighborhood of the discharging portion 35 for permitting discharge of the developer from a developer bag 16 as a flexible container, and FIG. 20 is a sectional view of the developer accommodating container 26 from cross section. Incidentally, the sectional views are a plane passing through an unsealing member 20, openings 35*a* and fixing portions 16*d* and 16*e*. Further, the sectional views are a plane perpendicular to a rotational axis of the unsealing member 20.

(Developer Accommodating Unit)

The developer accommodating unit 25 is, as shown in FIG. 4, constituted from the developer accommodating container 30, the developing roller 13, the developing blade 15, and the first frame 17 and the second frame 18 which support these members. A combination of the first frame and the second frame is a frame which accommodates the developer accommodating container 30.

Incidentally, in this embodiment, the developer accommodating unit 25 is the same as the developing device 38. This is because the developer accommodating unit 25 includes the developing roller 13 and the developing blade 15. However, the developing roller 13 and the developing blade 15 may also be supported by a frame separately from the developer accommodating unit 25 and thus may be separated from the developer accommodating unit 25. In this case, the developing device 38 is constituted by the developer accommodating unit 25, the developing roller 13 and the developing blade 15 (not shown).

(Developer Accommodating Container Including Unsealing Member)

The developer accommodating container 30 including the unsealing member is constituted by an unsealing member 20 and the developer accommodating container 26 as shown in FIG. 3 and FIG. 4.

The unsealing member 20 includes an engaging portion 20*b* to be engaged with a sealing member 19, and by engaging a portion-to-be-engaged 19*b* of the developer accommodating container 26 with the engaging portion 20*b*, the developer accommodating container 30 including the unsealing member is constituted.

(Developer Accommodating Container in Which Developer is Accommodated)

Figure 30:
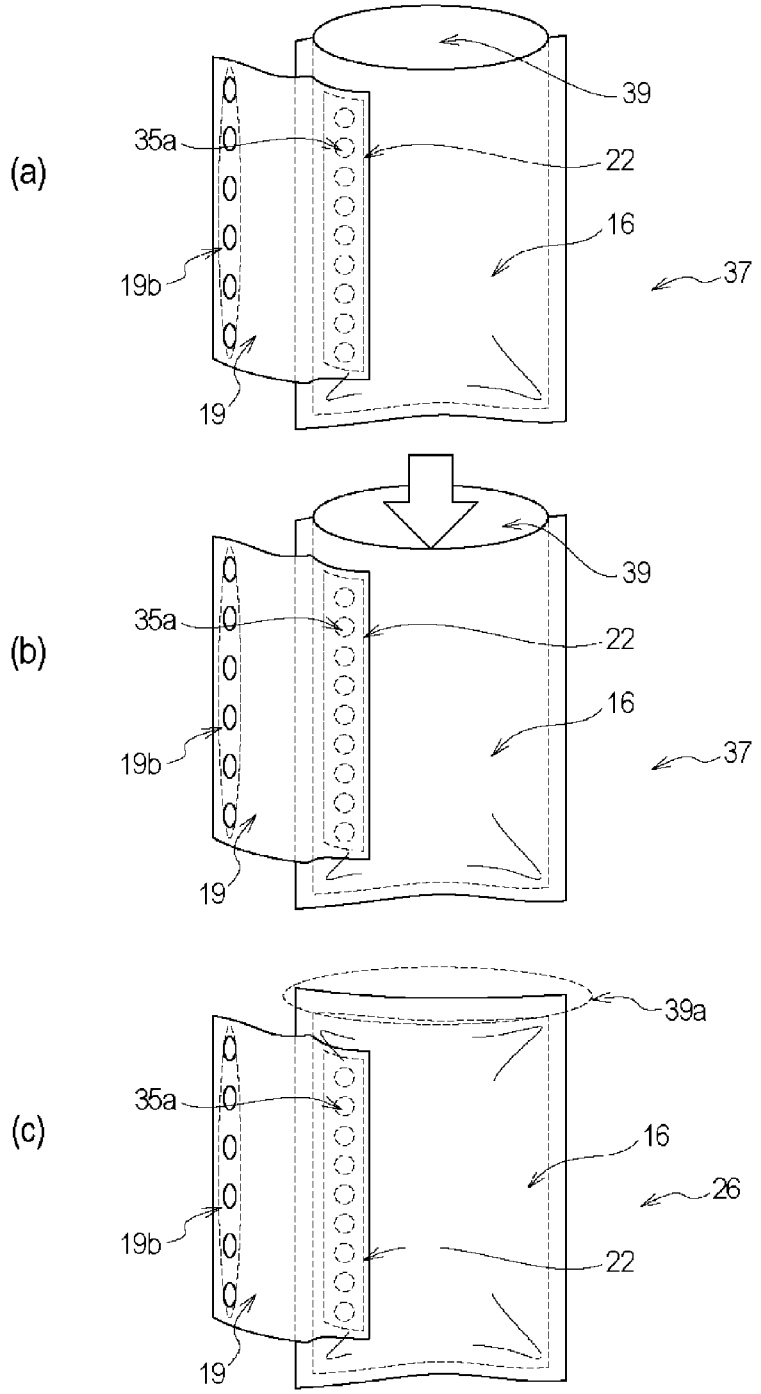
FIG. 30 includes illustrations of developer accommodating containers in embodiments of the present invention.

As shown in (c) of FIG. 30, the developer accommodating container 26 is constituted from the developer, a developer bag 16 and the sealing member 19. Here, the developer is powder.

The developer bag 16 of the developer accommodating container 26 is sealed with the sealing member 19 at the plurality of openings 35*a* for permitting the discharge of the developer and includes a bonding portion 39*a* which seals a filling opening (injection port) for permitting filling (entrance) of the developer. Thus, the respective openings 35*a* and the filling opening 39 of the developer accommodating container 26 in which the developer is accommodated are sealed and therefore the accommodated developer is not leaked out to the outside, so that the developer accommodating container 26 can be treated as a single unit. Further, the sealing member 19 includes holes as the portions-to-be-engaged 19*b* to be engaged with the unsealing member 20, thus being engageable with the unsealing member 20.

(Developer Accommodating Container for Accommodating Developer)

As shown in (a) of FIG. 30, the developer accommodating container 37 for accommodating the developer is constituted from the developer bag 16 and the sealing member 19 for sealing the plurality of openings 35*a* for permitting the discharge of the developer and for exposing the openings 35*a* by being moved. Here, the developer bag 16 of the developer accommodating container 37 for accommodating the developer includes the filling opening 39 for permitting the filling of the developer and the openings 35*a* for permitting the discharge of the developer.

Here, in the developer accommodating container 37 for accommodating the developer, the developer is not filled as yet, and the developer accommodating container 37 is in a state in which the filling opening 39 for permitting the filling of the developer is open.

(Filling and Developer Accommodating Container)

Here, a relation between the developer accommodating container 37 for accommodating the developer and the developer accommodating container 26 in which the developer is accommodated will be described.

First, as shown in (a) of FIG. 30, the developer accommodating container 37 for accommodating the developer is not filled with the developer and is provided with the filling opening 39 for permitting the filling of the developer.

Next, as shown in (b) of FIG. 30, the developer is filled from the filling opening 39, for permitting the filling of the developer, of the developer accommodating container 37 for accommodating the developer. Further, by flexibility of the developer bag 16, the filling opening 39 for permitting the filling of the developer is deformable correspondingly to a filling device and thus the filling of the developer is facilitated without causing scattering of the developer. At the time of the filling, a known auger type filling device is used but another method having a similar function may also be used.

Then, as shown in (c) of FIG. 30, the filling opening 39 for permitting the filling of the developer is bonded and sealed. The bonding of the bonding portion 39*a* of the opening for permitting the filling of the developer is made by ultrasonic bonding in this embodiment but may also be made by other bonding methods using heat, a laser and the like.

Then, when the bonding of the bonding portion 39*a* of the opening for permitting the filling is completed, the developer is filled, so that the developer accommodating container 26 in which the developer is accommodated is provided.

Incidentally, a position and a size of the filling opening 39 for permitting the filling may appropriately by disposed correspondingly to shapes and the like of the filling device of the developer and the process cartridge A.

(Effect of Incorporating Developer Bag in Developing Device)

By forming the developer-accommodated developer accommodating container 26 in a bag shape, the developer can be treated as a unit. For that reason, a developer filling step can be separated from a main assembling step (manufacturing line) of the process cartridge A. By this, the developer is prevented from being scattered in the main assembling step (manufacturing line) of the process cartridge A, so that maintenance such as cleaning of the manufacturing line can be reduced. By the prevention of the scattering of the developer during the assembling step, it is possible to omit a cleaning step of the process cartridge A to be performed after the filling of the developer.

Further, also in the filling step of the developer bag 16, the developer bag 16 has flexibility, and the filling opening 39 for permitting the filling is also soft and therefore can be easily sealed with less scattering.

Further, the developer accommodating container 26 in which the developer is accommodated has flexibility and therefore can be assembled while following a shape of the frame.

Further, in the filling step, the developer accommodating container 37 has flexibility and therefore deforms its cross section to increase its volume in which the developer can be filled, so that a filling amount can be increased during the filling.

Further, the developer accommodating container 37 before the developer filling has flexibility and thus can be made small (thin), so that a storing space during storage before the filling can be made small compared with the frame which is a resinous structure.

(Structure of Developer Bag)

As shown in FIG. 3 and FIG. 4, the developer bag 16 accommodates the developer therein and has a bag-like shape which is deformable, and is provided with the plurality of openings 35*a* at the discharging portion 35, for permitting the discharge of the accommodated developer.

Further, the developer bag 16 includes developer bag fixing portions (portions-to-be-fixed) 16*d* and 16*e* fixed to the first frame 17 and the second frame 18.

(Material and Air Permeability of Developer Bag)

Figure 29:
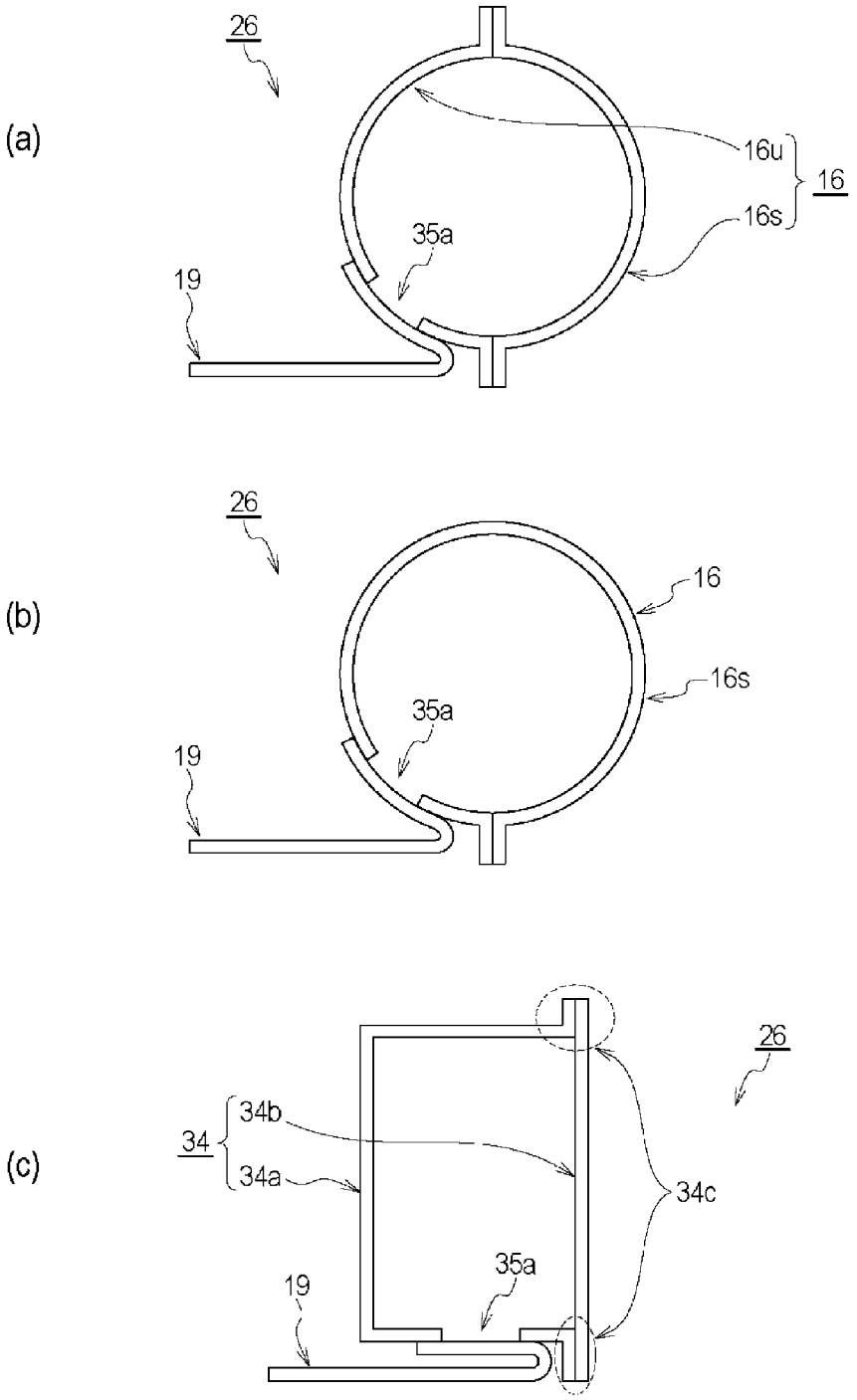
FIG. 29 includes sectional views of the developer accommodating container in the embodiment of the present invention.

FIG. 29 includes sectional views for illustrating the developer accommodating container 26. As shown in (a) of FIG. 29, the developer bag 16 is constituted by bonding a sheet 16*u* which includes the discharging portion 35 and does not have air permeability and a sheet 16*s* which has the air permeability and which is an air permeable portion to each other.

Here, a degree of the air permeability may appropriately be selected so that the developer is prevented from leaking out of the developer bag 16 based on a balance with a size of the developer (particle size of powder) to be accommodated.

As a material for the air permeable portion 16*s*, a nonwoven fabric or the like formed of polyethylene terephthalate (PET), polyethylene (PE), polypropylene (PP) or the like in a thickness of 0.03-0.15 mm is preferred. Further, even when the material for the air permeable portion 16*s* is not the nonwoven fabric, a material having minute holes which are smaller than the powder such as the developer may also be used.

Further, with respect to arrangement of the air permeable portion, in this embodiment, as shown in FIG. 3 and FIG. 29, the air permeable portion 16*s* is disposed over the entire region of the developer bag 16 with respect to a longitudinal direction in the second frame 18 side. Incidentally, as shown in (b) of FIG. 29, the air permeable portion 16*s* may also constitute the entire developer bag 16.

Incidentally, as the material for the developer bag 16 other than the air permeable portion 16*s*, a material having flexibility so as to improve efficiency during the discharge of the developer described later may preferably be used. Further, the material for the air permeable portion 16*s* may also have flexibility.

(Effect of Developer Bag Having Air Permeability)

Thus, the reason why the air permeability is imparted to the developer bag 16 is that the developer bag 16 can meet states during manufacturing, during transportation until a user uses the cartridge A, and during storage. First, the reason for the state during the manufacturing is that the developer bag 16 is made deformable and reducible in order to facilitate assembling of the developer bag 16 with the frames 17 and 18. In the case where the developer bag 16 is not provided with the air permeability portion, the size thereof cannot be changed from that in a state in which the developer bag 16 is filled with the developer (state in which the bag is closed) and therefore the developer bag 16 is not readily deformed. For that reason, it takes time to assembling and steps are complicated. Therefore, when the air permeability is imparted to at least a part of the developer bag 16, the size of the developer bag 16 can be changed from that in the state in which the developer bag 16 is filled with the developer and then is closed, thus facilitating the assembling.

Next, the reason for the states during the transportation and during the storage is that the developer bag 16 can meet a change in different air pressure during the transportation and during the storage of the process cartridge A. The difference in air pressure between the inside and outside of the developer bag 16 is generated in the case where the developer bag 16 is in a lower air-pressure environment during the transportation or the like than during the manufacturing or in the case where the developer bag 16 is stored at a higher temperature than during the manufacturing. For that reason, by expansion of the developer bag 16, there is a fear that parts contacting the developer bag 16 are deformed or broken. There is a need, for that purpose, to control the air pressure and the temperature during the transportation and during the storage, so that facilitates and a cost are needed. However, problems caused due to the difference in air pressure between the inside and outside of the developer bag 16 can be solved by partly imparting the air permeability to the developer bag 16.

Further, in the case where the nonwoven fabric is provided with the discharging portion 35 and a bonding portion 22 at a periphery of the discharging portion 35, there is a fear that fibers of the nonwoven fabric fall out with peeling of the sealing member 19 during unsealing and then enter the developer to adversely affect the image. For that reason, by providing the discharging portion 35 to the sheet 16*u* different from the sheet 16*s* having the air permeability, the above-described falling-out of the fibers from the nonwoven fabric is prevented.

Further, a filling density can be increased by filling the developer while deaerating the developer bag 16.

(Structure of Discharging Portion of Developer Bag)

Figure 10:
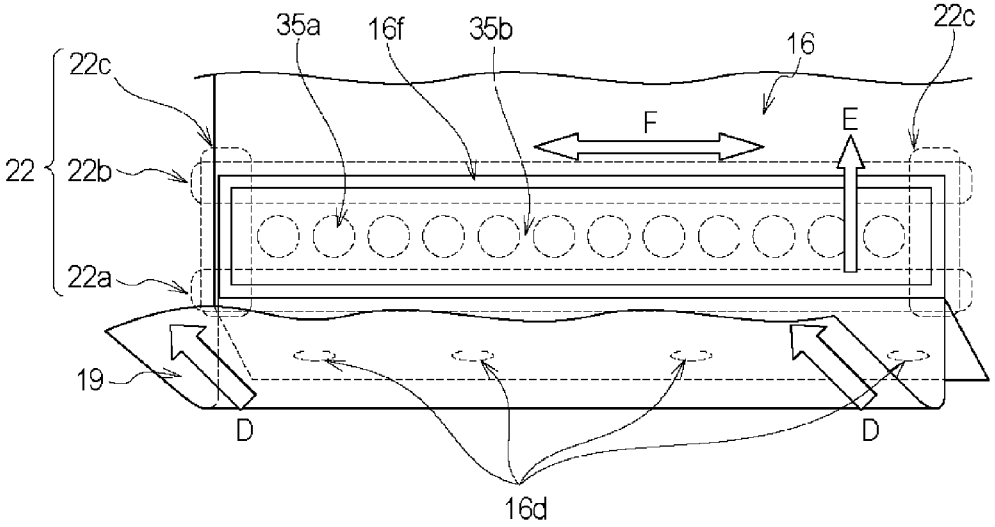
FIG. 10 is an illustration of the developer accommodating container before unsealing in the embodiment of the present invention.

As shown in FIG. 3 and FIG. 10, the developer bag 16 includes the developer discharging portion 35 consisting of the plurality of openings 35*a* for permitting the discharge of the inside developer and the connecting portion 35*b* defining the plurality of openings 35*a*. Further, the discharging portion 35 is continuously surrounded at its periphery by the bonding portion 22 to be unsealably bonded, so that the developer accommodated in the developer bag 16 is sealed with the sealing member 19.

(Structure of Bonding Portion of Developer Bag)

The bonding portion 22 has a rectangular shape surrounded by two lines extending in a long direction (direction F) and two lines extending in a short direction (direction E), and therefore the bonding portion 22 enables the sealing of the discharging portion 35.

Here, of the two lines of the bonding portion 22 welded with respect to the long direction (direction F), a bonding portion which is first unsealed is referred to as a first bonding portion 22*a* and a bonding portion which is unsealed later is referred to as a second bonding portion 22*b*. In this embodiment, in the case where the bonding portion 22 is viewed along the surface of the sealing member 19, the bonding portion in a side closer to a fold(ed)-back portion 19*d* (or portion-to-be-engaged 19*b*) described later is the first bonding portion 22*a*. Further, the bonding portion opposing the first bonding portion 22*a* via the opening is the second bonding portion 22*b*. Further, a bonding portion with respect to a widthwise direction is a widthwise (short) bonding portion 22*c*.

In this embodiment, an unsealing direction is the direction E. The unsealing direction is defined as follows. In the case where the unsealing is effected by moving the sealing member 19, of the first bonding portion 22*a* and the second bonding portion 22*b* opposing to each other via the opening 35*a*, the first bonding portion 22*a* is first unsealed (peeled). Thus, a direction directed from the first bonding portion 22*a* to be first unsealed toward the second bonding portion 22*b* is the unsealing direction E.

Incidentally, when the sealing member 19 is unsealed (peeled) from the developer bag 16 in the E direction, when viewed microscopically, the peeling progresses also in the arrow F direction in some cases due to the deformation of the developer bag 16 by an unsealing force also in the first bonding portion 22*a* and the second bonding portion 22*b*. However, the unsealing direction in this embodiment does not refer to such a microscopic unsealing direction.

(Arrangement of Openings of Developer Bag)

Next, arrangement of the openings 35*a* will be described with reference to FIG. 10, FIG. 11 and FIG. 30. The movement direction of the sealing member 19 (the direction of the sealing member 19 pulled by the unsealing member 20) for sealing the openings 35*a* and for exposing the openings 35*a* by being moved is D. By the movement of the sealing member 19, the exposure of the openings 35*a* progresses in the unsealing direction E. In the following, the movement direction of the sealing member 19 is D.

The plurality of openings 35*a* and the plurality of connecting portions 35*b* are disposed at different positions in the direction F perpendicular to the unsealing direction E. Further, the sealing member 19 is configured to be wound up by rotating the unsealing member 20 but the above-described direction F is the same direction as an axis (axial line) of the rotation shaft of the unsealing member 20.

Here, the reason why the rotational axis direction of the developing roller 13 and the arranged direction F of the plurality of openings 35*a* are made equal is that the developer is easily supplied, during the discharge thereof, to the developing roller 13 over the entire longitudinal direction without being localized.

Here, the plurality of openings 35*a* are disposed at the different positions in the direction of F and therefore the discharging portion 35 is long in the direction F and is short in the direction E. That is, with respect to the direction F, a distance from an end to another end of the plurality of openings 35*a* is longer than that with respect to the direction E.

Thus, the discharging portion 35 where the plurality of openings 35*a* are disposed at the different positions in the direction F perpendicular to the unsealing direction E is long in the direction F and is short in the direction E, and therefore the distance required for the unsealing can be made shorter than that required for the unsealing in the long direction F and therefore a time required for the unsealing can also be made short.

Further, a constitution in which the sealing member 19 for covering the discharging portion 35 is wound up by the unsealing member 20 is employed. The rotational axis direction of the unsealing member 20 and the direction F substantially perpendicular to the unsealing direction E are made equal, so that winding distance and time of the sealing member 19 can be shortened.

(Shape and Direction of Openings of Developer Bag)

Figure 18:
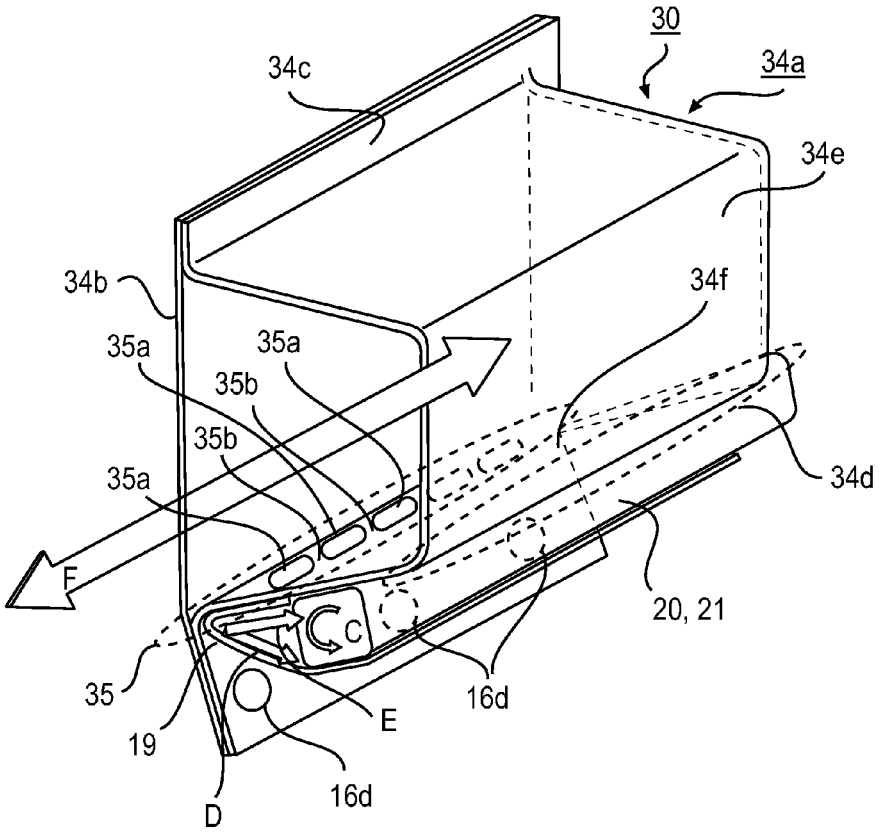
FIG. 18 is a sectional view of a developer accommodating container in a Second Embodiment of the present invention.

Each of the plurality of openings 35*a* in Embodiment 1 has a circular shape. When a discharging property is taken into consideration, an area of the openings 35*a* may preferably be large. Further, the connecting portions 35*b* defining the openings 35*a* may preferably be large (thick) in order to enhance the strength of the developer bag 16. Therefore, the area of the openings 35*a* and the area of the connecting portions 35*b* are required to achieve a balance in view of a material and a thickness of the discharging portion 35 and a force relationship with peeling strength during the unsealing described later and may be appropriately selected. Further, the shape of the openings 35*a* may also be, in addition to the circular shape, a polygonal shape such as a rectangular shape, an elongated circular shape as shown in FIG. 18 in Embodiment 2 described later, and the like shape.

Incidentally, the arrangement of the openings 35*a* may only be required to be disposed at the different positions with respect to the direction F perpendicular to the unsealing direction E, and even when the openings 35*a* overlap with each other as shown in (c) of FIG. 28, or do not overlap with each other as shown in (d) of FIG. 28, there is an effect of the connecting portions 35*b* described later.

Further, the direction of the openings 35*a* may preferably be such that the developer accommodated in the developer bag 16 is easily discharged in an attitude during image formation. For that reason, in the attitude during image formation, the openings 35*a* are disposed so as to be open downward with respect to the gravitational direction. Here, the downward opening of the openings 35*a* with respect to the gravitational direction refers to that the direction of the openings 35*a* has a downward component with respect to the gravitational direction.

(Fixing Between Developer Bag and Frame)

As shown in FIG. 3 and FIG. 4, the developer bag 16 is fixed inside the first frame 17 and the second frame 18 by the two fixing portions 16*d* and 16*e*.

(First Fixing Portion)

First, as a first fixing portion, the first fixing portion 16*d* of the developer bag 16 where a force is received when the sealing member 19 is unsealed from the developer bag 16 as described later is provided. The first fixing portion 16*d* is provided at a plurality of positions in parallel to the direction F in which the plurality of openings 35*a* are arranged. Incidentally, other than the arrangement at the plurality of positions, the first fixing portion 16*d* may also be a single fixing portion elongated in parallel to the direction F (not shown).

Further, the position of the first fixing portion 16*d* is provided in the neighborhood of the openings 35*a*.

Further, the first fixing portion 16*d* of the developer bag 16 is fixed to a first fixing portion 18*a* of the frame.

The first fixing portion 16*d* is a fixing portion necessary for the time of unsealing the developer bag 16, and its action and arrangement will be described later in the description of the unsealing.

(Second Fixing Portion)

Further, as a second fixing portion, the second fixing portion 16*e* for preventing movement of the developer bag 16 downward or toward the developing roller 13 and the developer supplying roller 23 is provided.

The second fixing portion 16*e* is provided for the following two reasons. A first reason is that the second fixing portion 16*e* is prevented from moving downward in the attitude during the image formation. For that reason, the second fixing portion 16*e* may preferably be disposed at an upper position in the attitude during the image formation.

Further, a second reason is that the developer bag 16 is prevented from disturbing the image in contact with the developing roller 13 and the developer supplying roller 23 during the image formation. For that reason, the second fixing portion 16*e* of the developer bag 16 may preferably be provided at a position remote from the developing roller 13 and the developer supplying roller 23. In this embodiment, the second fixing portion 16*e* of the developer bag 16 is disposed at an upper position remote from the developing roller 13 as shown in FIG. 1.

Further, the second fixing portion 16*e* of the developer bag 16 is fixed to a second fixing portion 18*b* of the frame.

(Fixing Method Between Developer Bag and Frame)

(Fixing Method of First Fixing Portion)

As a fixing method of the first fixing portion 16*d* of the developer bag 16, fixing by ultrasonic clamping (caulking) such that a boss of the second frame 18 is passed through the hole of the developer bag 16 to be deformed is used. As shown in (a) of FIG. 27, before fixing, the first fixing portion 18*a* of the second frame 18 has a cylindrical boss shape, and the first fixing portion 16*d* of the developer bag 16 has a hole which is open. An assembling step is shown below.

Figure 27:
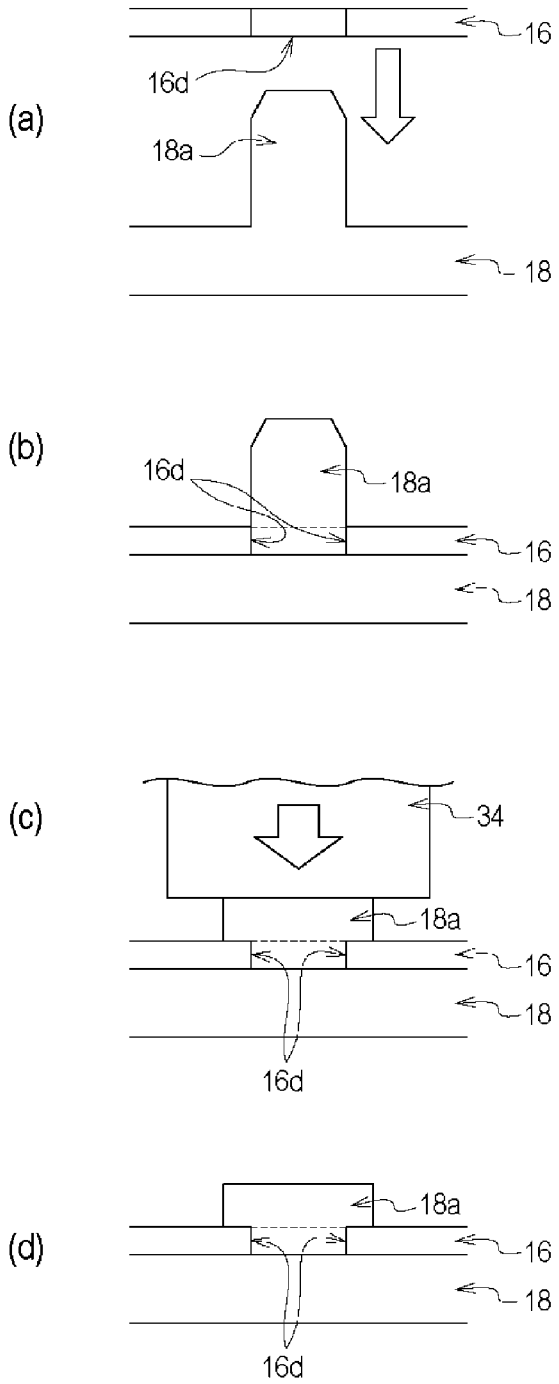
FIG. 27 includes illustrations of a fixing portion of the developer accommodating container in the embodiment of the present invention.

First, a projected-shaped portion of the first fixing portion 18*a* of the second frame 18 is passed through the hole of the first fixing portion 16*d* of the developer bag 16 ((b) of FIG. 27).

Then, an end of the first fixing portion 18*a* of the second frame 18 is fused by an ultrasonic clamping tool 34 ((c) of FIG. 27).

Then, the end of the first fixing portion 18*a* of the second frame 18 is deformed so that it is larger than the hole of the first fixing portion 16*d*, so that the developer bag 16 is fixed to the second frame 18 ((d) of FIG. 27).

(Fixing Method of Second Fixing Portion)

Figure 24:
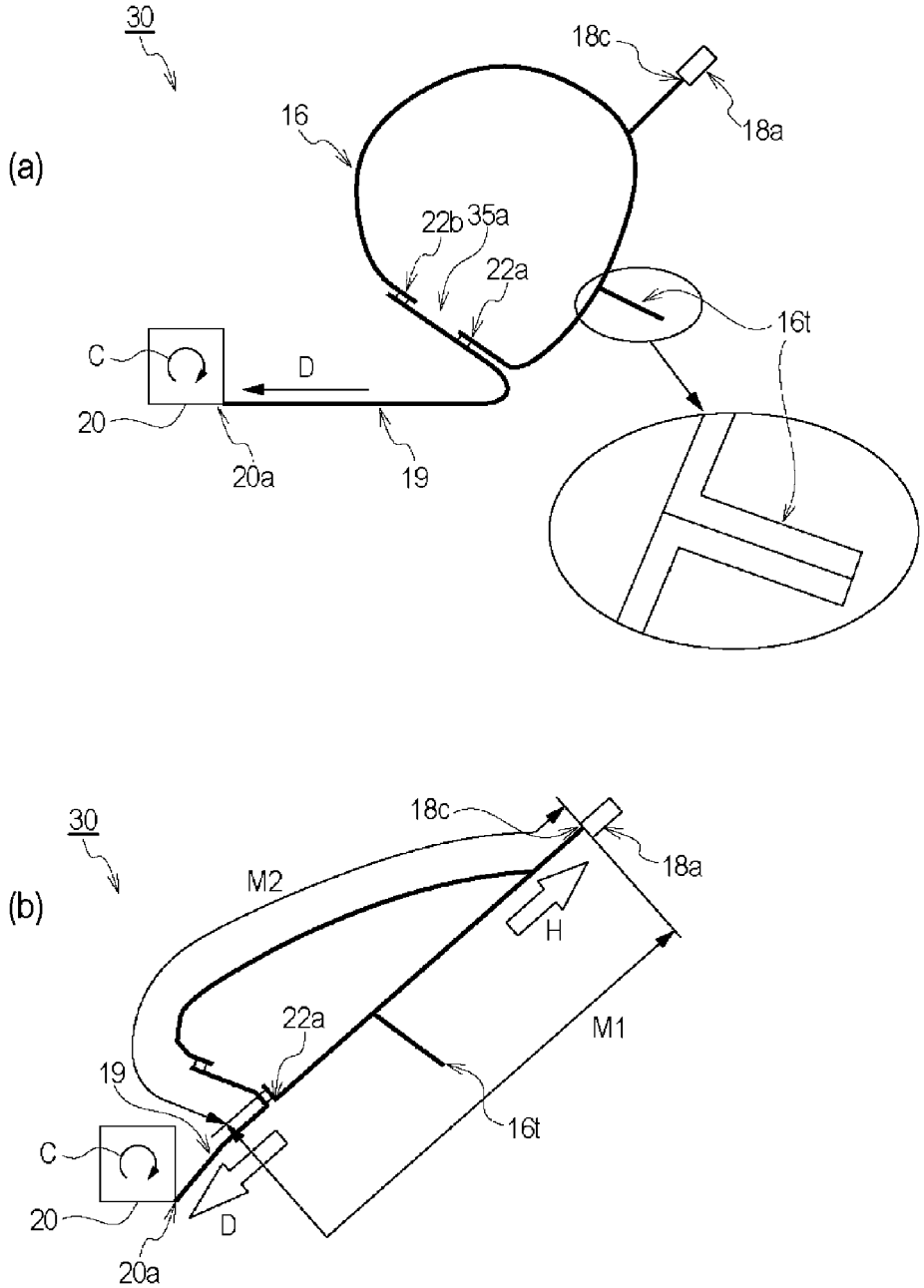
FIG. 24 includes illustrations of the developer accommodating container in the embodiment of the present invention.

As shown in FIG. 24, a fixing method of the second fixing portion 16*e* of the developer bag 16 uses clamping by the two frames 17 and 18. Holes are made in the developer bag 16 to constitute the first fixing portion 16*e* of the developer bag 16, and projections are provided to the second frame 18 to constitute the second fixing portion 18*b* of the frame.

Then, an assembling step is shown below. The projections of the fixing portion 18*b* of the second frame 18 are passed through the first fixing portion 16*d* of the developer bag 16, and then fixing by clamping such that the second fixing portion (holes) 16*e* of the developer bag is prevented from being disengaged (dropped) from the projections by the first frame 17.

(Other Fixing Means)

As fixing means, other than the above-described ultrasonic clamping, it is also possible to use fixing means other than those using ultrasonic wave. For example, heat clamping using heat, (heat) welding or ultrasonic welding for directly welding the developer bag 16 to the first frame 17 and the second frame 18, bonding using a solvent or an adhesive, insertion of the developer bag 16 between the frames, the heat clamping, the ultrasonic clamping, a screw, or hooking using of holes and projections (such as bosses), and the like means may also be used. Further, the developer bag 16 may also be fixed via a separate member provided between the first or second frame 17 or 18 and the developer bag depending on appropriate design based on relationships in space, arrangement or the like between the developer bag 16 and the first or second frame 17 or 18 (not shown).

<Structure of Sealing Member>

As shown in FIGS. 3 and 4, the sealing member 19 covers the discharging opening 35 of the developer bag 16 before use of the process cartridge A to seal the developer in the developer bag 16. The sealing member 19 is moved, so that the openings 35*a* are exposed. The structure of the sealing member 19 has a sheet-like shape including a sealing portion 19*a* for covering the discharging portion 35 of the developer bag 16, a portion-to-be-engaged 19*b* to be fixed with the unsealing member 20 described later, and a sealing member connecting portion 19*c* which connects the sealing portion 19*a* and the portion-to-be-engaged 19*b*. The sheet is formed of a laminate material having a sealant layer which exhibits an easy-unsealing property described later, and a base material is polyethylene terephthalate (PET), polyethylene, polypropylene or the like, and a thickness may appropriately be selected from a range of 0.03-0.15 mm.

(Sealing Portion of Sealing Member)

The sealing portion 19*a* refers to a region where the sealing member 19 seals the plurality of openings 35*a* and connecting portions 35*b* of the developer bag 16. By the sealing portion 19*a*, the developer is prevented from being leaked from the inside of the developer bag 16 until before use of the process cartridge A.

(Engaging Portion of Sealing Member)

The sealing member 19 has a free end portion in one end side thereof with respect to the unsealing direction E, and at the free end portion, the portion-to-be-engaged 19*b* to be engaged with the unsealing member for moving the sealing member is provided. With the portion-to-be-engaged 19*b*, the unsealing member for moving the sealing member so as to expose the openings is engaged. The unsealing member may also be configured to automatically perform the unsealing by receiving drive (driving force) from the image forming apparatus main assembly B. Or, the unsealing member may also be configured to perform the unsealing by being held and moved by the user. In this embodiment, the unsealing member 20 is a rotation shaft provided in the frame, and the sealing member 19 engaged with the unsealing member 20 is pulled, so that the developer accommodating container 26 accommodating the developer is unsealed.

(Sealing Member Connecting Portion of Sealing Member)

A portion for connecting the bonding portion 22 and the sealing member engaging portion 19*b* is the sealing member connecting portion 19*c*. The sealing member connecting portion 19*c* is a portion for transmitting a force so as to pull off the bonding portion 22 by receiving the force from the unsealing member 20.

(Folding-Back of Sealing Member Connecting Portion)

Figure 12:
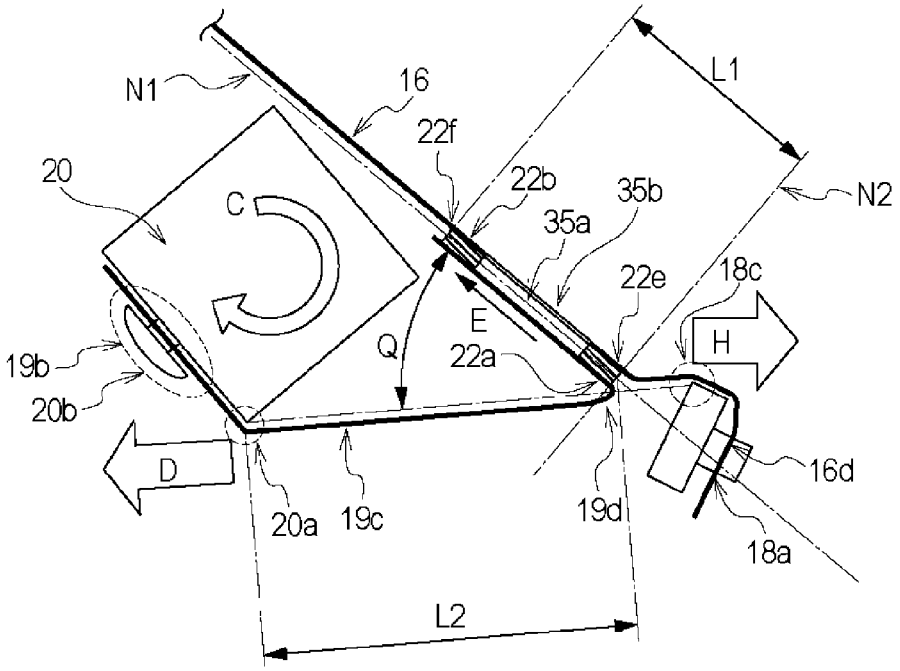
FIG. 12 is a sectional view for illustrating the discharging portion in the embodiment of the present invention.

Here, referring to FIG. 12, a plane formed between the first bonding portion 22*a* and the second bonding portion 22*b* at the movement of the unsealing is taken as N1. A plane which is perpendicular to the plane N1 and which passes through the first bonding portion 22*a* is taken as N2. Here, the unsealing member 20 is disposed in the second bonding portion 22*b* side than the plane N2 passing through the first bonding portion 22*a*. In other words, the sealing member 19 includes, when it is seen along the surface of the sheet-like sealing member 19, a fold(ed)-back portion 19*d* where the sealing member 19 is folded back at the portion (connecting portion 19*c*) between the connecting portion 22 and the portion-to-be-engaged 19*b* engaged with the unsealing member 20. The fold-back portion 19*d* may be provided with or not provided with a fold (crease). Here, a folding angle Q of the sealing member 19 may preferably be 90 degrees or less. The folding angle Q is a narrow angle Q between a surface of the bonding portion 22 of the developer bag 16 and a surface along the direction D in which the sealing member 19 is pulled.

(Fixing of Sealing Member)

Further, fixing between the sealing member 19 and the unsealing member 20 is, in this embodiment, made by the ultrasonic clamping similarly as in the first fixing portion 16*d*. Other than the ultrasonic clamping, the fixing may also be made by the (heat) welding, the ultrasonic welding, the bonding, the insertion between the frames, the hooking by a hole and a projection, or the like similarly as the fixing means for the first fixing portion 16*d* and the second fixing portion 16*e*.

(Portion Having Easy-Unsealing Property of Sealing Member)

Next, a method of providing a peeling force of the bonding portion 22 with a desired value will be described. In this embodiment, in order to provide the peeling force with the desired value (herein a minimal force within a range in which the toner sealing property can be maintained), two methods are principally employed.

In a first method, a laminate material having a sealant layer for enabling easy unsealing of the sealing member 19 is applied. Further, the first method is a method in which the easy unsealing is enabled at the bonding portion by applying, as the material for the developer bag 16, a sheet material (of, e.g., polyethylene or polypropylene) which is weldable with the sealant layer and which has flexibility. By changing a combination of formulation of the sealant layer with the material to be bonded, the peeling force can be adjusted correspondingly to a desired condition. In this embodiment, a material having a peeling strength of about 3N/15 mm measured by testing methods for hermetically sealed flexible packages of JIS-Z0238 is used.

A second method is a method in which as shown in FIG. 4 and FIG. 7, the discharging portion 35 of the developer bag 16 is placed in a state in which the sealing member 19 is folded back with respect to an unsealing advancing direction (arrow E in the figures). For example, in the state of FIG. 4, the unsealing member 20 is rotated (an arrow C in the figure), so that the sealing member 19 is pulled in a pulling direction (arrow D in the figure) by the unsealing member 20. By doing so, the developer bag 16 and the sealing member 19 provide an inclined peeling positional relationship, as shown in FIG. 12, in which the narrow angle Q between the surface of the bonding portion 22 of the developer bag 16 and the surface along the pulling direction D of the sealing member 19. It has been conventionally known that the peeling force necessary to pull off the both surfaces can be reduced by effecting the inclined peeling. Accordingly, as described above, the sealing member 19 is placed in the folded-back state with respect to the unsealing advancing direction (arrow E in the figure), so that the sealing member 19 at the bonding portion 22 and the developer bag 16 are placed in the inclined peeling positional relationship, and the peeling force can be adjusted so as to be reduced.

<Structure of Unsealing Member>

The unsealing member 20 is used for the purpose of peeling the sealing member 19 from the developer bag 16 by applying a force to the sealing member 19 to move the sealing member 19. The unsealing member 20 includes a supporting portion (not shown) which has a shaft shape and which is rotatably supported by the second frame 18 at its ends, and includes an engaging portion 20*b* for fixing the portion-to-be-engaged 19*b* of the sealing member 19. In this embodiment, the unseal member 20 has a rectangular shaft shape, and the portion-to-be-engaged 19*b* of the sealing member 19 is engaged with the engaging portion 20*b* at one surface of the rectangular shaft.

(Combined Use as Unsealing Member, Urging Member and Stirring Member)

Further, the urging member 21 for externally acting on the developer bag 16 to discharge the developer accommodated in the developer bag 16, and the unsealing member 20 may be separate members, respectively, but in this embodiment, the same part performs functions of the unsealing member 20 and the urging member 21.

Further, a function of stirring the developer discharged from the developer bag 16 and a function of the unsealing member 20 may be performed by separate members, respectively, but in this embodiment, the unsealing member 20 also perform the stirring function as the same part.

(Effect of Combined Use as Unsealing Member, Urging Member and Stirring Member)

Thus, by using the same part (member) as the unsealing member 20, the urging member 21 and the stirring member, the number of parts is reduced, so that it becomes possible to realize cost reduction and space saving.

<Summary of Unsealing of Developer Accommodating Bag>

The unsealing of the developer accommodating bag 16 will be described with reference to FIG. 7 and FIG. 8.

The developing device 38 includes a power application point portion 20*a* where the unsealing member 20 applies the force for pulling the sealing member 19 in order to effect the unsealing, and includes the fixing portion 18*a* of the frame for fixing the developer bag 16 to be pulled.

The power application point portion 20*a* is a portion, closest to the bonding portion 22, of a portion where the sealing member 19 and the unsealing member 20 contact at the moment of the unsealing. In (b) of FIG. 7, a corner portion 20*c* of the unsealing member is the power application point portion 20*a*. The fixing portion 18*a* of the second frame 18 includes a fixing portion 18*c* for suppressing movement of the developer bag 16 caused by the force during the unsealing. Further, from the bonding portion 22, in this embodiment, the first fixing portion 18*a* of the frame and the first bonding portion 16*d* of the developer bag are bonded by the ultrasonic clamping, and as shown in (b) and (c) of FIG. 7 and (a) of FIG.

8, a portion, near the bonding portion 22, of the ultrasonic clamping portion of the first fixing portion 18*a* constitutes the fixing portion 18*c*.

Figure 50A:
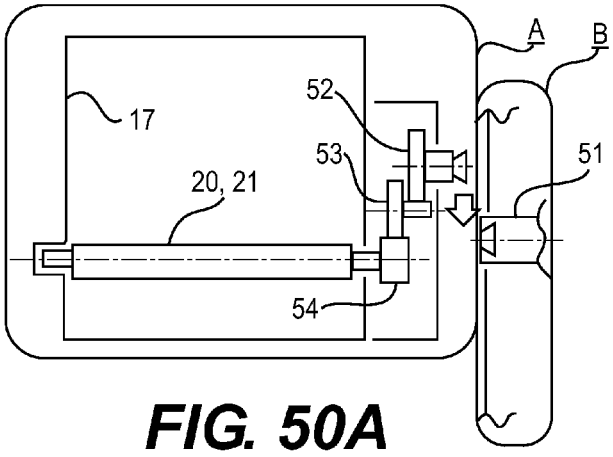
FIG. 50 includes schematic illustrations of drive transmission to an unsealing member in the embodiment of the present invention.
Figure 50B:
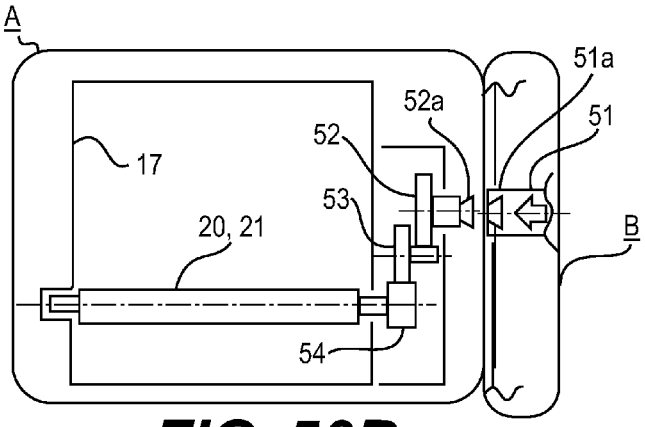
Figure 50C:
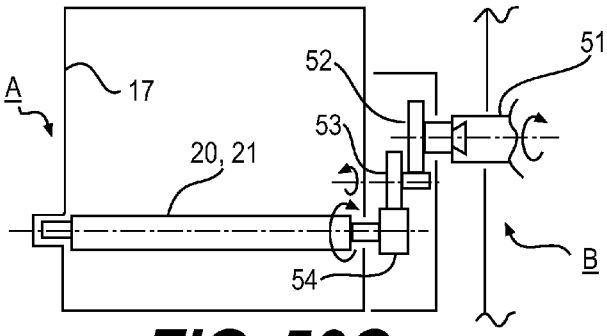
Figure 51A:
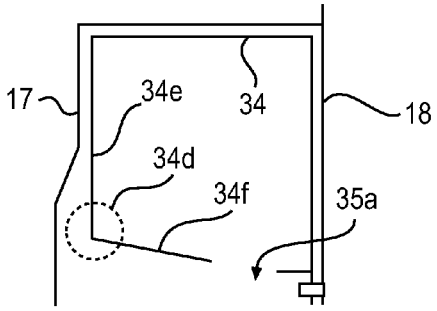
FIG. 51 includes sectional views of the developer accommodating unit in the embodiment of Embodiment 7 of the present invention.
Figure 51B:
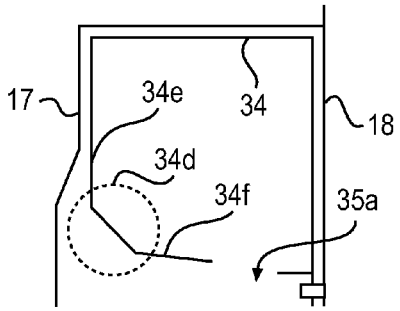
Figure 51C:
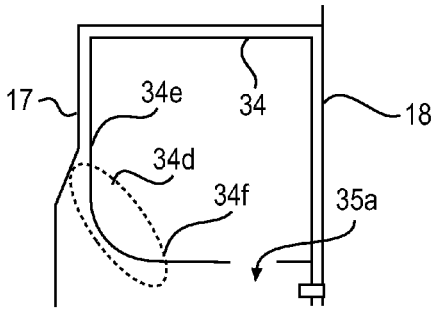
Figure 51D:
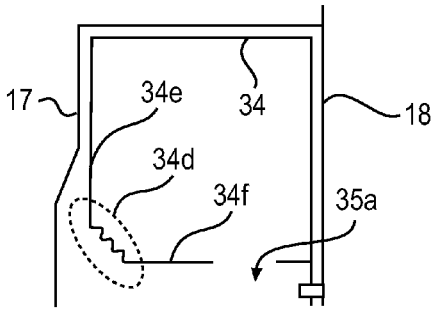
Figure 52:
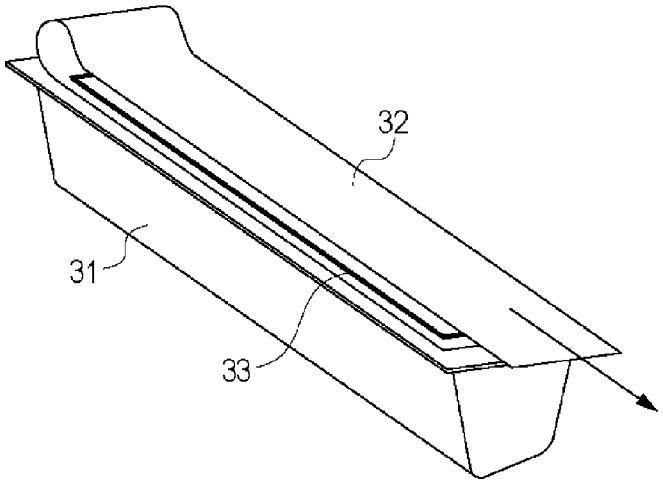
FIG. 52 is a view for illustrating a conventional example.

Next, drive transmission of the unsealing member 20 will be described by using FIG. 50. FIG. 50 includes schematic illustrations showing the drive transmission to the unsealing member 20. Incidentally, in FIG. 50, the sealing member 19 and the developer bag 16 and the like are omitted. First, the unsealing member 20 is rotatably supported at its ends by the first frame 17. Further, a gear 54 is connected to the unsealing member 20 at one-side end portion. Further, gears (52, 53) are disposed in the cartridge A. Further, the gear 52 includes a coupling portion 52*a* for receiving the drive (driving force) from the image forming apparatus B. The image forming apparatus B is provided with a driving means 51, and the driving means 51 includes, at its end, a coupling 51*a* for transmitting the drive to the cartridge A.

With respect to an arrow direction shown in (a) of FIG. 50, the cartridge A is mounted to the inside of the image forming apparatus B. Next, the driving means 51 is moved in an arrow direction shown in (b) of FIG. 50, so that the coupling portion 51*a* of the driving means 51 and the coupling 52*a* of the gear 52 are engaged with each other. Then, as shown in (c) of FIG. 50, the drive is transmitted from the driving means 51 of the image forming apparatus B to the gear 52, the gear 53 and the gear 54, so that the unsealing member 20 is rotated. Incidentally, the drive transmission from the image forming apparatus B to the cartridge B is not limited to the coupling by projection and recess, but may also be use of a means, such as engagement by gears or the like, capable of the drive transmission.

Then, as shown in FIG. 4, the unsealing member 20 is rotated in the arrow C direction by transmission of the driving force thereto.

Figure 5:
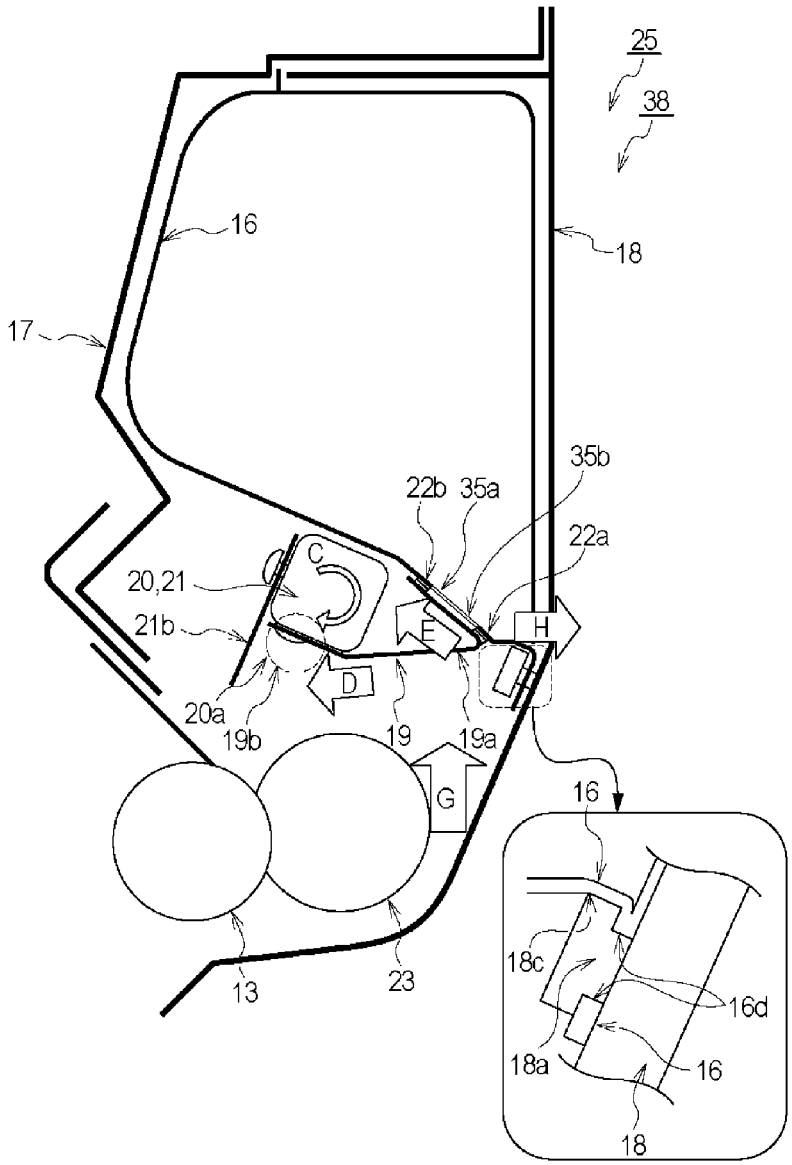
FIG. 5 is a sectional view of the developer accommodating unit immediately before the unsealing in the embodiment of the present invention.

Then, a state immediately before the sealing member 19 is pulled by further rotation of the unsealing member 20 to start the unsealing of the first bonding portion 22*a* is shown in FIG. 5 and (b) of FIG. 7. With the rotation, the sealing member 19 fixed to the unsealing member 20 by the portion-to-be-engaged 19*b* is pulled in the arrow D direction by the corner portion 20*c* (power application point portion 20*a*) of the rectangular unsealing member 20.

When the sealing member 19 is pulled, the developer bag 16 is pulled via the bonding portion 22. Then, a force is applied to the first fixing portion 16*d* of the developer bag 16, so that the developer bag 16 is pulled from the fixing portion 18*c* toward the power application point portion 20*b* by the fixing portion 18*c*. Then, in a cross section perpendicular to the rotation shaft of the unsealing member 20, the first bonding portion 22*a* is moved so as to approach a line connecting the power application point portion 20*a* and the fixing portion 18*c*. At this time, with respect to the arrow D direction, from a side close to the rotation shaft of the unsealing member 20, the portions are disposed in the order of the openings 35*a*, the first bonding portion 22*a*, the fold-back portion 19*d* and the fixing portion 18*c* ((b) of FIG. 7). Further, the unsealing member 19 is folded back between the first bonding portion 22*a* and the portion-to-be-engaged 19*b* and therefore the force is applied to the portion of the first bonding portion 22*a* so as to be inclination-peeled in the arrow D direction. Then, the peeling of the first bonding portion 22*a* is effected to start the unsealing of the discharging portion 35.

Further, together with the corner portion 20*c*, also the power application point portion 20*a* is moved in the arrow C direction, and when the sealing member 19 contacts a corner portion 20*d*, the power application point portion 20*a* is moved from the corner portion 20*c* to the corner portion 20*d*. Here, (b) of FIG. 7 shows a state in which the power application point portion 20*a* is the corner portion (c), and (c) of FIG. 7 shows a state in which the unsealing member 20 in further rotated and the power application point portion is moved to the corner portion 20*d*.

Figure 6:
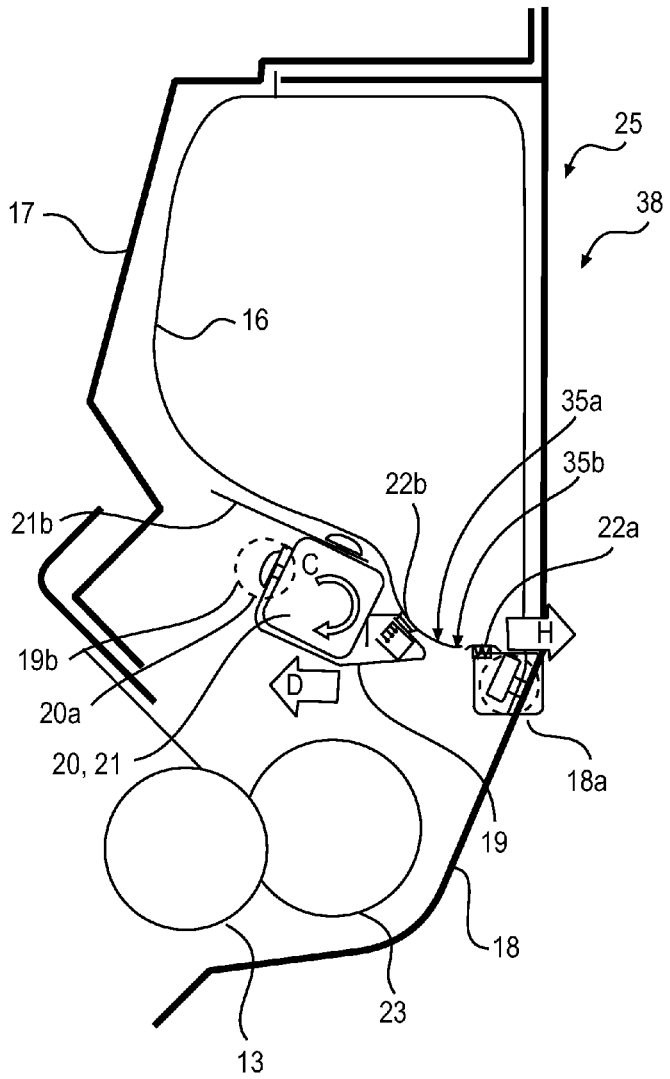
FIG. 6 is a sectional view of the developer accommodating unit during unsealing in the embodiment of the present invention.

As shown in FIG. 6 and (c) of FIG. 7, together with advance of the unsealing with further rotation of the unsealing member 20, also the fold-back portion 19*d* advanced in the arrow E direction. Then, the unsealing further advances, so that the openings 35*a* are exposed. A state in which the peeling of the second bonding portion 22*b* is to be started after the openings 35*a* are exposed is shown in (a) of FIG. 8. Also at this time, similarly as the peeling of the first bonding portion 22*a*, the sealing member 19 is pulled toward the power application point portion 20*a*, and the developer bag 16 stands firm toward a direction of the fixing portion 18*c* (arrow H). Then, in a cross section perpendicular to the rotation shaft of the unsealing member 20, the second bonding portion 20*b* is moved so as to approach a line connecting the power application point portion 20*a* and the fixing portion 18*c*. Then, the force is applied to the portion of the bonding portion 22*b* in the arrow D direction, so that the second bonding portion 22*b* is peeled. Then, the second bonding portion 22*b* is peeled to complete the unsealing ((b) of FIG. 8 and FIG. 9). Then, the developer inside the developer bag 16 passes through the openings 35*a* of the discharging portion 35, and is disposed in an arrow I direction.

Thus, the sealing member 19 is wound up around the unsealing member 20 by the rotation of the unsealing member 20, so that the bonding portion 22 is unsealed. The sealing member 19 is wound up by the rotation and therefore a space required to move the unsealing member 20 may only be required to be a rotation space, and compared with the case where the sealing member 19 is moved by movement other than the rotation, it is possible to realize space saving.

Further, the openings 35*a* may also be exposed by rotating the unsealing member 20 by the user to wind up the sealing member 19. However, it is preferable that the unsealing member 20 is rotated by the drive from the image forming apparatus B to wind up the sealing member 19 since the operation does not trouble the user.

By providing the sealing member 19 with the fold-back portion 19*d*, the bonding portion 22 can be inclination-peeled without effecting shearing peeling and can be unsealed with reliability.

Further, the portion-to-be-engaged (19*b*), to be engaged with the unsealing member 20, for unsealing the sealing member 19 in an end side of the sealing member 19 with respect to a direction substantially perpendicular to the direction F in which the plurality of openings 35*a* are arranged is provided, so that the sealing member 19 can be engaged and unsealed with reliability.

Further, by providing the frame with the fixing portion 18*c*, the developer bag 16 is supported during the unsealing, so that even a soft and deformable developer bag 16 becomes unsealable with reliability.

Figure 8:
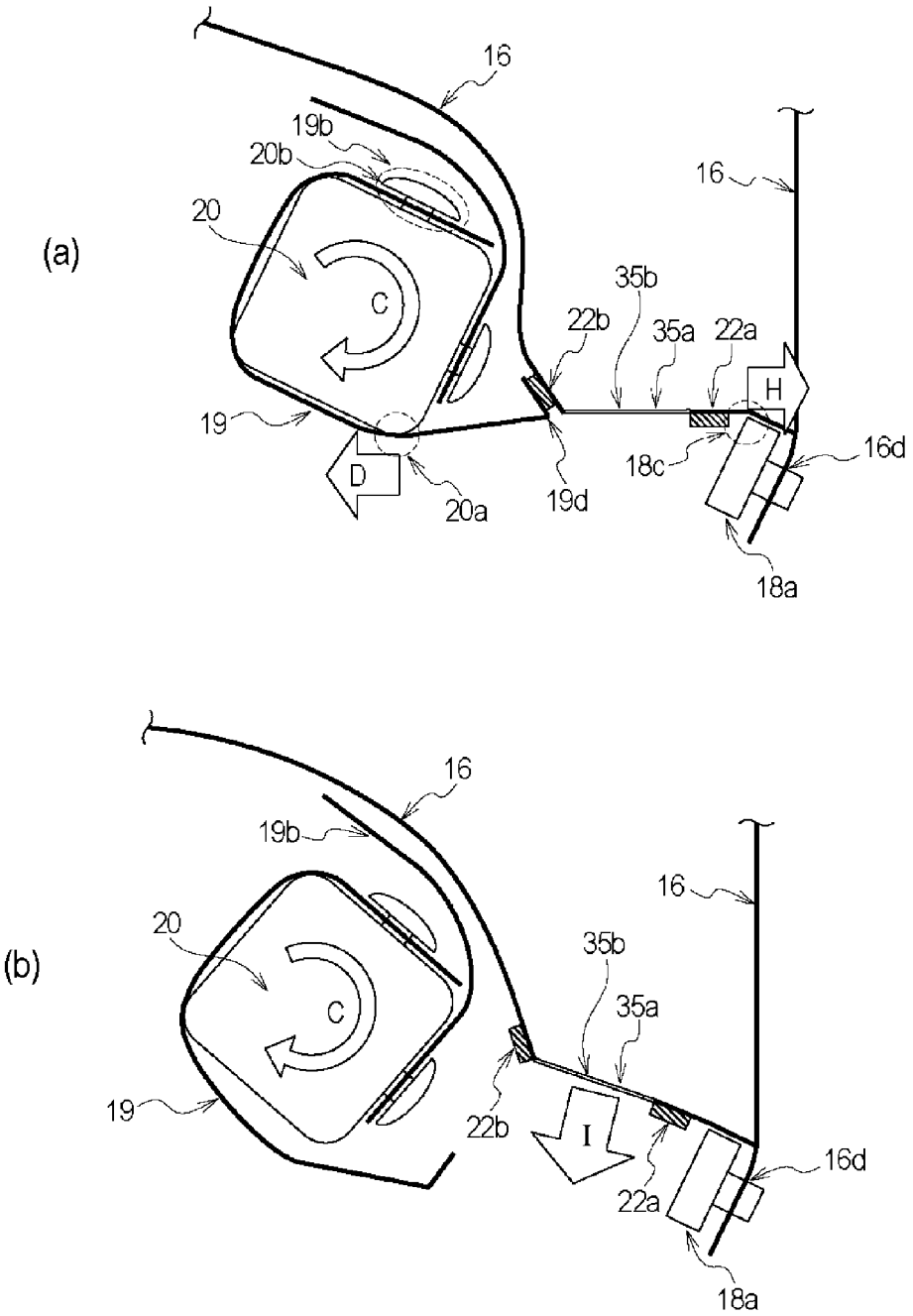
FIG. 8 includes sectional views for illustrating the process of unsealing the discharging portion in the embodiment of the present invention.

Further, with respect to the discharge of the developer during the unsealing, as described above, the bonding portion 22 is moved on the line connecting the power application point portion 20*a* and the fixing portion 18*c* (in the order of (a) of FIG. 7, (b) of FIG. 7, (c) of FIG. 7 and (a) of FIG. 8). By this motion, the developer at the periphery of the openings 35*a* is moved, so that agglomeration of the developer can be broken.

Figure 34:
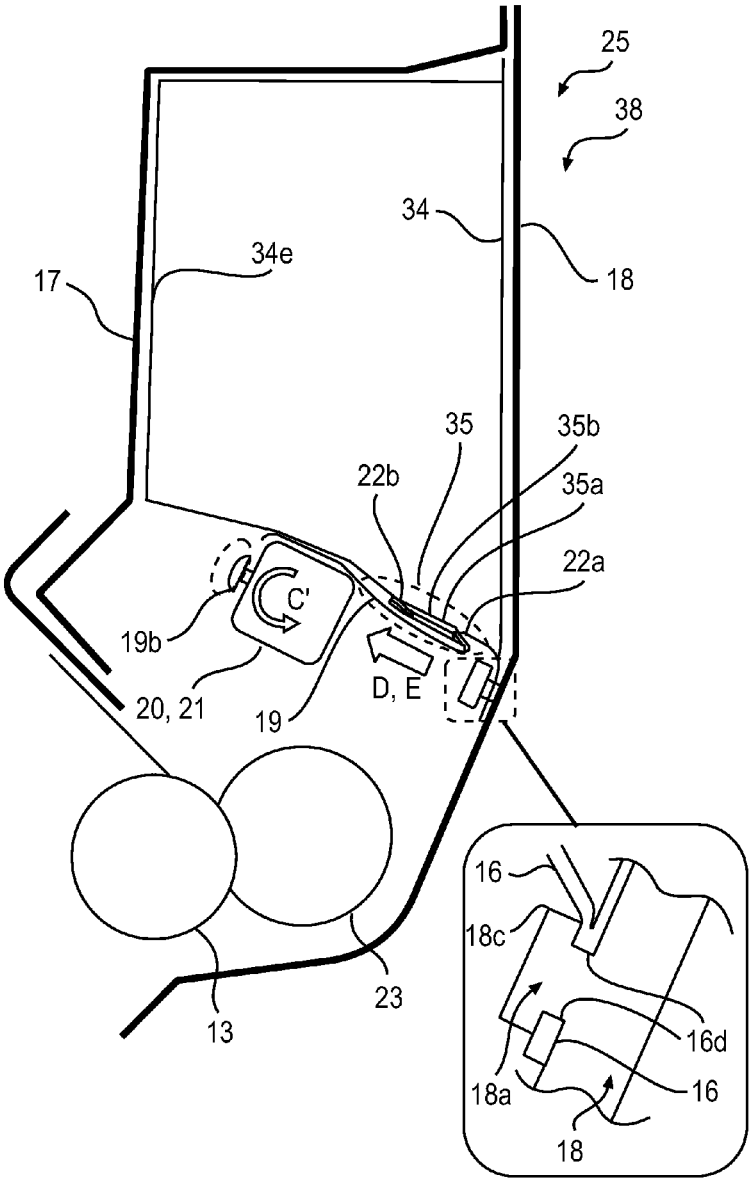
FIG. 34 is an illustration of the developer accommodating unit in the embodiment of the present invention.

Further, as shown in FIG. 34, the unsealing member 20 is unsealable even when the unsealing member 20 is rotated in a rotational direction of an arrow C2. Thus, the rotational direction of the unsealing member 20 is selectable from even the C direction shown in FIGS. 4 to 9 and the C2 direction of FIG. 34, and may appropriately be selected depending on design.

(Arrangement Relation of Fixing Portion Associated with Unsealing)

As shown in FIG. 4, in order to peel off the first bonding portion 22*b* with reliability, the following arrangement relation is required between the first bonding portion 22*b* and the fixing portion 18*c*. During the unsealing, with respect to the fixing portion 18*c*, the unsealing member 20 pulls the sealing member 19 in the arrow D direction. At this time, with respect to the movement direction D of the sealing member 19 by the unsealing member 20, the fixing portion 18*c* is provided in an upstream side of the openings 35*a*. For that reason, a force is applied to the fixing portion 18*c* in the arrow H direction. Therefore, when the unsealing force is applied, the sealing member 19 is pulled in the arrow H direction and the arrow D direction between the fixing portion 18*c* and the unsealing member 20 to apply a force to the first bonding portion 20*a*, thus advancing the unsealing in the arrow E direction. Thus, if the fixing portion 18*c* is not provided upstream with respect to the movement direction D of the sealing member 19, the entire developer bag 16 is pulled in the direction in which the unsealing member 20 is pulled, so that the force cannot be applied to the first bonding portion 22*a* and the unsealing cannot be effected.

In this way, the fixing portion 18*c* is provided upstream with respect to the movement direction D of the sealing member 19, so that reliable unsealing becomes possible.

(Distance Relation of Fixing Portion Associated with Unsealing)

Figure 22:
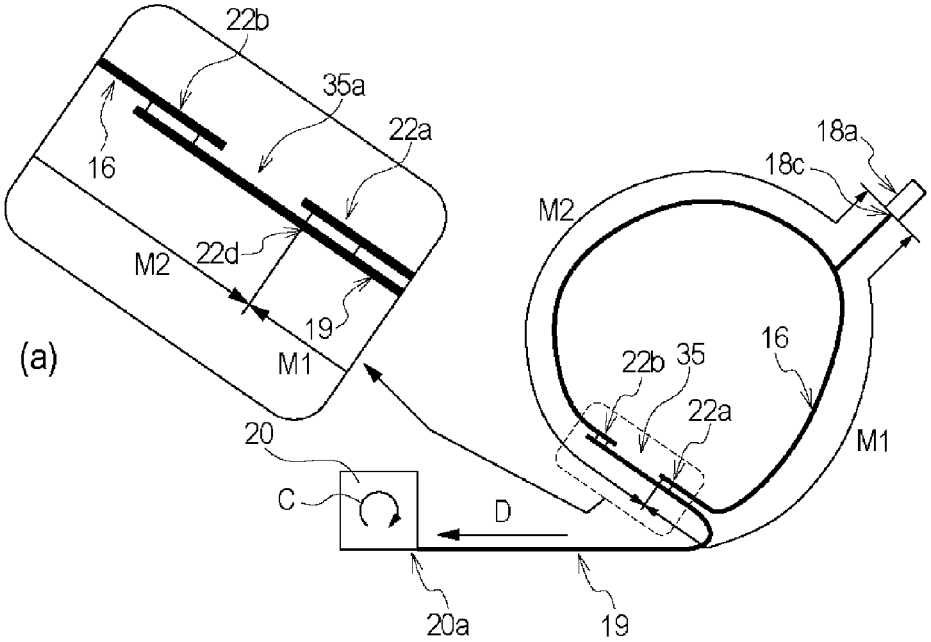
FIG. 22 includes illustrations of the developer accommodating container in the embodiment of the present invention.
Figure 22:
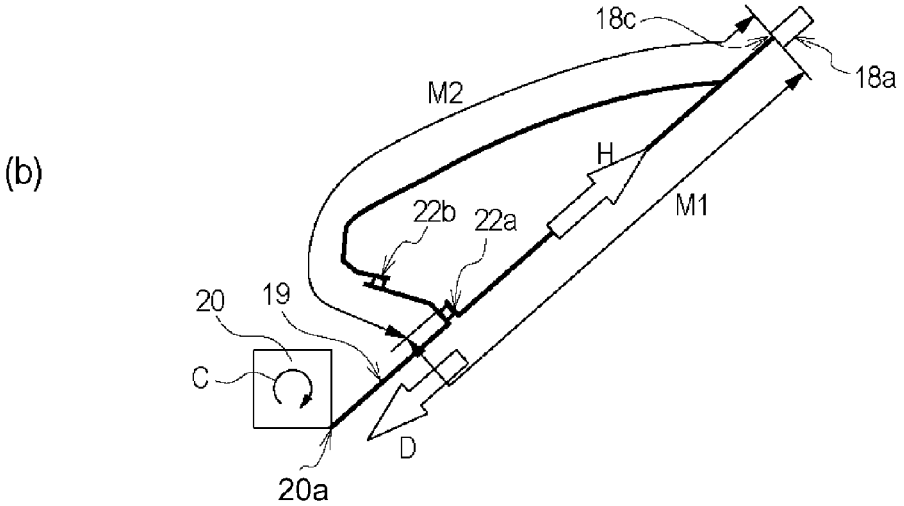
Figure 23:
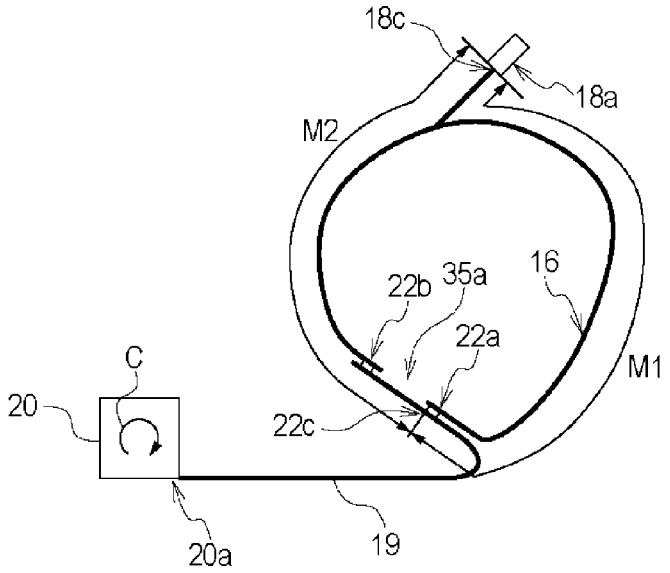
FIG. 23 includes illustrations of a developer accommodating container which is not the embodiment of the present invention.
Figure 23:
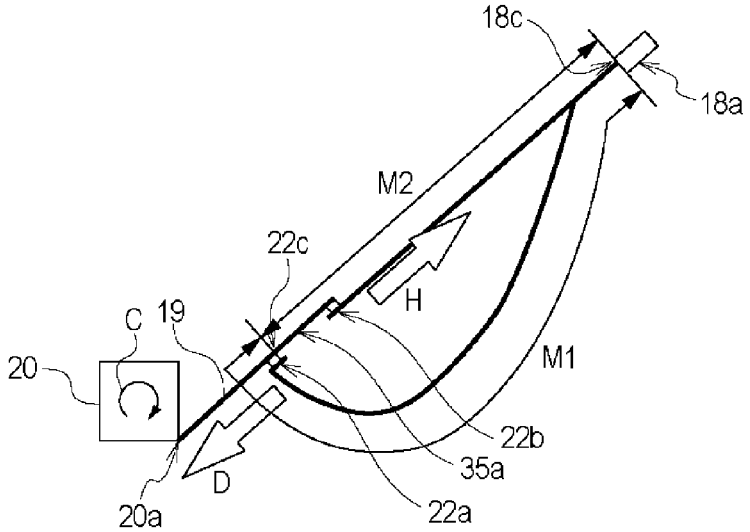

As shown in FIG. 22 and FIG. 23, in order to peel off the first bonding portion 22*b* with reliability, the following length relationship is required between the first bonding portion 22*a* and the fixing portion 18*c*. First, a point of the first bonding portion 22*a* finally peeled off when a flat surface which passes the unsealing member 20, the openings 35*a* and the fixing portion 18*c* and which is perpendicular to the rotation shaft of the unsealing member 20 is viewed, is a first point 22*d*. The first point 22*d* is an end portion point of the first bonding portion 22*a* close to the openings. Further, a distance from the fixing portion 18*c* to the first point 22*d* along the developer bag 16 is M1. Further, a distance measured, from the first fixing portion 18*d* to the first point 22*d*, along the developer accommodating bag 16 with respect to the direction including the openings 35*a* is M2. Incidentally, the openings 35*a* are a space in which the material for the developer bag 16 is not present but a width of the openings 16 is also included in the distance.

At this time, M1<M2 is satisfied to permit the peeling-off of the first bonding portion. Here, the above relationship of M1<M2 will be described specifically.

(Case of M1<M2)

First, in the case where M1<M2 is satisfied, as shown in FIG. 22, a force (arrow D) for pulling the sealing member 19 to the first bonding portion 22*a* by the unsealing member 20 and a retaining force (arrow H) of the fixing portion are applied to the first bonding portion 22*a*, so that the first bonding portion 22*a* can be inclination-peeled. By effecting the inclination peeling, the peeling force can be set at a low level. Here, (a) of FIG. 22 shows before the unsealing, and (b) of FIG. 22 shows immediately before the first bonding portion 22*a* is unsealed.

(Case of M1>M2)

On the other hand, in the case of M1>M2, as shown in FIG. 23, the pulling force by the unsealing member 20 is not applied to the first bonding portion 22*a* but is applied to the second bonding portion 22*b*. In this case, the force is not applied to the first bonding portion 22*a* and therefore the first bonding portion 22*a* is not peeled. In this case, the force (arrow D) from the unsealing member 20 and the retaining force (arrow H) of the fixing portion 18*c* are applied to the second bonding portion 22*b*. In this state, to the second bonding portion 22*b*, the force (arrow D) for pulling the sealing member 19 by the unsealing member 20 and the retaining force (arrow H) of the fixing portion 18*c* (in the arrow H direction) are applied, and at the portion of the second bonding portion 22*b*, the peeling relationship is a shearing peeling relationship and therefore it is difficult to unseal the second bonding portion 22*b*. This is because the shearing peeling requires a large force compared with the inclination peeling.

Here, (a) of FIG. 23 is a view before the unsealing, and (b) of FIG. 23 is a view when the force (arrow D) for pulling the sealing member 19 by the unsealing member 20 is applied to the bonding portion (the second bonding portion in this case) by the rotation of the unsealing member 20. Further, to the second bonding portion 22*b*, the force is applied but is applied based on the shearing peeling relation, and therefore compared with the case of the inclination peeling, a very large force is required, so that it becomes difficult to reduce the peeling force.

(Distance in Case Where Projection (Rib) is Present)

Incidentally, here, definition of a manner of measuring the above-described distances M1 and M2 will be described. The distances M1 and M2 are important when the sealing member 19 is pulled during the unsealing. In the case where there is no projection rib 16*t* at an intermediate position of paths of M1 and M2, the distances developed as shown in FIG. 22 and FIG. 23 may only be required to be measured. Further, as shown in FIG. 24, in the case where there is the projection 16*t* formed, by bonding in manufacturing, at the intermediate position of the paths of M1 and M2, even when the sealing member 19 is pulled during the unsealing, the projection 16*t* is not elongated (peeled off) and therefore the portion of the projection 16*t* is not included in the distances M1 and M2. That is, the portion, such as the projection 16*t*, which does not affect transmission of the force is not included in the distances M1 and M2.

As described above, based on the relationship of M1<M2, the first bonding portion 22*a* is unsealed earlier than the second bonding portion 22*b*. By the earlier unsealing of the first bonding portion 22*a* than the second bonding portion 22*b*, the fold-back portion 19*d* of the sealing member 19 can be provided at the first bonding portion 22*a*. By this fold-back portion 19*d*, the peeling is not the shearing peeling but is the inclination peeling. By this, with reliability, the sealing member 19 can be peeled off from the developer bag 16, so that it is possible to provide an unsealable developing device 38.

(Case of Plurality of Fixing Portions)

Figure 31:
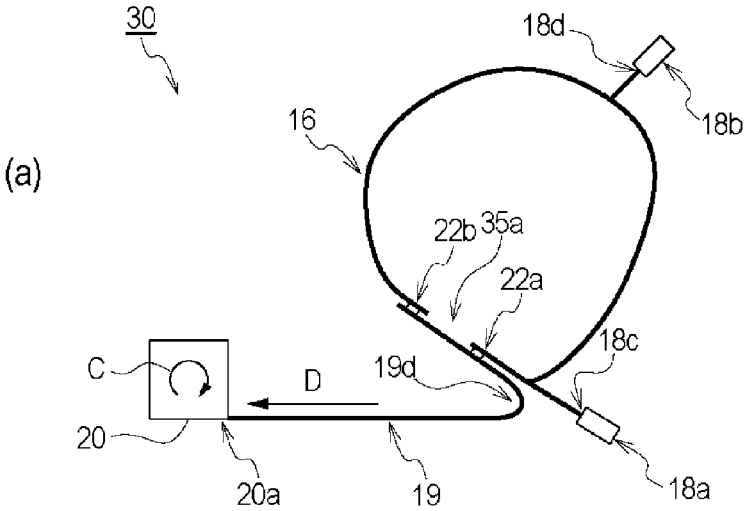
FIG. 31 includes illustrations of the developer accommodating container including an unsealing member.
Figure 31:
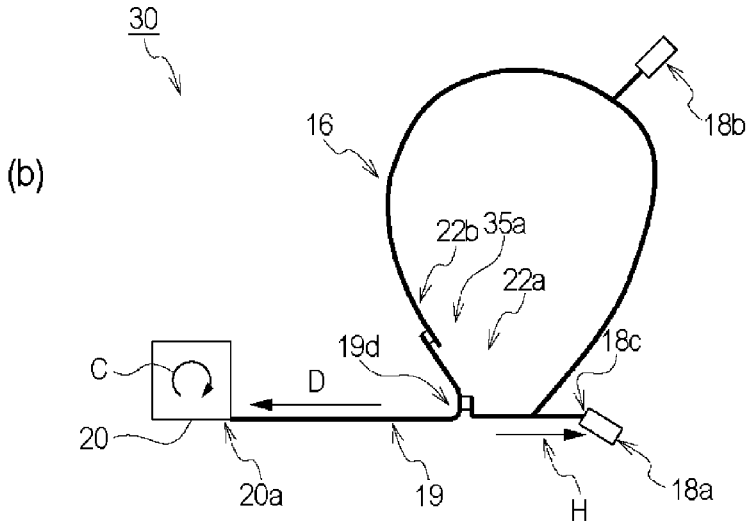

Here, a relation between a plurality of fixing portions and the unsealing will be described by using FIG. 31. Immediately, before the unsealing member 20 is rotated from a state of (a) of FIG. 31 to unseal the first bonding portion 22*a* is (b) of FIG. 31. In this embodiment, the first fixing portion 18*a* and the second fixing portion 18*b* are provided. Here, the force during the unsealing is applied to the first fixing portion 18*a* disposed at a place close to the first bonding portion 22*a* which is first unsealed while sandwiching the openings 35*a* between the portions 22*a* and 22*b*. For that reason, the second bonding portion 22*b* is not required to be taken into consideration of the measuring manners of the distances M1 and M2 described above. Thus, in the case where there are the plurality of fixing portions, the fixing portion disposed at the place close to the first bonding portion 22*a* which is first unsealed while sandwiching the openings 35*a*, between the portions 22*a* and 22*b*, to which the force during the unsealing is to be applied may be used as a basis (of the unsealing).

(Positional Relation of Second Bonding Portion)

An arrangement in which the second bonding portion 22*b* can be more satisfactorily unsealed without being wound up around the unsealing member 20 will be described by using FIG. 12 shows a state immediately before the first bonding portion 22*a* is unsealed. First, an end portion of the first bonding portion 22*a* in a side remote from the openings 35*a* is a second point 22*e*. An end portion of the second bonding portion 22*b* in a side remote from the openings 35*a* is a third point 22*f*. Here, a distance from the second point 22*e* to the third point 22*f* is L1. Further, a distance from the second point 22*e* to the power application point portion 20*a* is L2. At this time, a relationship between the distance L1 and the perpendicular to L2 needs a relationship of L1<L2.

The reason thereof is that in the case where L1 is distance L2, the second bonding portion 22*b* reaches the power application point portion 22*a* before the peeling of the second bonding portion 22*b* is ended, and the second bonding portion 22*b* is wound about the unsealing member 20. The force cannot be applied so as to peel off the sealing member 19 from the second bonding portion 22*b*. For that reason, it becomes difficult to unseal the sealing member 19 from the developer bag 16.

As described above, the relationship between the distance L1 and the distance L2 is made L1<L2, the sealing member 19 is satisfactorily unsealable without being wound about the unsealing member 20.

(Function of Connecting Portions Defining Openings)

A summary of the connecting portions 35*b*, defining the openings, which perform a large function in the unsealing operation of the developer bag 16 will be described.

Figure 11:
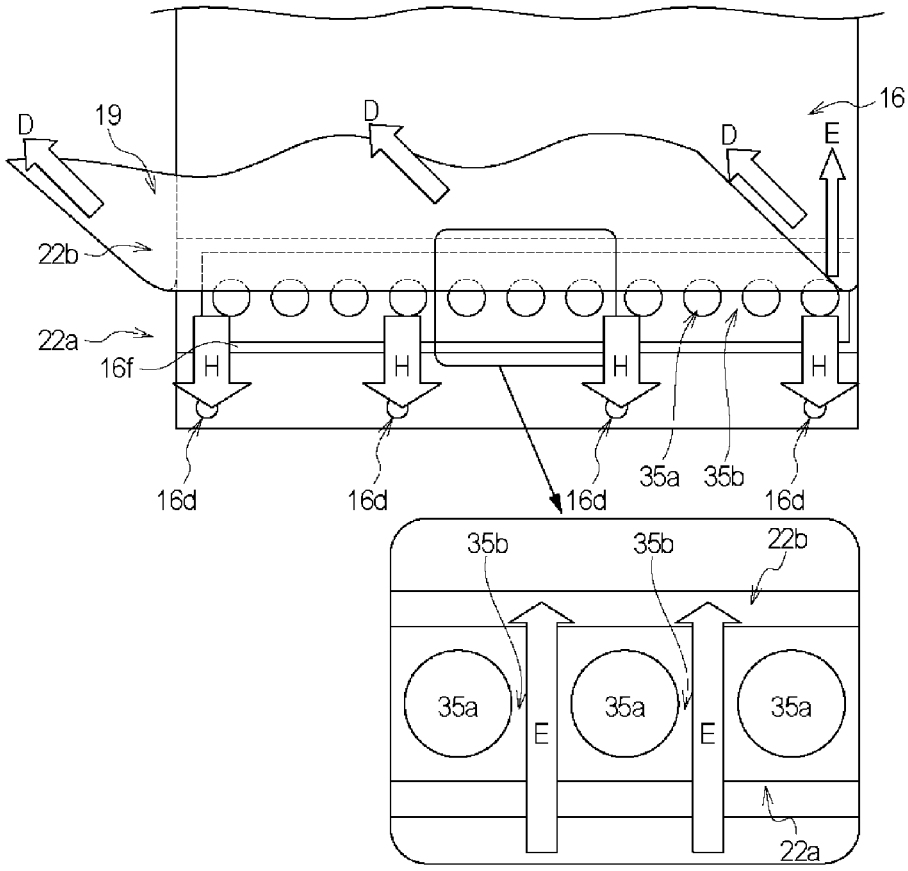
FIG. 11 is an illustration of the developer accommodating container during unsealing in the embodiment of the present invention.

FIG. 11 is a view of the discharging portion 35 when the peeling of the portion, at the first bonding portion 22*a*, to be first unsealed is ended to expose the openings 35*a*, and is a state in which the peeling at the second bonding portion 22*b* is not ended. As described above, the discharging portion 35 includes the plurality of openings 35*a* disposed at different positions with respect to the perpendicular direction F to the unsealing direction E in which the exposure of the openings 35*a* advances. For that reason, also the plurality of connecting portions 35*b* defining the plurality of openings 35*a* are disposed at a plurality of positions with respect to the F direction. By this, the plurality of connecting portions 35*b* bridge the first bonding portion 22*a* and the second bonding portion 22*b* with respect to the direction E in which the unsealing of the openings 35*a* advances. For that reason, at the time of the state of FIG. 8 in which the unsealing of the first bonding portion 22*a* is ended, the force when the second bonding portion 22*b* is unsealed can be received by the first fixing portion 16*d* via the connecting portions 35*b*, so that the force for peeling off the sealing member 19 from the developer bag 16 can be transferred. That is, the forces are applied to the second bonding portion 22*b* in the directions of the arrow D and the arrow E, so that also at the second bonding portion 22*b*, the sealing member 19 is peelable.

Figure 28:
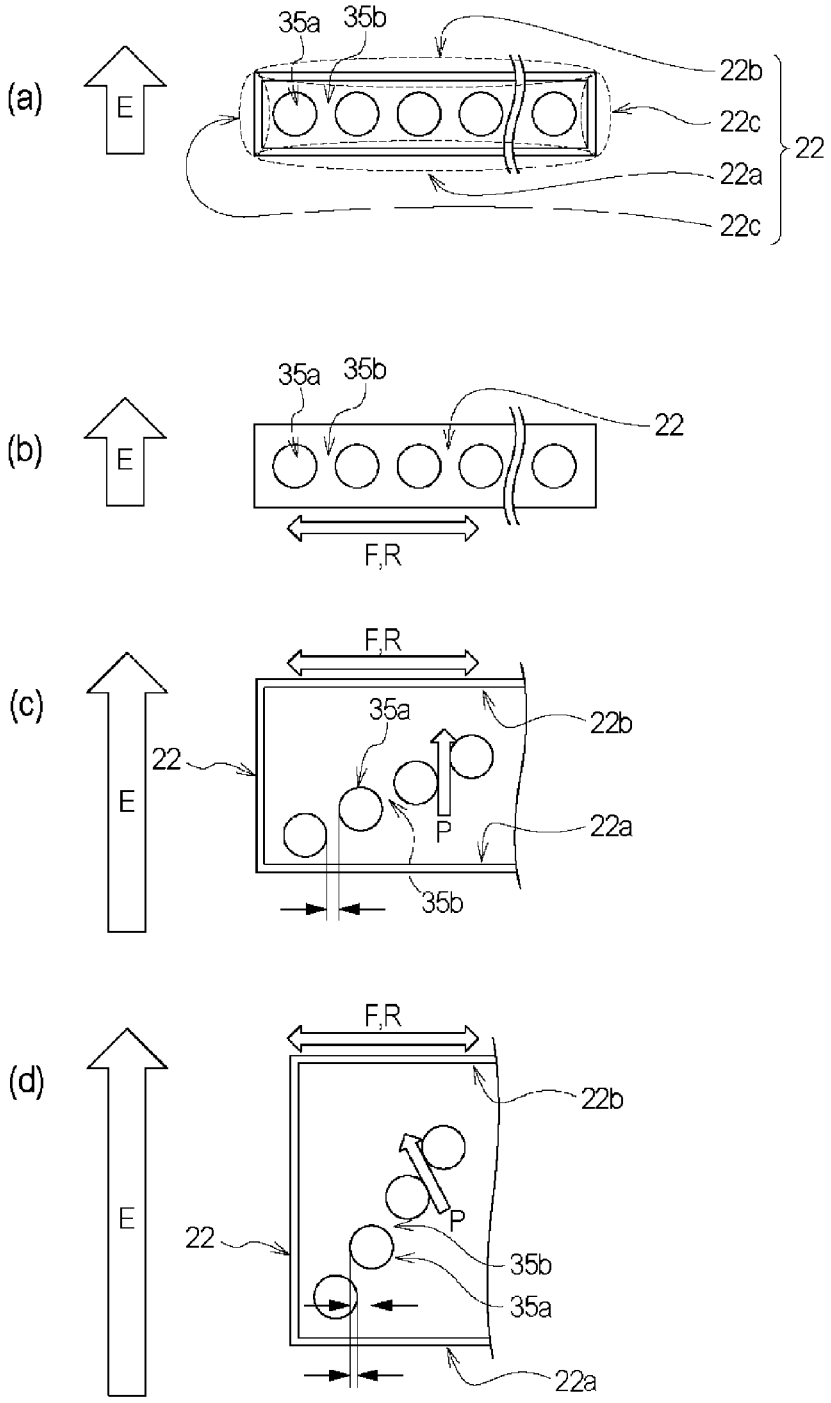
FIG. 28 includes illustrations of openings of the developer accommodating container in the embodiment of the present invention.

A similar effect can be obtained also in cases other than the case where the openings 35*a* are arranged in the direction F perpendicular to the unsealing direction E as shown in (b) of FIG. 28 as described above. Even when the openings 35*a* are not completely arranged in the direction perpendicular to the unsealing direction E as shown in (c) of FIG. 28, the connecting portions 35*b* can transmit the force, for peeling off the sealing member 19 from the developer bag 16, as shown by an arrow P. Further, even when the openings 35 overlap with each other with respect to the unsealing direction E as shown in (d) of FIG. 28, the connecting portions 35*b* can transmit the force, for obliquely peeling the sealing member 19 from the developer bag 16, as shown by an arrow P. That is, the plurality of openings 35*a* may only be required to be disposed at different positions with respect to the direction F perpendicular to the unsealing direction E.

Further, as shown in (b) of FIG. 28, a portion including the connecting portions 35*b* at a periphery of the openings 35*a* may also be used as the bonding portion 22. Also in this case, by the presence of the connecting portions 35*b*, the force can be transmitted to the end of the peeling at the bonding portion 22, so that the unsealing is effected with reliability.

Further, as for a relationship between the rotation shaft of the unsealing member 20 and the openings 35*a*, it can be said that the openings 35*a* are disposed at the different positions with respect to the direction R of the rotation shaft of the unsealing member 20. By doing so, the connecting portions 35*b* for bridging the first and second bonding portions 22*a* and 22*b* with respect to the perpendicular direction (arrow E) to the rotation shaft of the urging member 20. The openings 35*a* may only be required to be located at the different positions in the rotational axis direction R of the unsealing member. Even when the openings 35*a* overlap with each other with respect to the rotational axis direction R as shown in (b) of FIG. 28 and do not overlap with each other completely with respect to the rotational axis direction R as shown in (c) of FIG. 28, the force can be transmitted as shown by the arrow P and there is the effect of the connecting portions 35*b*.

Thus, by the presence of the connecting portions 35*b* for bridging the first and second bonding portions 22*a* and 22*b* at the discharging portion 35, the developer accommodating container 26 accommodating the developer and the developer accommodating container 30 including the unsealing member 20 can transmit the unsealing force of the unseal member 20 until the second bonding portion 22*b* is unsealed, so that the unsealing can be effected with reliability.

Further, a relationship between the openings 35*a* and the portion-to-be-engaged 19*b* of the sealing member will be described (FIG. 3). The portion-to-be-engaged 19*b* is provided in an end side of the sealing member 19 with respect to the direction substantially perpendicular to the direction in which the plurality of openings are arranged.

A relationship between the openings 35*a* and the unsealing member 20 will be described (FIG. 3). The unsealing member 20 is provided in an end side of the sealing member 19 with respect to the direction substantially perpendicular to the direction in which the plurality of openings are arranged.

Also in such a constitution, it is possible to obtain the effect of transmitting the unsealing force of the unsealing member 20 by the connecting portions 35*b* until the second bonding portion 22*b* is unsealed.

(Example in Which Connecting Portions are Separate Members)

Figure 21:
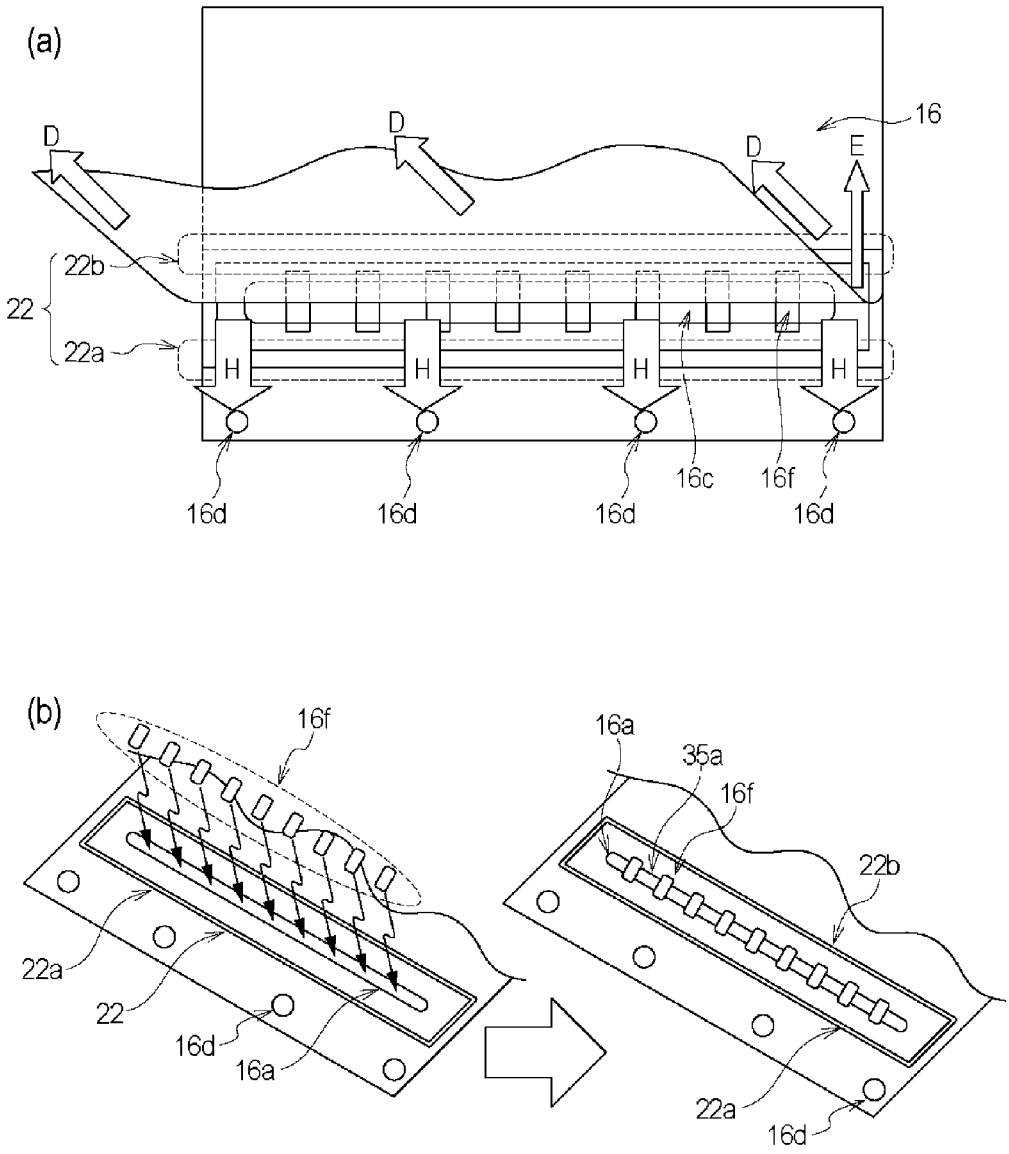
FIG. 21 includes illustrations of the developer accommodating container in the embodiment of the present invention.

Further, as shown in FIG. 21, the connecting portions 35*b* defining the openings 35*a* of the discharging portion 35 may also be separate members (connecting members 16*f*). In this case, a constitution in which a single long opening 16*a* in the direction F perpendicular to the unsealing direction E is provided and the connecting members 16*f* as the separate member connecting both sides of the opening 16*a* along the unsealing direction E are provided on the single long opening 16*a* is employed. At this time, the connecting members 16*f* are bonded in each of the first bonding portion 22*a* side and the second bonding portion 22*b* side of the long single opening 16*a* by adhesive bonding, welding or the like.

Incidentally, also in the case where the developer bag 16 is provided with the connecting members 16*f*, the sealing member 19 is folded back between the bonding portion 22 and the portion-to-be-engaged 19*b* as described above and is wound around the unsealing member 20, so that the developer bag 16 is unsealable. By employing such a constitution, the connecting portions 35*b* defining the openings in the case where the plurality of openings 35*a* are provided, and the connecting members 16*f* perform the same function. That is, the long single opening 16*a* is the same as the case where there are the plurality of openings 35*a* by providing the connecting members 16*f*.

Therefore, when the sealing member 19 is peeled at the second bonding portion 22*b* after the unsealing at the first bonding portion 22*a* is ended, the force (arrow D) during the unsealing at the second bonding portion 22*b* by the unsealing member 20 can be received by the first fixing portion 16*d* via the connecting members 16*f* with respect to the arrow H direction. Therefore, the force for peeling the sealing member 19 from the developer bag 16 can be transmitted. That is, the forces are applied to the second bonding portion 22*b* in the arrow D direction and the arrow H direction, so that the unsealing is enabled also the second bonding portion 22*b*.

In this way, the long single opening 16*a* forms the plurality of openings 35*a* by the connecting members 16*f*, so that it also becomes possible to strengthen only the connecting members 16*f*.

(Problem of Unsealing Property in Case of No Connecting Portion)

Figure 13:
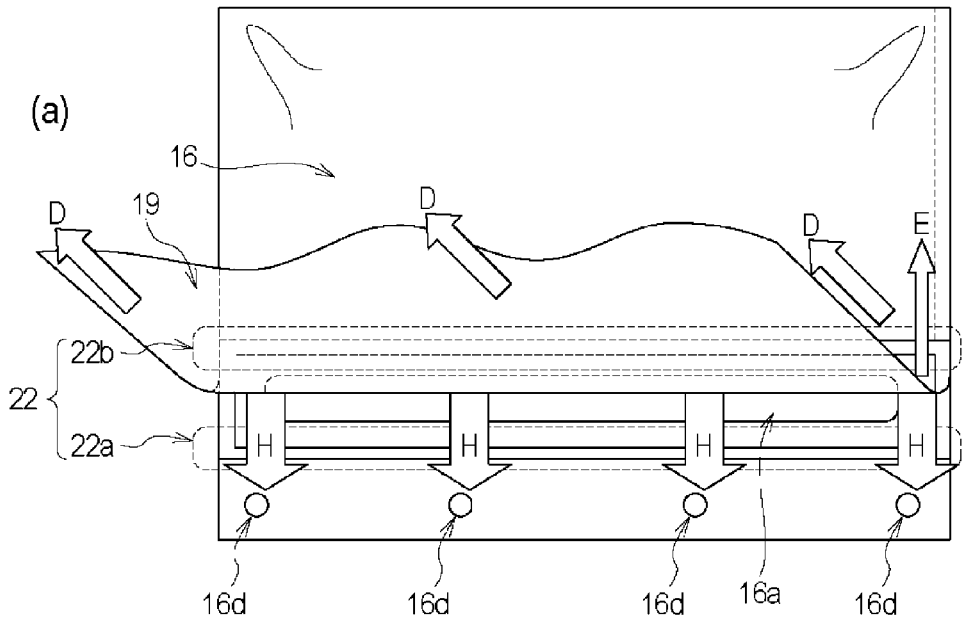
FIG. 13 illustrates a hard-to-unseal developer accommodating container which is not the embodiment of the present invention.
Figure 13:
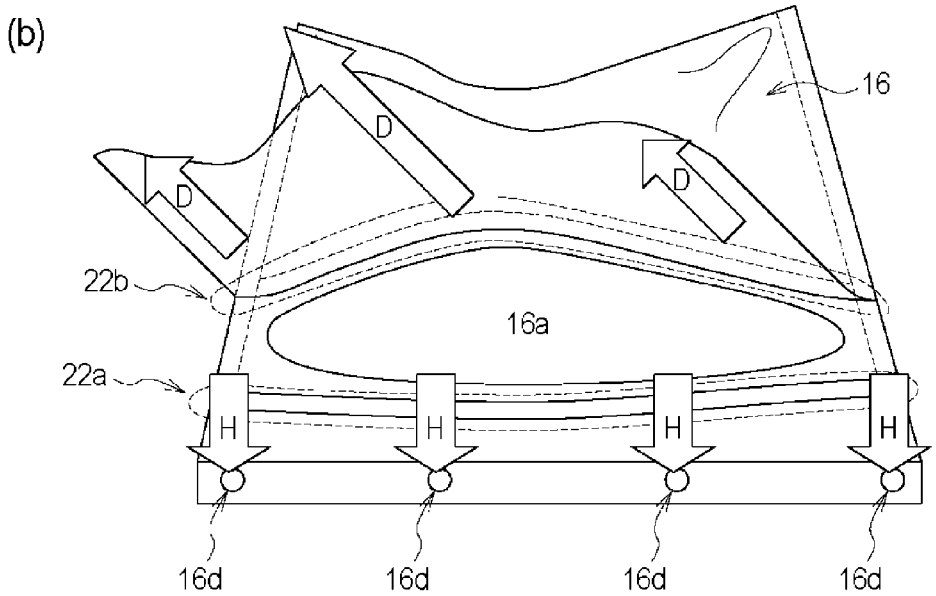
Figure 14:
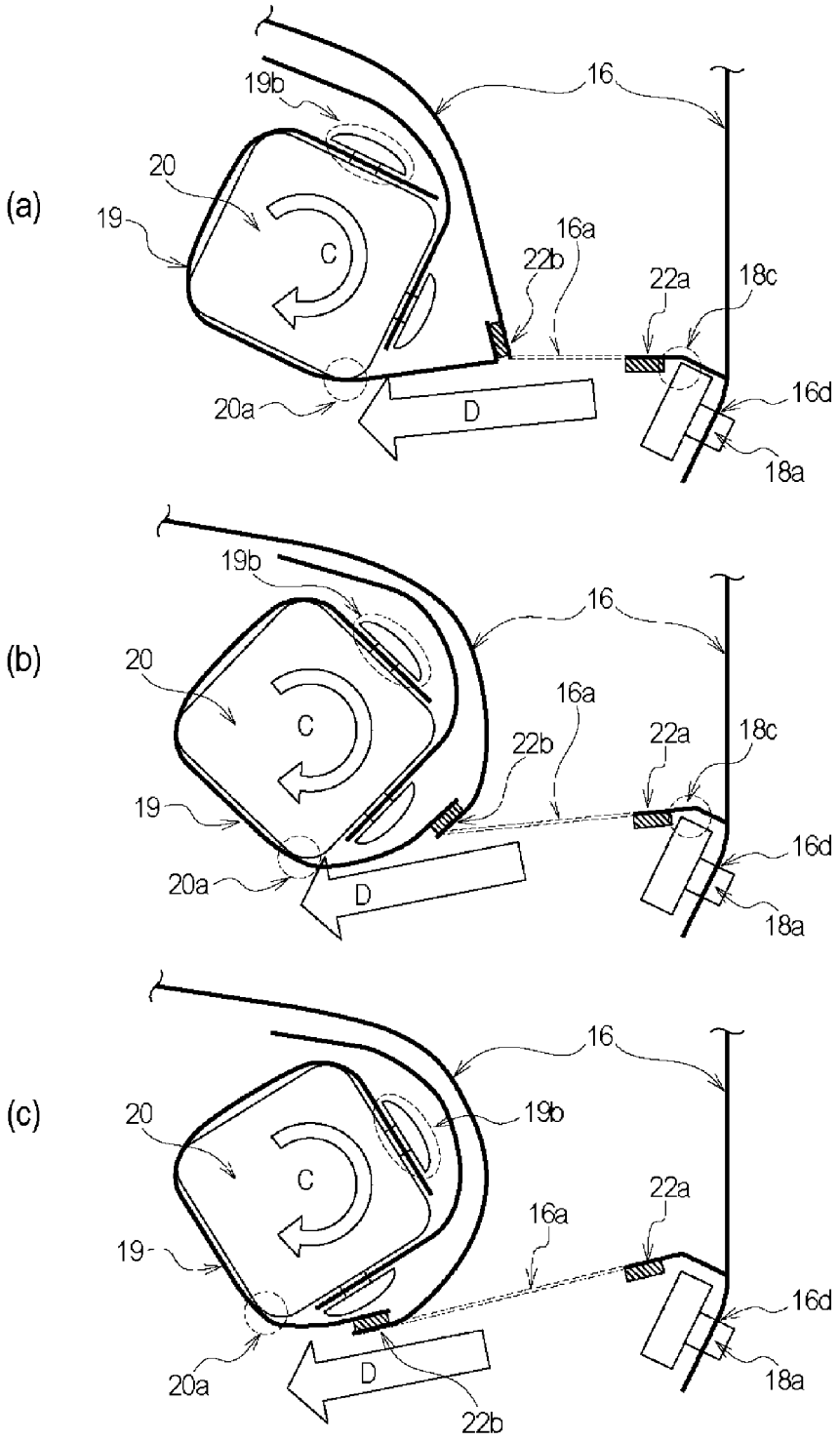
FIG. 14 includes sectional views of the hard-to-unseal developer accommodating container which is not the embodiment of the present invention.
Figure 15:
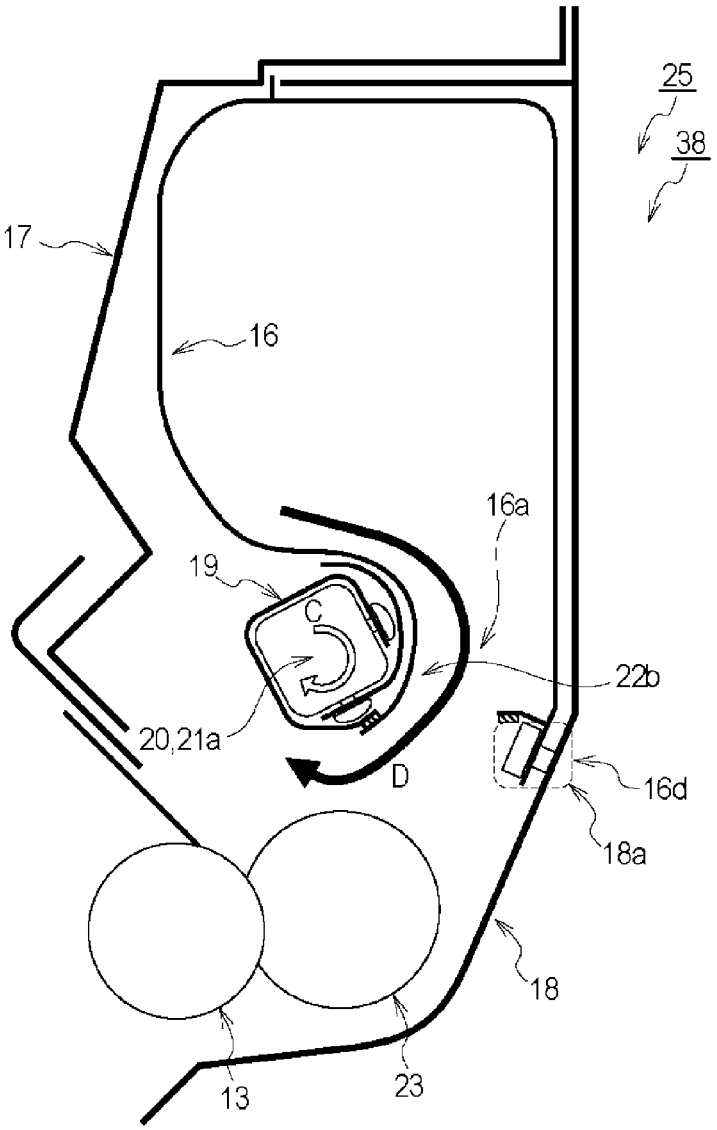
FIG. 15 is a sectional view of a hard-to-unseal developer accommodating unit which is not the embodiment of the present invention.

Here, an example in which the present invention is not applied and it is difficult to unseal the developer bag 16 will be described. This is, as shown in FIGS. 13 and 14, the case where there are no connecting portions 35*b* and it becomes difficult to effect the unsealing. FIG. 13 is an example in which there are no connecting portions 35*b* and there is a single opening 16*a*, in which (a) of FIG. 13 is a view showing a state before the peeling at the second bonding portion 22*b*, and (b) of FIG. 13 and FIG. 15 are views showing a state when the sealing member 19 is peeled at the second bonding portion. Further, FIG. 8 includes enlarged sectional views at a periphery of the opening 35*a* in states before and after the sealing member 19 is peeled at the second bonding portion 22*b* in this embodiment, and FIG. 14 includes sectional views at the periphery of the opening 35*a* in the case where there are no connecting portions 35*b* and thus it becomes difficult to effect the unsealing.

In this case, a state in which the unsealing advances to the second bonding portion 22*b* is (a) of FIG. 14, and from this state, the sealing member 19 is pulled and moved in the arrow D direction by further rotation of the unsealing member 20. Then, since there are no connecting portions 35*b*, the force from the first fixing portion 16*d* cannot be transmitted to the second bonding portion 22*b* side at the central portion of the opening 16*a*. For that reason, as shown in (b) of FIG. 14 and (b) of FIG. 13, a binding force from the fixing portion 18*a* of the frame to the second bonding portion 22*b* is eliminated, so that the opening 16*a* gradually opens largely in the arrow D direction. Further, the second bonding portion 22*b* is pulled by the sealing member 19, so that the opening 16*a* is deformed as shown in (c) of FIG. 14. In this case, a force acting on the second bonding portion 22*b* fails to provide the inclination peeling positional relationship as shown in FIG. 8 and causes the shearing peeling (approximately 0-degree peeling) by the deformation of the opening 35*a* as shown in (c) of FIG. 14, so that a large force is required for the peeling. Moreover, the supporting force of the first fixing force 16*d* cannot be transmitted to the second bonding portion 22*b* and therefore the second bonding portion 22*b* is pulled by the unsealing member 20 without causing the peeling of the sealing member 19 therefrom. For that reason, the opening 16*a* in the neighborhood of a longitudinal central portion of the second bonding portion 22*b* further opens largely, so that the second bonding portion 22*b* is wound about the unsealing member 20.

Incidentally, if a member for accommodating the developer is a rigid member such as a structure, there is no such a deformation, so that the sealing can be made as in the conventional example. However, in the case of a constitution in which the developer is accommodated in a deformable soft bag-like member and an opening which is deformed during unsealing is unsealed, as described above, when there are no connecting portions 35*b*, it becomes difficult to effect the unsealing.

As described above, the sealing member 19 (=toner seal) is made unsealable by transmitting the driving force to the unsealing member 20 of the image forming apparatus B, and there is no need for the user to peel off the toner seal, so that the developing device 38 and the process cartridge A can be more simply replaced and used. Further, the sealing member 19 after the unsealing is fixed to the unsealing member 20, so that the unsealing can be effected without removing a waste material from the process cartridge A.

<With Respect to Summary of Urging Member and Developer Discharge)

(Urging Member)

Figure 16:
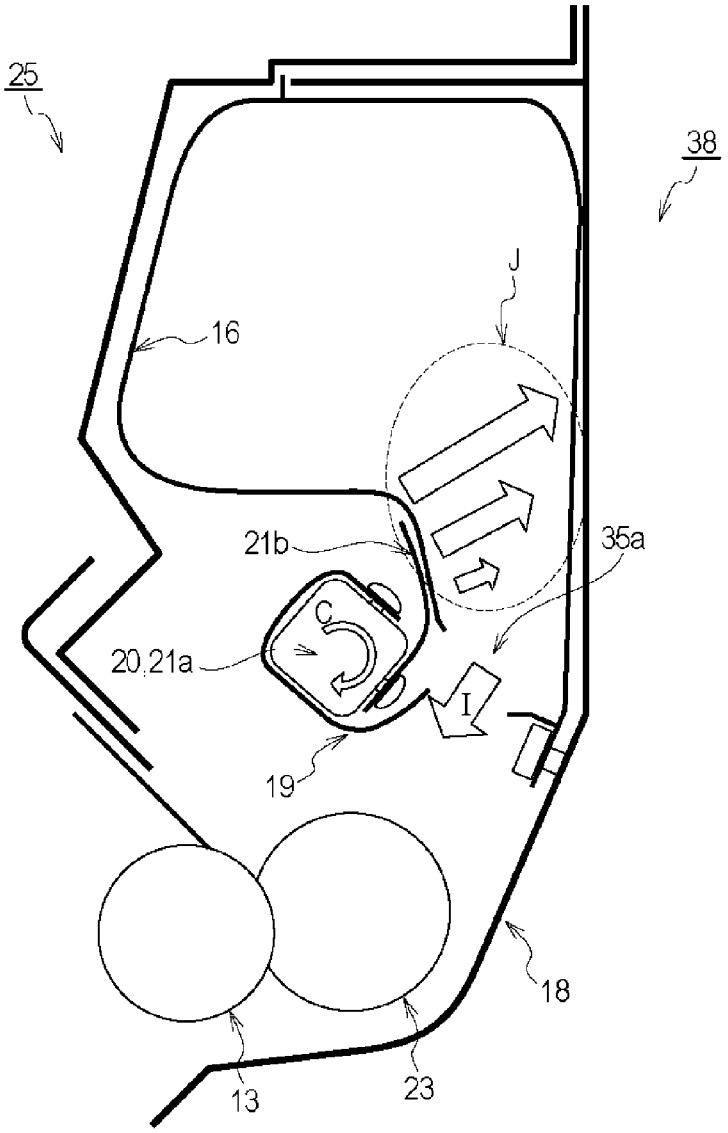
FIG. 16 is a sectional view of the developer accommodating unit in the embodiment of the present invention.

As shown in FIG. 16, the urging member 21 is provided with a shaft portion 21*a* and an urging sheet 21*b* fixed to the shaft portion 21*a* and is provided rotatably inside the first frame 17 and the second frame 18.

First, the shaft portion 21*a* performs a function by the same part as the unsealing member 20 (21*a*=20). Therefore, as described above, the driving force is transmitted to the shaft portion 21*a* by the unshown driving means of the main assembly of the image forming apparatus B, so that the urging member 21 (=20) is rotated in the arrow C direction.

Next, the urging sheet 21*b* is fixed on a surface of a rectangular shaft portion 21*a* in cross section and is rotated together with the shaft portion 21*a*. Incidentally, the urging sheet 21*b* is a flexible sheet formed of a material such as PET, PPS (polyphenylene sulfide) or polycarbonate, in a thickness of about 0.05-0.1 mm, and an end thereof projects to the outside of a circumscribed circle of the shaft portion 21*a*. Here, in this embodiment, on different surfaces of the shaft portion 21*a*, the sealing member 19 and the urging sheet 21*a* are fixed but may also be fixed on the same surface of the shaft portion 21*a*.

Figure 17:
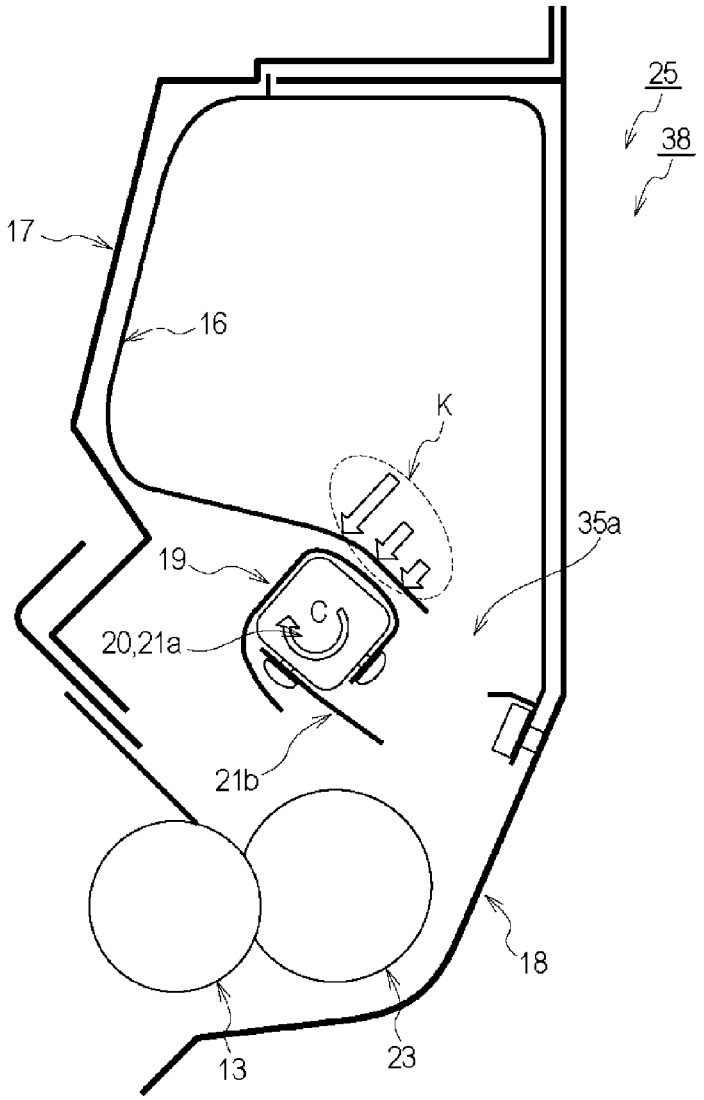
FIG. 17 is a sectional view of the developer accommodating unit in the embodiment of the present invention.

Further, as shown in FIG. 16 and FIG. 17, the urging sheet 21*b* also performs the function of stirring the developer and feeding the developer toward the developing roller 13 and the developer supplying roller 23.

<Summary of Developer Discharge from Developer Bag>

(Summary of Discharge from Before Unsealing to During Unseal)

First, with respect to the discharge of the developer from before the unsealing to the time of start of the unsealing, as shown in FIG. 7 and FIG. 8 described above, the sealing member 19 is pulled toward the power application point portion 20*a* (arrow D), and the developer bag 16 is supported by the fixing portion 18*c*. For that reason, during unsealing, three places consisting of the power application point portion 20*a*, the fixing portion 18*c* of the frame and the place of the bonding portion 22 where the sealing member 19 is peeled are moved in a direction in which these three places are aligned in a rectilinear line in a cross section perpendicular to the rotation shaft of the unsealing member 20. Thus, the position of the openings 35*a* is changed between the time before the unsealing member 20 applies the force to the sealing member 19 to perform the unsealing operation and the time when the unsealing operation is started to unseal the bonding at the first bonding portion 22*a*, so that stagnation of the developer in the neighborhood of the openings 35*a* can be prevented and a discharging property is good.

(Summary of Discharge After Unsealing: During Urging)

Further, after the unsealing, when the sealing member 19 is unsealed from the above-described developer bag 16 as shown in (b) of FIG. 8, the openings 35*a* are disposed to open toward below the developer bag 16 and therefore the developer in the neighborhood of the openings 35*a* is discharged by the action of gravitation and vibration or the like of the developer bag 16 during the unsealing.

Figure 9:
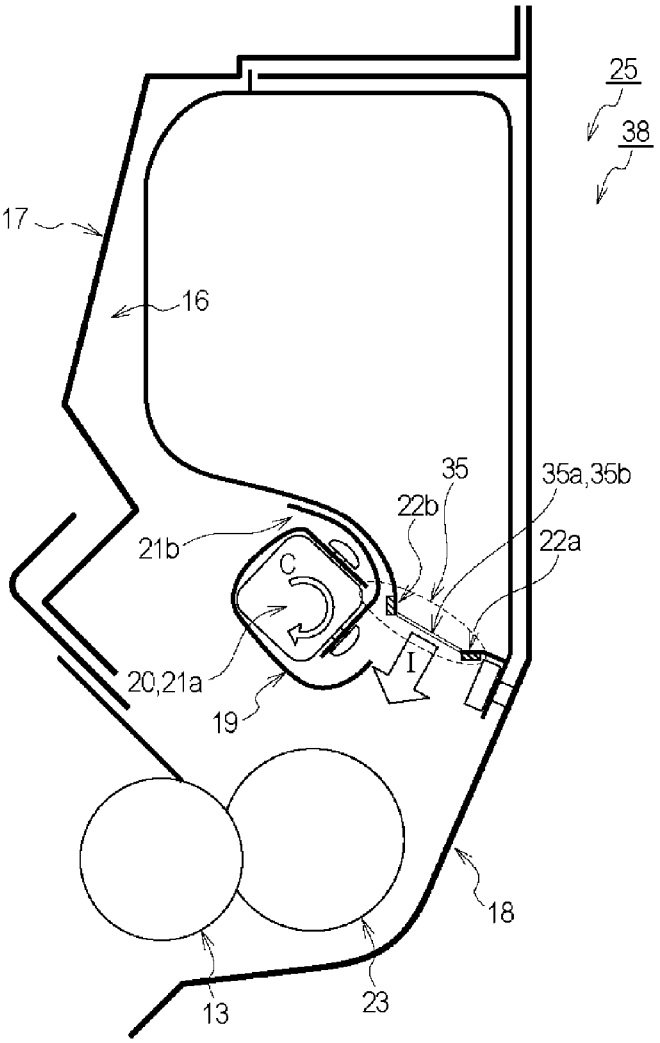
FIG. 9 is a sectional view of the developer accommodating unit after the unsealing in the embodiment of the present invention.

After the unsealing, when the unsealing member 20 is further rotated, also the urging sheet 21*b* fixed to the unsealing member 20, for urging the developer bag 16 is rotated, so that the urging sheet 21*b* is wound about the unsealing member 20 by the developer bag 16 as shown in FIG. 9. Here, as shown in FIG. 16, the urging sheet 21*b* has elasticity and therefore is likely to be restored to an original shape, thus urging the developer bag 16 in an arrow J direction. At this time, the developer bag 16 is urged by the urging sheet 21*b* and is pressed against the second frame 18 via the toner, so that the entire developer bag 16 is deformed. Further, the developer bag 16 is urged by the urging sheet 21*b* to be decreased in its inside volume. Thus, by the decrease in volume of and the change in entire shape of the developer bag 16, the developer inside the developer bag 16 is stirred, and thereby, the developer is readily discharged from the openings 35*a*. Further, at this time, the developer bag 16 is closed except for the openings 35*a* and there is no escape route except for the openings 35*a*, and therefore the discharging property from the openings 35*a* is high. By the discharging action as described above, the developer is readily discharged in the arrow I direction.

Incidentally, at this time, if the developer bag 16 is contacted to and pressed against the second frame 18 at least at a part thereof, the developer bag 16 is deformable.

Further, by aligning the rotational axis direction of the developing roller 13 and the arrangement direction F of the plurality of openings 35*a*, the developer can be easily supplied over the entire longitudinal direction of the developing roller 13 during the discharge without being localized.

Further, when the developing device 38 is mounted in the image forming apparatus B, by providing the openings 35*a* so as to open toward the direction of gravitation, the developer discharging property can be improved.

Further, the urging member 21 provided inside the frames (17, 18) urges the developer bag 16 so as to be pressed against the second frame 18, by which the developer discharging property can be improved.

Further, also the urging member 21 uses a flexible sheet which includes a base material such as polyethylene terephthalate (PET), polyethylene or polypropylene and which is 0.03-0.15 mm in thickness, and therefore takes part in the discharging action by a mechanism similar to that of the above-described urging sheet 21*b*.

(Summary of Discharge: Developer Bag Shape Restoration)

Then, as shown in FIG. 17, the unsealing member 20 is further rotated, so that the urging sheet 21*b* is separated from the developer bag 16. At this time, the developer bag 16 has flexibility and therefore is likely to be restored to the state before the urging by the weight of the developer (arrow K). Then, also the urging sheet 21*b* is rotated and urges the developer bag 16 toward the second frame 18 as shown in FIG. 16, so that the developer bag 16 is deformed to move the developer at a position other than the neighborhood of the openings 35*a*, and the developer is discharged from the openings 35*a*.

(Summary of Discharge: Repetition of Unsealing/Restoration)

In the case where the developer immediately after the unsealing is present in the developer bag 16 in a large amount, an entering amount of the urging sheet 21*b* to the unsealing member 20 is repetitively changed, so that the developer bag 16 is deformed so as to be pressed against the second frame 18. Contraction of the developer bag 16 by the urging with the urging member 21 and restoration of the developer bag 16 by the weight of the developer inside the developer bag 16 and by the flexibility of the developer bag 16 are repeated. Further, by the above-described action, the developer bag 16 itself is moved and therefore the developer bag 16 is vibrated, so that the developer inside the developer bag 16 is discharged from the openings 35*a* also by this vibration. Further, the urging member 21 is rotated and therefore is capable of repetitively urging the developer bag 16.

(Example in Which Developer Bag is Applied to Frame)

Figure 25:
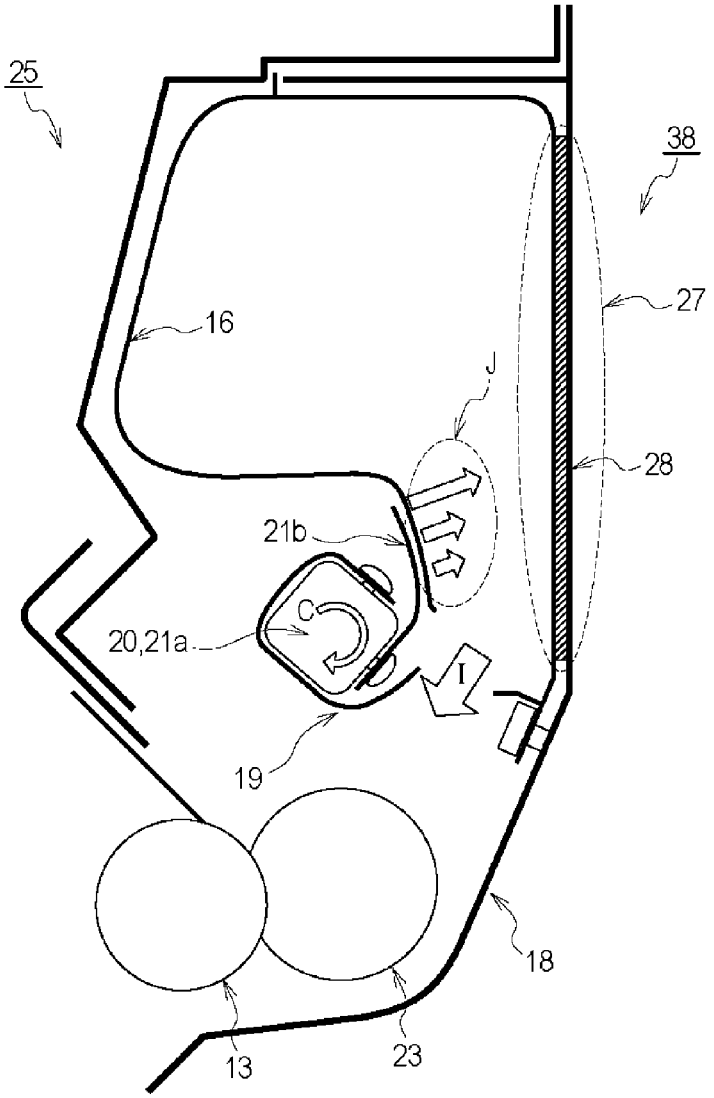
FIG. 25 includes illustrations of the developer accommodating unit in the embodiment of the present invention.

Incidentally, a portion 27 where the developer bag 16 is urged against the second frame 18 is as shown in FIG. 25, even in the case where a bonding portion 28 such as an adhesive or a double-side tape is provided and bonds the developer bag 16 to the second frame 18, the urging sheet 21*b* can urge the developer bag 16 to discharge the developer.

(Case Where Amount of Developer Becomes Small)

Figure 32A:
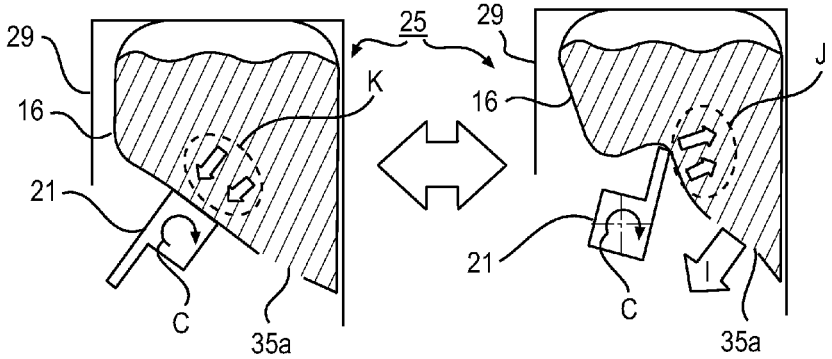
FIG. 32 includes illustrations of the developer accommodating unit in the embodiment of the present invention.
Figure 32B:
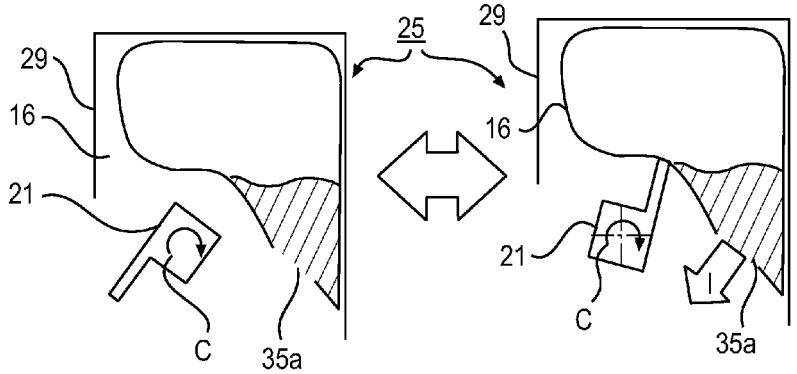
Figure 32C:
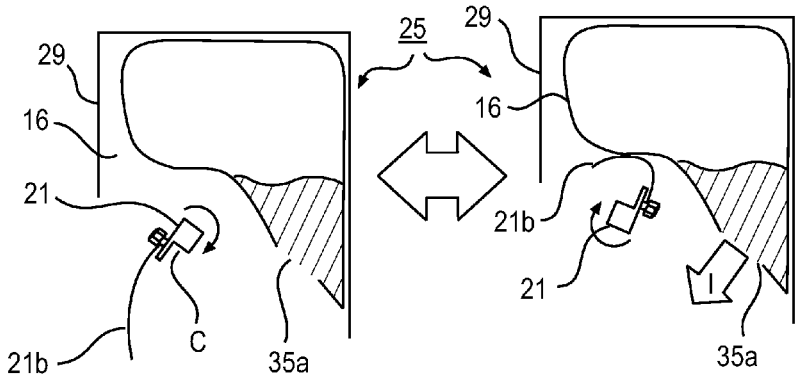

The case where the amount of the developer inside the developer bag 16 becomes small by effecting image formation will be described by using FIG. 32. Incidentally, for simplification, the urging member 21 will be principally described, but also with respect to the sealing member 19, a similar phenomenon occurs. Immediately after the unsealing, as shown in (a) of FIG. 32, the shape of the developer bag 16 follows the shape of the urging member 21 so that the developer bag 16 always contacts the urging member 21 by the weight of the accommodated developer, and a size (inside volume) is periodically changed. However, when the accommodated developer becomes small, as shown in (b) of FIG. 32, the weight of the developer becomes light, so that the developer bag 16 does not follow the urging member 21 and repeats periodical separation from and contact with the urging member 21. The developer bag 16 and the urging member 21 periodically contact each other, and therefore the developer can be discharged by the vibration of the developer bag 16.

Depending on a position relationship between the developer bag 16 and the urging member 21, there is the case where the developer bag 16 and the urging member 21 always do not contact each other at the time when the developer becomes small. That is, the discharge of the developer by the periodical contact is not effected, and therefore there is a possibility that the developer which is not discharged remains in the developer bag 16. At this time, as shown in (c) of FIG. 32, a constitution in which the urging sheet 21*b* is fixed to the urging member 21 and has a length enough to always bring the urging sheet 21*b* in contact with the developer bag 16 may preferably be employed. By doing so, the urging sheet 21*b* is contacted to the developer bag 16 in a flexed (bent) state, and therefore even in the case where the developer becomes small and the developer bag 16 is deformed, a state in which the developer bag 16 and the urging member 21 do not contact each other is not created, so that the discharging effect can be maintained. That is, when the flexible sheet is used as the urging member 21, depending on the state of the developer bag, it is possible to change a distance from the center of the rotation shaft of the urging member to an application (action) point where the developer bag 16 is urged. Specifically, when the toner is sufficiently contained in the developer bag 16, the urging sheet 21*b* urges the developer bag 16 in the flexed state, but as the toner in the developer bag 16 becomes small, the urging sheet 21*b* is contacted to the developer bag 16 in a state in which the flexure thereof is more eliminated.

Further, with respect to the rotational axis direction of the urging member 21, even in the case where localization is caused in the developer in the developer bag 16 and contact non-uniformity between the developer bag 16 and the urging sheet 21*b* is generated, if the above-described constitution in which the urging sheet 21*b* is fixed to the urging member 21 is employed, it is possible to maintain the discharging effect similarly as described above.

(Combined Use as Urging Sheet and Sealing Member)

Incidentally, a single part may also be used as the urging sheet 21*b* and the sealing member 19 to have functions of these members. That is, after the unsealing, the bonding portion 22 is separated from the developer bag 16 and therefore an end of the sealing member 19 in the bonding portion 22 side is a free end. For this reason, the sealing member 19 can have the function of the urging sheet 21*b*. Thus, the unsealing member 20 can have the function of the shaft portion 21*a* of the urging member 21, and the sealing member 19 can have the function of the urging sheet 21*b*.

By doing so, it is possible to reduce the number of parts and thus cost reduction can be realized.

As described above, the developer inside the developer bag 16 can be satisfactorily discharged without providing another discharging part such as a developer discharging roller at the openings 35*a* as a developer discharging port, so that agglomeration and bridge of the developer in the neighborhood of the openings 35*a* can be prevented. By this, even in the case where the developer in the developer bag 16 is agglomerated by tapping during transportation, storage or the like, the agglomerated developer is broken by such movement of the entire developer bag 16 and the periphery of the openings 35*a*, so that it is possible to prevent a state in which it becomes difficult to discharge the developer.

(Example in Which Urging Member is Single Part)

Figure 26:
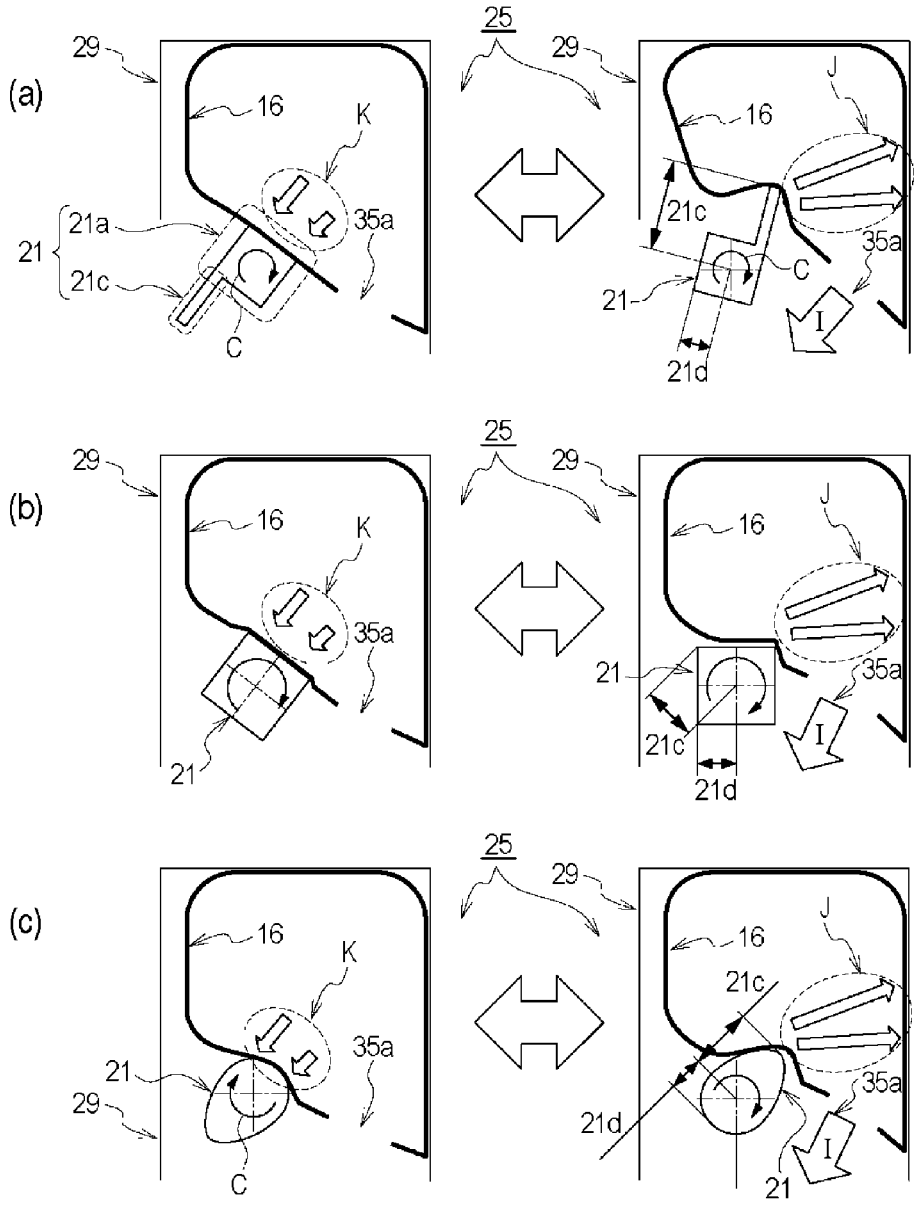
FIG. 26 includes illustrations of the developer accommodating unit in the embodiment of the present invention.

Further, the urging member 21 is not separate parts consisting of the shaft portion 21*a* and the urging sheet 21*b*, but even when the urging member 21 is a single part as shown in (a) of FIG. 26 and is provided with a projection (projected portion) 21*c* functioning as the urging sheet 21*b*, the developer can be similarly discharged. In the case where the urging member 21 is constituted by only the shaft portion 21*a*, when the urging member 21 is viewed in its cross section perpendicular to its rotation center, the developer bag 16 can be pressed against a frame 29 to be deformed even in the case where the cross section of the shaft portion 21*a* has a polygonal shape ((b) of FIG. 26) or has a cam shape ((c) of FIG. 26). This is because when the urging member 21 is disposed so as to contact at least the developer bag 16, a distance from the rotation center to the outer end of the urging member 21 is changed and therefore the entering amount of the urging member 21 to the developer bag 16 is also changed. That is, so long as the shaft portion is not a shaft having a circular cross section including the rotational axis as its center, the developer bag 16 can be deformed by the rotation of the urging member 21. As shown in FIG. 26, a distance 21*c* from the center of the urging member 21 to a remote outer end of the urging member 21 and a close distance 21*d* to an outer end are different from each other and therefore the entering amount of the urging member 21 to the developer bag 16 is also changed.

Figure 33:
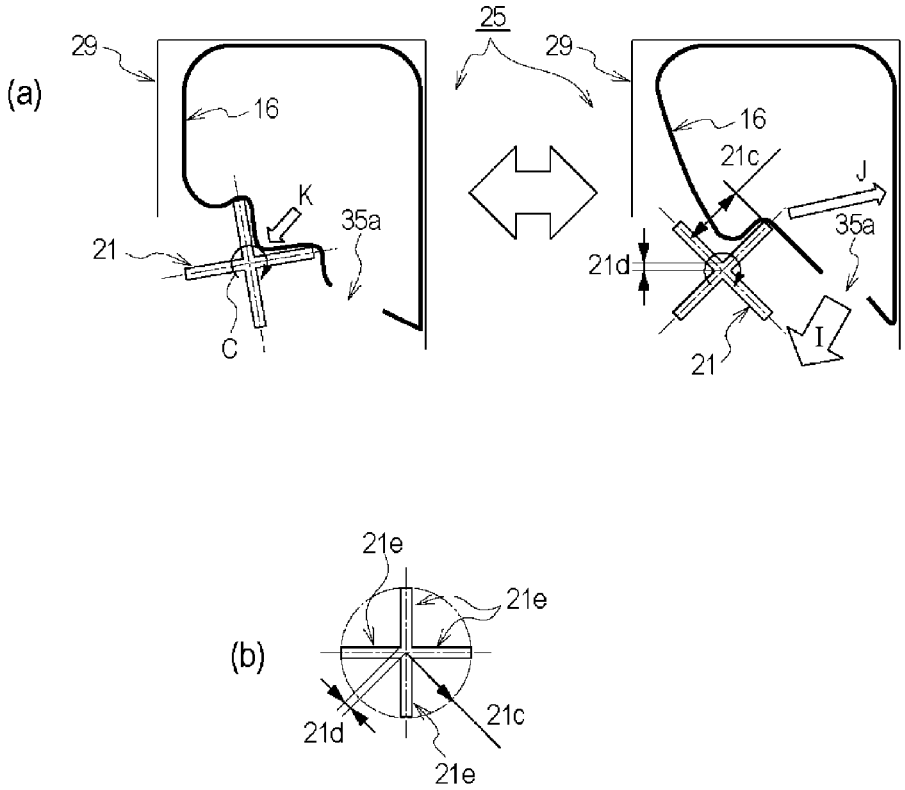
FIG. 33 includes illustrations of the developer accommodating unit in the embodiment of the present invention.

Further, (b) of FIG. 33 is a sectional view of an urging member 21 having a cross-shape in cross section, and (a) of FIG. 33 is a cross-sectional illustration of the developer accommodating unit 25 including the cross-shaped urging member 21. As shown in FIG. 33, in the case where four projections (projected portions) 21*e* having the same distance from the center of the urging member 21 to the outer end are provided, outer configurations (21*c*) of the four projections 21*e* are equal to each other. However, the urging member 21 includes a portion, other than the projections 21*e*, having an outer end (distance 21*d*) close to the center and therefore the entering amount to the developer bag 16 can be changed. That is, the urging member 21 can be made a rotatable member including portions different in distance from the rotation center of the urging member 21 to the outer end of the urging member in the cross section perpendicular to the rotation center of the urging member 21.

Thus, the developer bag 16 is urged by the urging member 21 (arrow J) to be pressed against the frame 29, thus being deformed to decrease its inside volume, so that the inside developer is pushed out to be discharged from the openings 35*a* (arrow I).

Further, in an attitude during the image formation, the shaft portion 21*a* (=20) of the urging member 21 is positioned under the developer bag 16 with respect to the direction of gravitation, and contacts the developer bag 16. Further, the cross-sectional shape of the shaft portion 21*a* (=20) of the urging member 21 is rectangular and is not circular, and therefore by the rotation of the shaft portion 21*a* (=20), the entering amount of the shaft portion 21*a* (=20) to the developer bag 16 is periodically changed as described above. Also by the change in entering amount of the shaft portion 21*a* (=20) to the developer bag 16, the developer bag 16 can be changed in volume and can be vibrated, so that the developer discharging property can be improved.

Further, if the constitution in which the urging sheet 21*b* is fixed to the urging member 21 is employed, the urging sheet 21*b* is contacted to the developer bag 16 is the flexed state, and therefore even in the case where the developer bag 16 is deformed, a state in which the developer bag 16 and the urging member 21 do not contact each other is not created. For that reason, it is possible to maintain the discharging effect. Further, even when the constitution in which the urging sheet 21*b* having the flexibility is provided is not employed, the discharging effect can be maintained similarly as described above also by making the projection 21*c* to have a thin sheet-like shape so as to have flexibility and a length enough to contact the developer bag 16.

<Summary of Urging Member and Developer Circulation in Developer Bag>

As described above, as the functional effect of the above-described urging member 21, the toner discharge has been described, but next a developer circulating function, in the developer bag, which is another functional effect of the above-described urging member 21 will be described by using FIG. 17.

As shown in FIG. 17, the rotation of the unsealing member 20 advances, so that the urging sheet 21*b* separates from the developer bag 16. At this time, the developer bag 16 has the flexibility and therefore will be restored, by the weight of the accommodated developer, to the state before being urged (arrow K). Further, also the urging sheet 21*b* is rotated to urge, as shown in FIG. 16, the developer bag 16 toward the second frame 18 thereby to deform the developer bag 16, so that also the developer at a position other than the neighborhood of the openings 35*a* is moved, and by this motion of the developer, the developer circulating function (action) in the developer bag 16 is generated. That is, the deformation function of the developer bag 16 moves the developer in the developer bag 16, thus generating the developer circulating function in the developer bag 16. Further, a deformation amplitude of the developer bag and the developer circulating function are in a proportional relationship.

Embodiment 2

Vacuum Molding

As Embodiment 2, in place of the developer bag 16 in Embodiment 1, a developer accommodating member 34 is used.

The developer accommodating member 34 is formed by shaping a sheet-like material by vacuum molding, air-pressure molding or press molding, and is used. The developer accommodating container 30 including the unsealing member includes, similarly as in Embodiment 1, the developer accommodating member 34, the sealing member 19, the unsealing member 20, the first frame 17 and the second frame 18. Incidentally, the unsealing member 20 is a member having the function of the urging member 21 and the developer stirring function similarly as in Embodiment 1.

(Structure of Developer Bag)

As shown in FIG. 18 and (c) of FIG. 29, the developer accommodating member 34 is constituted by a molded portion 34*a* which is a flexible container formed by the vacuum molding, the air-pressure molding or the press molding, and (constituted by) a sheet-like air permeable portion 34*b*. Here, bonding between the molded portion 34*a* and the air permeable portion 34*b* is made by (heat) welding, laser welding, an adhesive, an adhesive tape or the like. The reason why an air permeability is imparted to the developer accommodating member 34 is the same as that in Embodiment 1 and is that the developer accommodating member 34 meets states during manufacturing, during transportation and during storage.

As the material for the molded portion 34*a*, ABS, PMMA, PC, PP, PE, HIPS, PET, PVC and the like and composite multi-layer materials of these materials are preferred. Further, the thickness of the molded portion 34*a* may preferably be about 0.1-1 mm in the sheet shape before the molding. The material and thickness of the molded portion 34*a* may only be required to be appropriately selected depending on cost, product specification, manufacturing condition, and the like.

Figure 19:
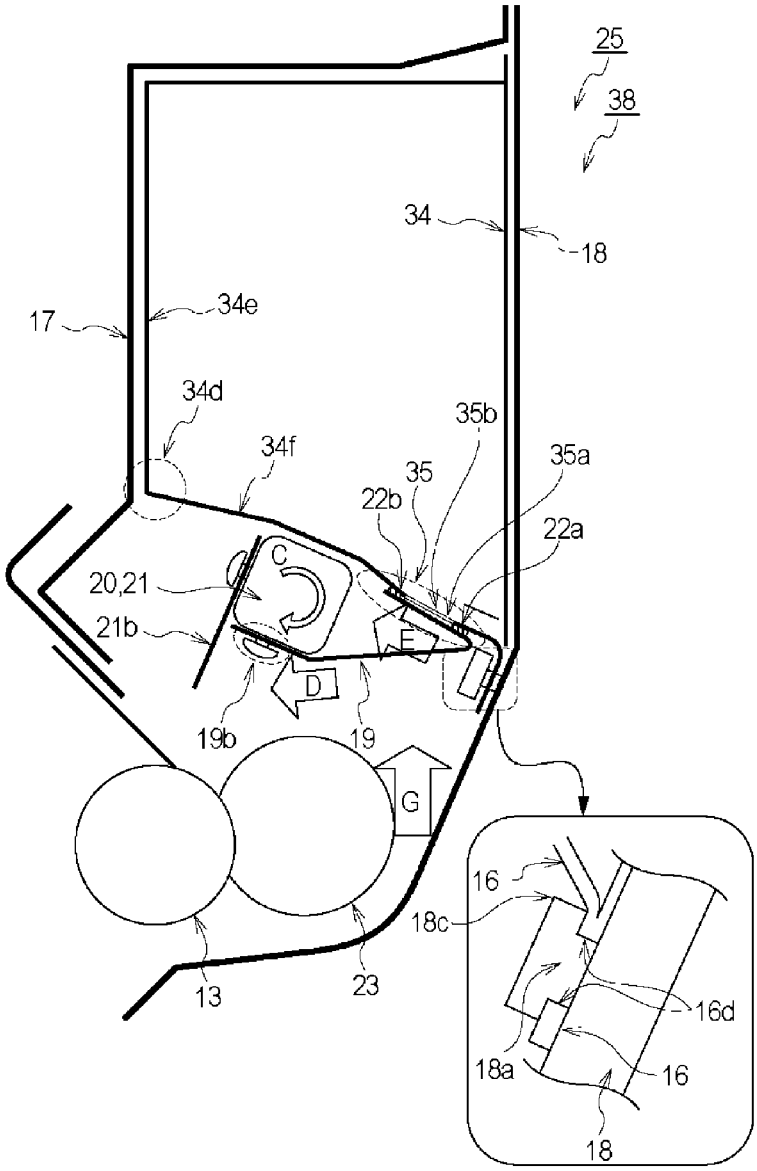
FIG. 19 is a sectional view of a developer accommodating unit in the Second Embodiment of the present invention.

The molded portion 34*a* is bonded to the air permeable portion 34*b* at an outer peripheral portion 34*c* of the molded portion 34*a*. The developer accommodating member 34 accommodates the developer therein. Further, at a part of the outer peripheral portion 34*c*, fixing portions 16*d* (portions-to-be-fixed) of the developer accommodating member 34 are provided. The shape of the molded portion 34*a* follows the inside (shape) of the frames 17 and 18 (FIG. 19).

Further, the developer accommodating container 26 in which the developer is accommodated is constituted by the developer accommodating member 34 and the sealing member 19 for unsealably covering the discharging portion 35 of the developer accommodating member 34 to seal the toner inside the developer accommodating member 34.

The developer accommodating container 30 including the unsealing member is constituted by the unsealing member 20 for unsealing the sealing member 19 from the developer accommodating member 34 and the developer accommodating container 26 in which the developer is accommodated.

The developing device 38 is constituted by the developer accommodating container 30 including the unsealing member, the developing roller 13 as the developing means, the developing blade 15, and the first frame 17 and the second frame 18 which support these members.

Here, the discharging portion 35 is provided at the molded portion 34*a*, and also a constitution of this discharging portion 35 is the same as that in Embodiment 1, and a plurality of openings 35*a* and connecting portions 35*b* for defining the plurality of openings 35*a* are provided with respect to the direction F substantially perpendicular to the unsealing direction E in which the unsealing of the developer accommodating member 34 advances. That is, the plurality of openings 35*a* are disposed at different positions with respect to the direction F perpendicular to the unsealing direction E. Further, the plurality of openings 35*a* are disposed at different positions with respect to the direction of the rotation shaft of the unsealing member 20. Further, the portion-to-be-engaged 19*b* is provided in an end side of the sealing member 19 with respect to the direction substantially perpendicular to the direction in which the plurality of openings 35*a* are arranged. Further, the unsealing member 20 is provided in the end side of the sealing member 19 with respect to the direction substantially perpendicular to the direction in which the plurality of openings 35*a* are arranged. The fixing portion includes a fixing portion 16*d*, necessary for the unsealing, corresponding to the first fixing portion 16*d* in Embodiment 1. The shape of the developer accommodating member 34 itself is intended to be maintained by the molded portion 34*a* and the developer accommodating member 34 has the shape following the frame, and therefore the developer accommodating member 34 is supported by the frame as a whole, so that the developer accommodating member 34 is not readily moved toward the developer supplying roller 23 and the developing roller 13.

Next, as a means for fixing the fixing portion, it is possible to cite the (heat) welding, the ultrasonic welding, the adhesive bonding, the insertion between the frames, the heat clamping, the ultrasonic clamping, the hooking using the hole and the projection, and the like.

Incidentally, the constitutions of the sealing member 19 and the unsealing member 20 are the same as those in Embodiment 1.

<Summary of Unsealing of Developer Accommodating Bag>

Next, the unsealing of the developer accommodating bag will be described. Here, the fixing portion and the position thereof are the substantially same as those in Embodiment 1, and also the force relationship is the same as that in Embodiment 1. Therefore, also the unsealing step is the same as that in Embodiment 1 (FIG. 7 and FIG. 8).

In Embodiment 2, the openings 35*a* are disposed at the molded portion 34*a*, but also the molded portion 34*a* is flexible similarly as in Embodiment 1, so that the force relationship is the same as that in Embodiment 1. Therefore, also in Embodiment 2, the plurality of connecting portions 35*b* bridge the first bonding portion 22*a* and the second bonding portion 22*b* with respect to the direction E in which the unsealing advances. For that reason, when the unsealing at the first bonding portion 22*a* is ended and the unsealing at the second bonding portion 22*b* is effected, a force for peeling the sealing member 19 from the developer accommodating member 34 can be transmitted. For that reason, the unsealing also at the bonding portion 22*b* becomes possible.

Also the developer discharging port after the unsealing is the same as that in Embodiment 1. When the sealing member 19 is unsealed from the above-described developer accommodating member 34, first, the openings 35*a* are disposed at the lower portion of the developer accommodating member 34, and therefore the position of the openings 35*a* during the unsealing is moved at the same time when the gravitation acts on the openings 35*a*, so that the developer is discharged. Further, by the vibration or the like of the developer accommodating member 34, the developer in the neighborhood of the openings 35*a* is discharged. Here, the unsealing member 20 also functions as the urging member 21. Further, the urging member 21 has a rectangular shape in the cross section perpendicular to the rotational axis direction of the urging member 21, and the discharge of the developer is accelerated by the rotation of the urging member 21 as described in Embodiment 1 (FIG. 19).

Here, the urging member 21 contacts a surface which is the same surface as the surface where the openings 35*a* of the developer accommodating member 34 are provided. Incidentally, the developer accommodating member 34 is constituted by a plurality of surfaces including the surface where the openings 35*a* of the developer accommodating member 34 are provided and another surface connected to the surface via a bent portion 34*d*.

By employing the constitution as described above, in addition to the effect in Embodiment 1, the following effects are achieved.

(Effect of Vacuum Molding)

By forming a part of the developer accommodating member 34 through the vacuum molding, the following effects are obtained.

As a first effect, the developer accommodating member 34 can be shaped so as to follow the inside (shape) of the frame. For that reason, in the bag form as described in Embodiment 1, it is difficult to insert the bag until corner portions of the frame, so that a gap (space) is formed between the developer accommodating member 34 and the first frame 17, and the space is not an effective developer accommodating space.

As a second effect, the developer accommodating member 34 can be shaped so as to follow (the shape of) the frame and therefore can be easily assembled with the frame. This is because there is no need to push the developer accommodating member into the frame during the assembling so that its shape follows the shape of the frame.

As a third effect, the developer accommodating member 34 is not readily moved toward the developer supplying roller 23 and the developing roller 13. This is because the developer accommodating member 34 is supported by the frame as a whole since the shape of the developer accommodating member 34 itself is maintained as described above by the vacuum molding and has the shape which follows (the shape of) the frame. For that reason, the second fixing portion for preventing the movement of the developer bag toward the developer supplying roller 23 and the developing roller 13 as described in Embodiment 1 can be omitted.

Further, as shown in FIG. 19, an effect of pushing the surface 34*f* which is the same surface as the surface where the openings 35*a* are provided is as follows. The developer accommodating member 34 is constituted by the plurality of surfaces by the vacuum molding. Therefore, the bent portion 34*d* is present between the plurality of surfaces. The surface of the developer accommodating member 34 is defined as a portion surrounded by bent portions. Here, a difference in effect between the case where the surface 34*f* including the openings 35*a* is urged and the case where a surface 34*e* which does not include the openings 35*a* is urged will be described. The surface 34*e* is a surface which sandwiches the bent portion 34*d* between itself and the surface 34*f* including the opening 35*a*. A force received by the surface 34*e* urged by the urging member 21 is transmitted via the bent portion 34*d*. The force is largely attenuated before it reaches the surface including the openings 35*a*. For that reason, also a force for moving the openings 35*a* becomes small compared with the case where the surface 34*f* including the openings 35*a* is urged directly. For that reason, the function (action) of discharging the developer by moving the openings 35*a* becomes small. Therefore, when the urging member 21 urges the surface 34*f* including the openings 35*a*, the urging member 21 can efficiently improve the discharging property of the inside developer and can prevent stagnation of the developer. Thus, by the rotation of the urging member 21 of which function is performed by the unsealing member 20, the developer accommodating member 34 is urged so as to be pressed against the second frame 18, so that the developer accommodating member 34 is deformed to change the position of the openings 35, and the inside developer is discharged. Further, there are the plurality of openings 35*a* and therefore the developer is readily discharged more than the case of a single opening. Further, the openings 35*a* are disposed downward with respect to the direction of gravitation in the attitude during the image formation and therefore the developer is easily discharged.

Embodiment 3

Figure 35:
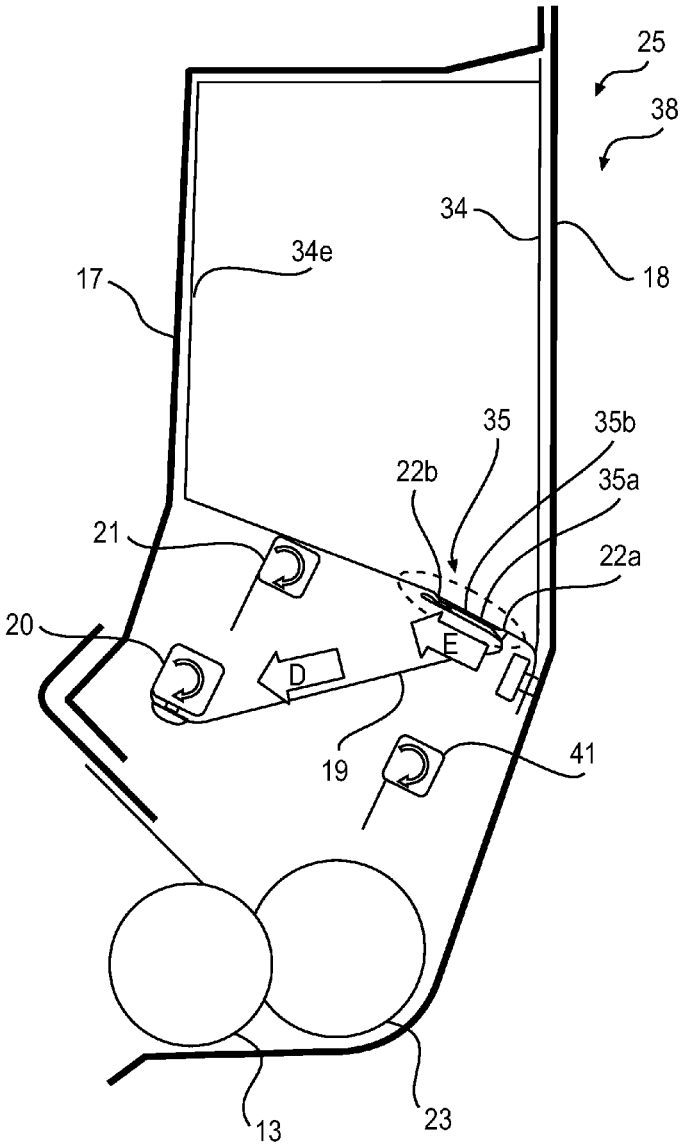
FIG. 35 is a sectional view of a developer accommodating unit in an embodiment of Embodiment 3 of the present invention.
Figure 36:
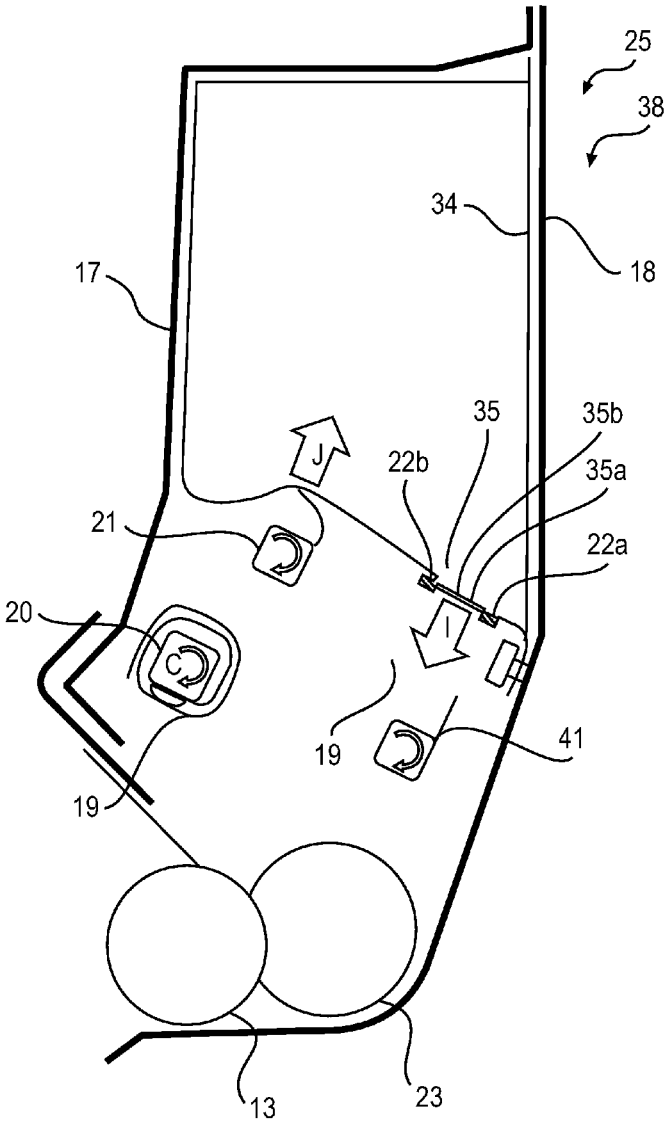
FIG. 36 is a sectional view of the developer accommodating unit in the embodiment of Embodiment 3 of the present invention.

Example in which Unsealing Member, Urging Member and Stirring Member are Separate Members By using FIGS. 35 and 36, an example in the case where an urging member 21, an unsealing member 20 and a stirring member 41 are separate members, respectively is shown. FIG. 35 is a schematic sectional view before unsealing, and FIG. 36 is a schematic sectional view after the unsealing. Here, each of the urging member 21, the unsealing member 20 and the stirring member 41 is rotatably supported by the first frame 17, and is rotated by receiving drive (driving force) from the main assembly of the image forming apparatus B. In an unsealing step, the unsealing member 20 is rotated in an arrow C direction, so that the sealing member 19 is wound up to expose the openings 35*a*. Further, with the rotation of the urging member 21, the urging member 21 urges the developer accommodating member 34 to deform the developer accommodating member 34, so that the discharge of the toner from the inside of the developer accommodating member 34 is urged. Further, by the rotation of the stirring member 41, the toner discharged from the developer accommodating member 34 can be stirred. Thus, the urging member 21, the unsealing member 20 and the stirring member 41 are the separate members, and therefore as desired, it is possible to set a rotational direction, a rotation speed, a rotation time and the like of each of the members.

Embodiment 4

Example in which Unsealing Operation is Operation Other than Rotation

Figure 37:
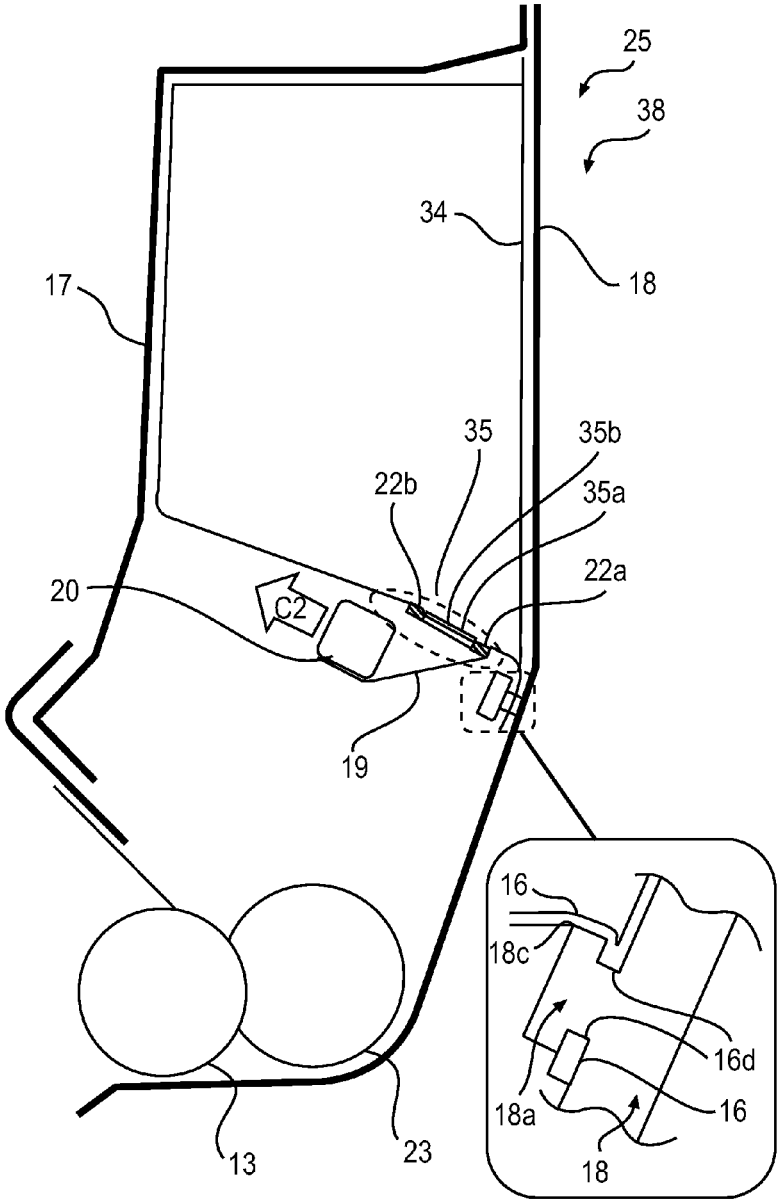
FIG. 37 is a sectional view of a developer accommodating unit in an embodiment of Embodiment 4 of the present invention.
Figure 38:
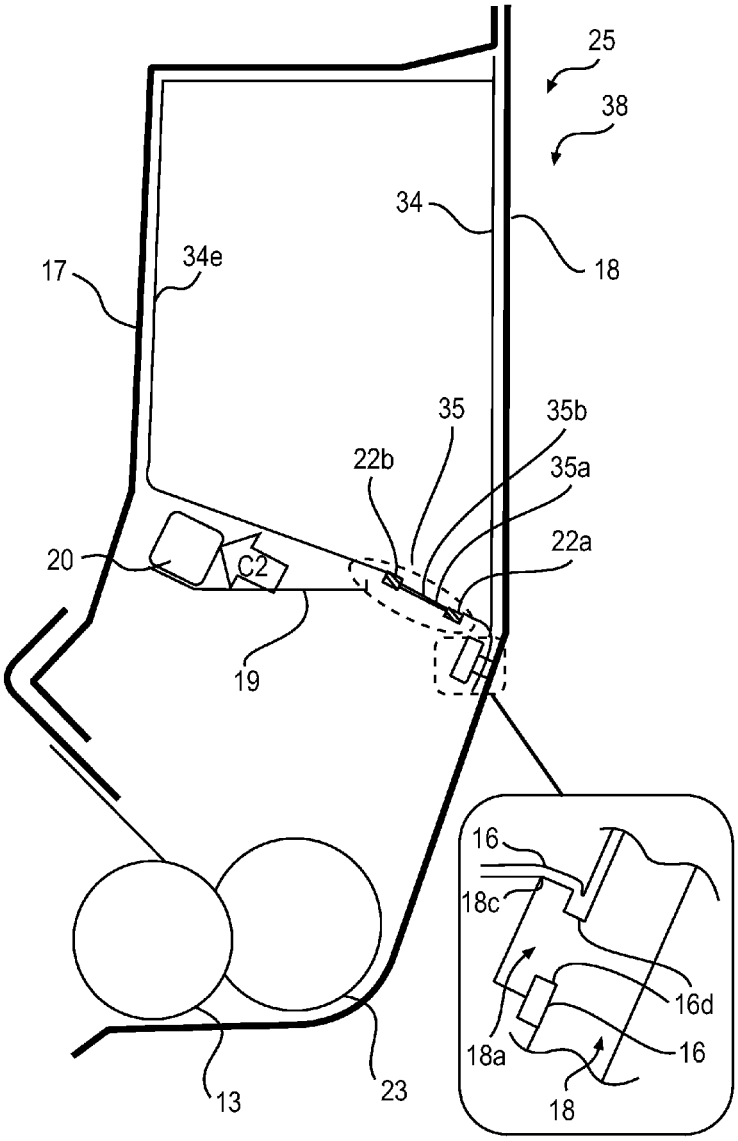
FIG. 38 is a sectional view of the developer accommodating unit in the embodiment of Embodiment 4 of the present invention.

By using FIG. 37 and FIG. 38, an example in the case where the unsealing member 20 is not rotated but is moved in a direction apart from the fixing portion 18*a* thereby to expose the openings 35*a* is shown. Here, the unsealing member 20 is slidably supported at its end portions by the first frame 17. Further, the unsealing member 20 is capable of being moved by an operation of the main assembly of the image forming apparatus B or by a user's operation. Here, the unsealing member 20 moves in an arrow C2 direction. With this movement of the unsealing member 20, the sealing member 19 is pulled in the arrow D direction to peel welded portions 22*a* and 22*b* to expose the openings 35*a*. Incidentally, the sliding direction C2 is not limited to a rectilinear line but may also be another shape such as an arcuate shape if the unsealing member 20 is movable in the direction apart from the fixing portion 19*a*.

Figure 39:
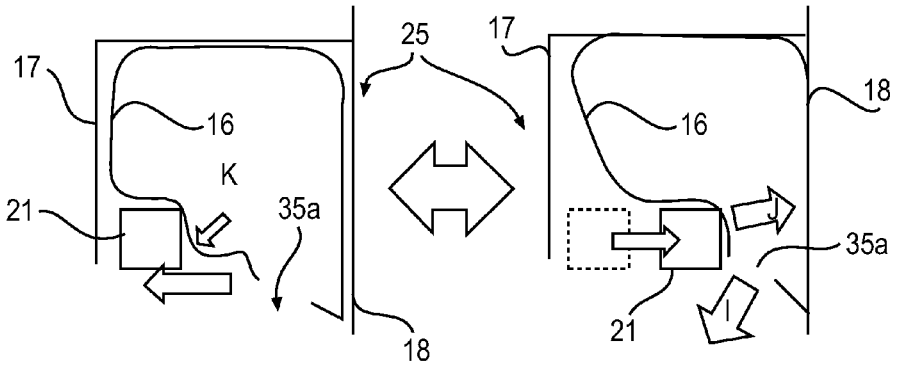
FIG. 39 is a sectional view of the developer accommodating unit in the embodiment of Embodiment 4 of the present invention.

Further, the unsealing member 20 may also function as the urging member 21 during the discharge or as the toner stirring member after the discharge, by being repeatedly reciprocated also after the unsealing (FIG. 39).

Thus, the operation of the unsealing member 20 can be constituted, other than the rotation, so as to cause the sealing member 19 to be movable, and therefore as desired, a constitution in which the unsealing member 20 is operated can appropriately be selected.

Embodiment 5

Figure 45:
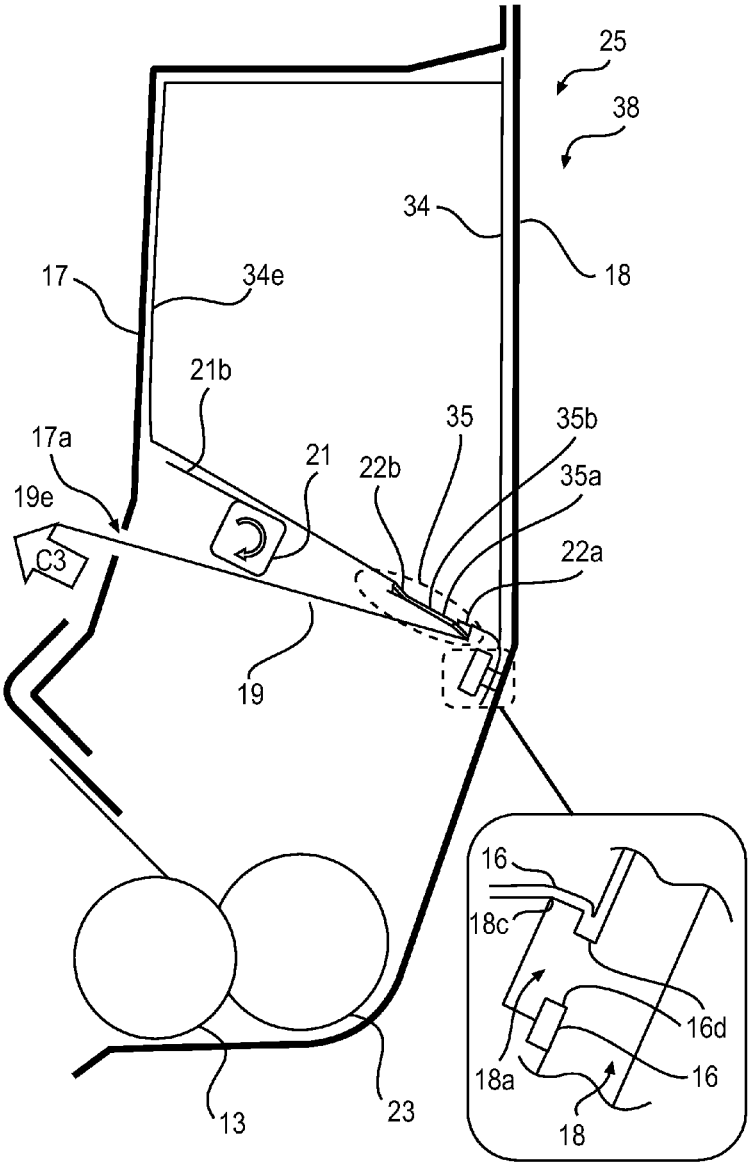
FIG. 45 is a sectional view of the developer accommodating unit in the embodiment of Embodiment 5 of the present invention.
Figure 46:
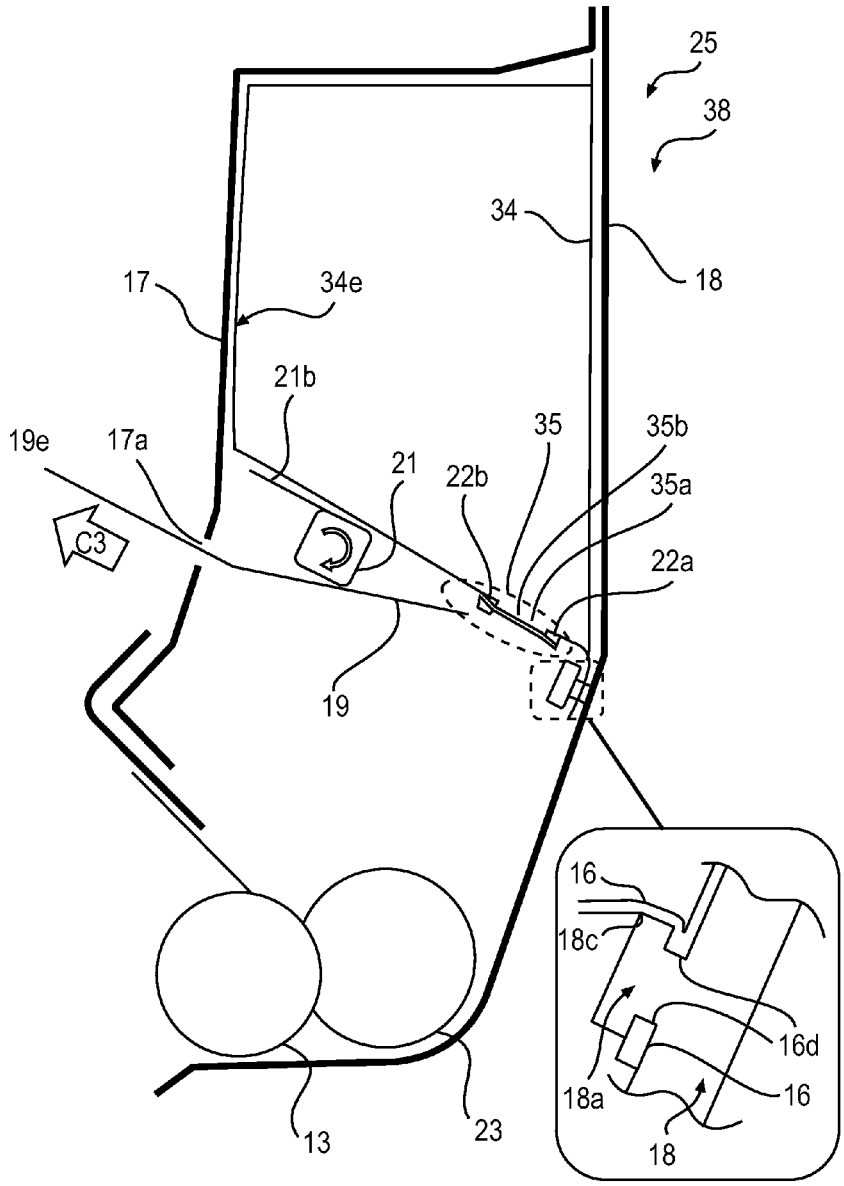
FIG. 46 is a sectional view of the developer accommodating unit in the embodiment of Embodiment 5 of the present invention.

Example of Unsealing Operation by User and Unsealing Operation by Image Forming Apparatus Without using the unsealing member 20, the openings 35*a* may also be exposed by pulling a part of the sealing member 19 or a member connected with the sealing member 19, by the user. As shown in FIG. 45 and FIG. 46, a constitution in which a sealing member 19 includes a portion which passes through an opening 17*a* of the first frame 17 to be exposed to the outside of the process cartridge A (hereinafter, referred to as a sealing member gripping portion 19*e*) is employed. Incidentally, at the opening 17*a*, a seal member (not shown) for preventing the toner from leaking to the outside is provided. The user moves the sealing member gripping portion 19*e* in an arrow C3 direction before the use of the process cartridge A, whereby the openings 35*a* can be exposed.

Further, the sealing member gripping portion 19*e* may also be provided with a separate member for facilitating the gripping.

Figure 40:
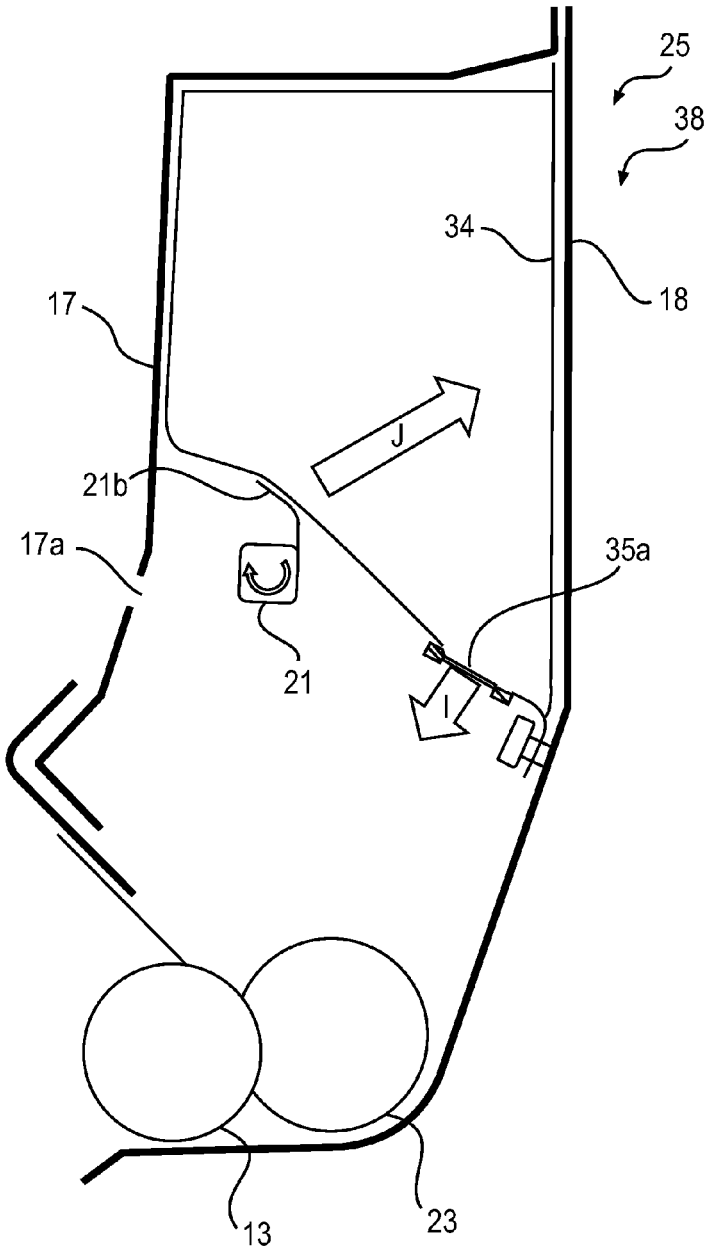
FIG. 40 is a sectional view of a developer accommodating unit in an embodiment of Embodiment 5 of the present invention.

Incidentally, without troubling the user, the main assembly of the image forming apparatus B is provided with a driving means to pull the sealing member gripping portion 19*a*, so that the openings 35*a* may also be exposed. Further, the sealing member gripping portion 19*e* is moved by a mounting operation during mounting of the process cartridge A in the image forming apparatus B, so that the openings 35*a* may also be exposed. Then, after the openings 35*a* are exposed, the urging member 21 is rotated to urge the developer accommodating member 34 by the urging sheet 21*b*, so that the incorporated developer is discharged (FIG. 40).

Embodiment 6

Example Used in Supplying System Constitution

Figure 47:
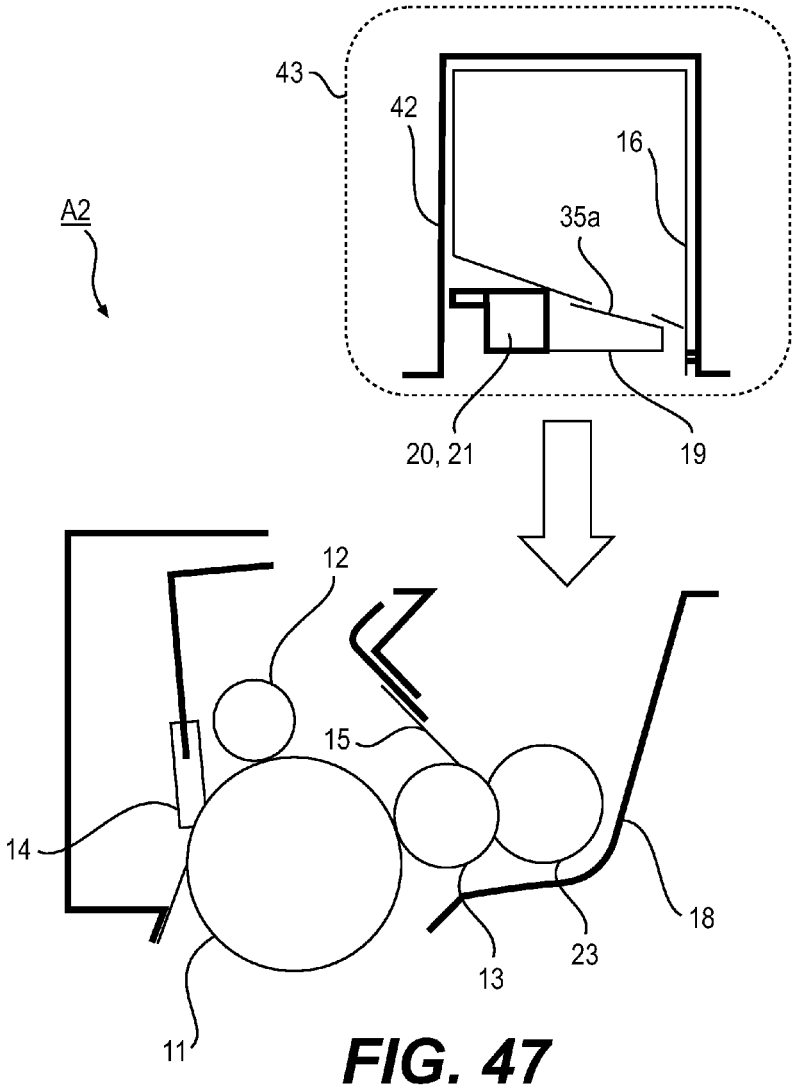
FIG. 47 is a sectional view of a developer accommodating unit in an embodiment of Embodiment 6 of the present invention.
Figure 48:
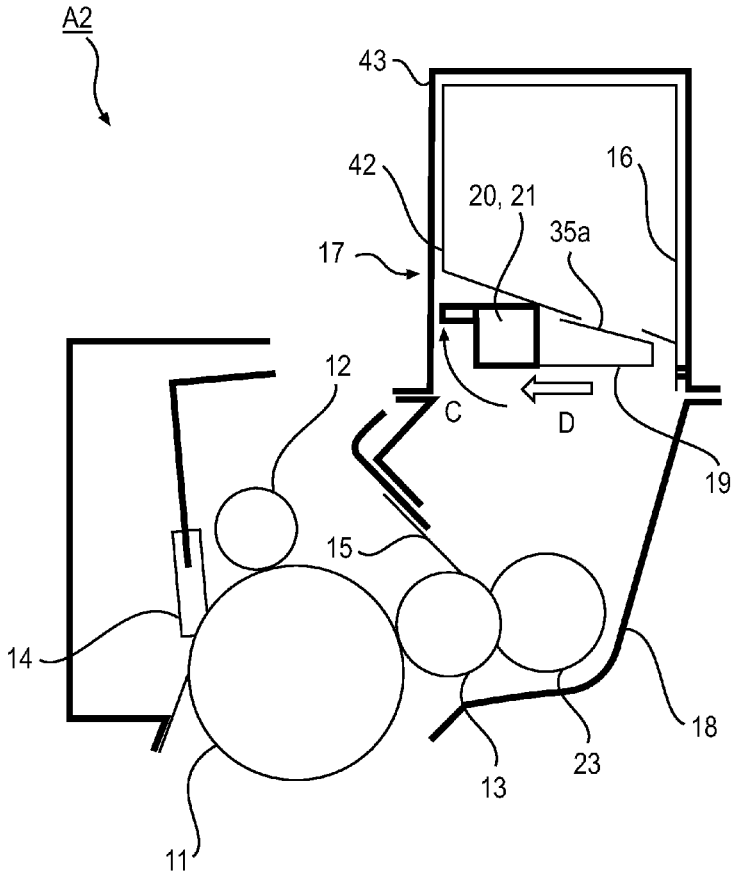
FIG. 48 is a sectional view of the developer accommodating unit in the embodiment of Embodiment 6 of the present invention.

An example in which a developer bag 16 and a supply frame 42 for covering the developer bag 16 are integrally assembled into a supplying unit 43 which is detachably mounted in a process cartridge A2 will be described. As shown in FIG. 47 and FIG. 48, the supplying unit 43 is constituted by the supply frame 42 and the developer bag 16 including an unsealing member 20 and a sealing member 19. Further, the process cartridge A2 is provided, at a periphery of a photosensitive drum 1, with a charging roller 12 as a charging means, a cleaner unit 24 including a cleaning blade 14 having elasticity as a cleaning means, and a developing device 38. The developing device 38 includes a developing roller 13 as a developing means, a developing blade 15 and a developer supplying roller 23, and is constituted so that the supplying unit 43 is detachably mountable thereto.

This supplying unit 43 is mounted in the process cartridge A2, and is detachably mountable to the main assembly of the image forming apparatus B integrally with the process cartridge A2. Incidentally, the supplying unit 43 may also be made replaceable while mounting the process cartridge A2 in the main assembly of the image forming apparatus B.

Here, by rotation of the unsealing member 20 in an arrow C direction, the sealing member 19 is moved in an arrow D direction to expose the openings 35*a*.

Figure 49:
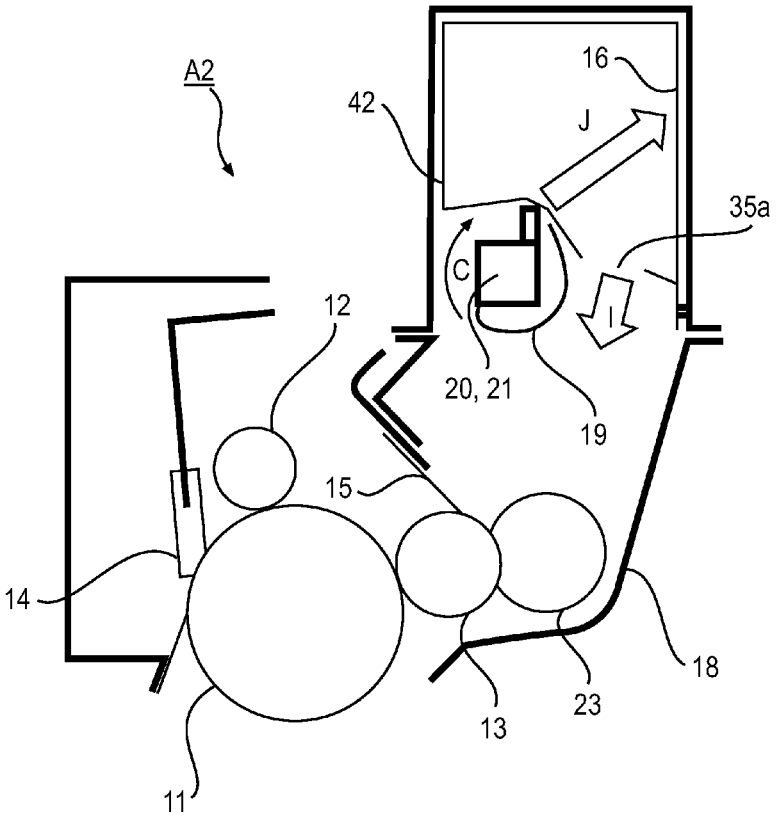
FIG. 49 is a sectional view of the developer accommodating unit in the embodiment of Embodiment 6 of the present invention.

Then, after the sealing member 19 is peeled from the developer bag 16, the developer bag 16 is urged by an urging member 21 which also functions as the unsealing member 20, so that the toner is discharged (FIG. 49).

Thus, by replacing the supplying unit 43 in which the developer bag 16 is incorporated, it is possible to provide the process cartridge A2 capable of supplying the toner.

Embodiment 7

Figure 41:
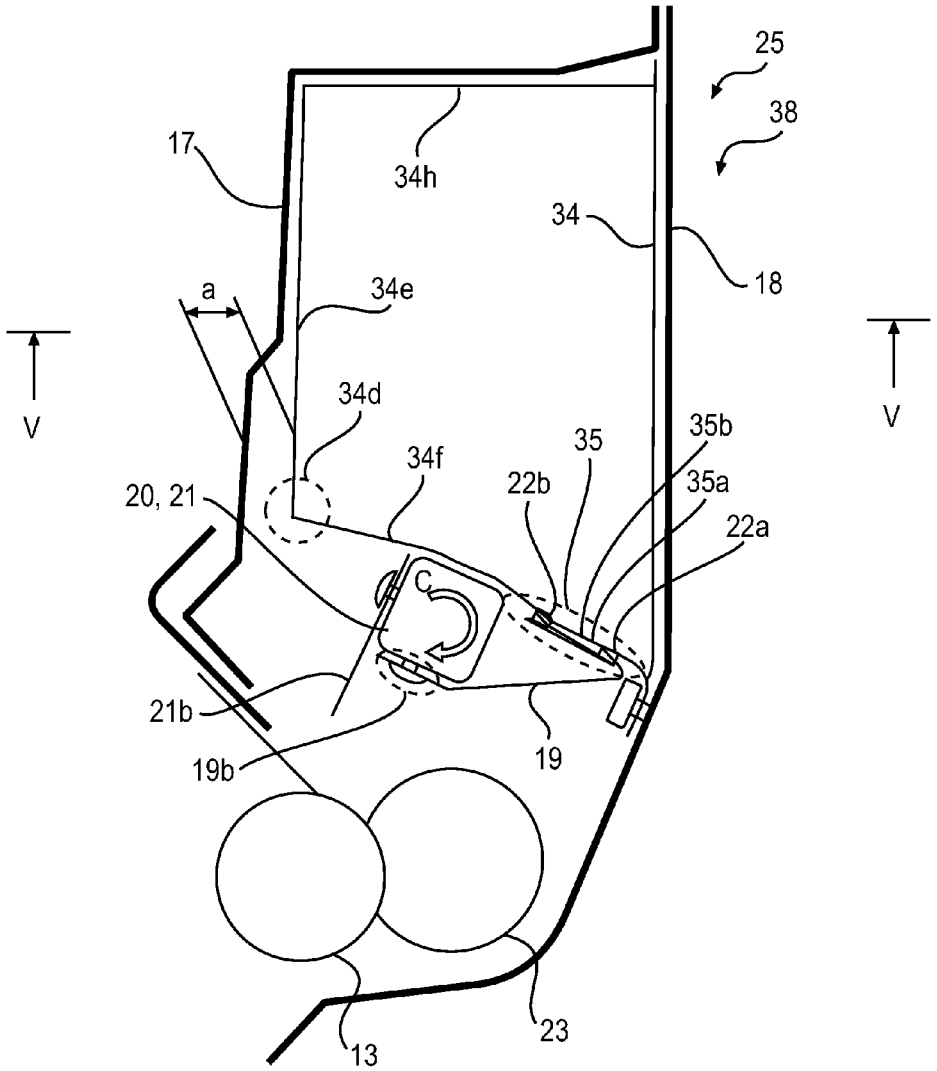
FIG. 41 is a sectional view of a developer accommodating unit in an embodiment of Embodiment 7 of the present invention.

Next, by using FIG. 19, FIG. 41, FIG. 42, FIG. 43 and FIG. 44, a constitution and action for activating a developer circulating function (action) in the developer bag 16 will be described. FIG. 41 is a sectional view perpendicular to a rotation center axis of the urging member 21 of the developing device 38.

As described in Embodiment 1, the fact that the developer circulation in the developer bag 16 is generated by the deformation of the developer bag 16 was described above. Here, in the case where the molded product 34 described in Embodiment 2 is used, the shape of the developer bag 16 is capable of taking a shape similar to that of the frame 17, whereby as shown in FIG. 19, a region where the developer bag 16 and the frame 17 hermetically contact each other is increased. By this increase, there is the case where a deformable region of the developer bag 16 by the urging member 21 is limited and as a result, also the developer circulation in the developer bag 16 is limited. Accordingly, in the case where the developer circulating function in the developer bag 16 is further required, as shown in FIG. 41, a gap $\alpha$ is provided between a side (surface) 34*e*, continuous with a side (surface) 34*f* including openings of the developer bag 16 via a bent portion 34*d*, and the frame 17. This gap $\alpha$ may be set depending on an amount in which the developer bag 16 is amplified. Here, when the above-described gap $\alpha$ is set at a value not less than an amplitude of the developer bag 16 by the urging member 21, the above-described developer circulating function is proportional to the amplitude of the developer bag 16 and therefore the developer circulating function is performed to the maximum. However, in this case, correspondingly to a volume generated by the gap $\alpha$, an accommodating amount of the developer is limited. Next, in the case where the above-described gap $\alpha$ is set so as to be less than the amplitude of the developer bag 16, the developer circulating function becomes limited one. In this case, compared with the case where the gap $\alpha$ which is not less than the amplitude of the above-described developer bag 16 is provided, it becomes possible to direct the developer accommodating amount in an increasing direction correspondingly to a decrease in gap $\alpha$. Accordingly, the value of the above-described gap $\alpha$ may be appropriately set depending on a required developer circulating function in the developer bag 16 and an amount of the accommodated developer. Further, as shown in FIG. 41, a constitution in which the above-described gap $\alpha$ is made small toward between the side (surface) 34*f* including the openings and a side (surface) 34*h* opposing the side including the openings may also be employed. That is, the gap $\alpha$ is constituted so as to become larger as the gap $\alpha$ approaches the side 34*f* including the openings. Such a constitution can be made a constitution capable of achieving a balance between the developer circulation in the developer bag 16 and the developer accommodating amount, more than a constitution in which the gap α is provided in the entire region of the side 34*e* continuous with the side 34*f* including the openings via the bent portion 34*d*. Incidentally, the bent portion 34*d* may appropriately selected from those including one constituted by chamfering ((b) of FIG. 51), one constituted by a plurality of sides (surfaces) ((d) of FIG. 51) and those having curvature ranging from a value close to 0 ((a) of FIG. 51) to a large value ((c) of FIG. 51).

Figure 42:
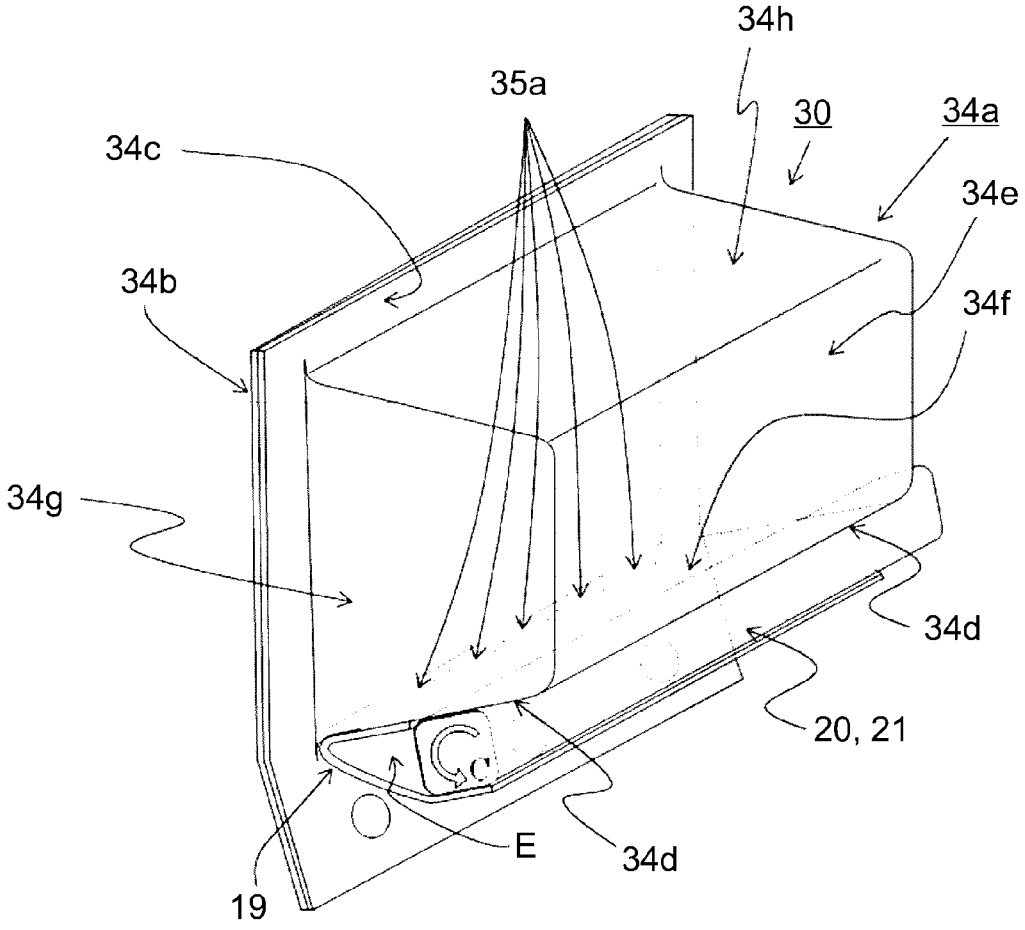
FIG. 42 is a schematic illustration of openings in the embodiment of Embodiment 7 of the present invention.
Figure 43:
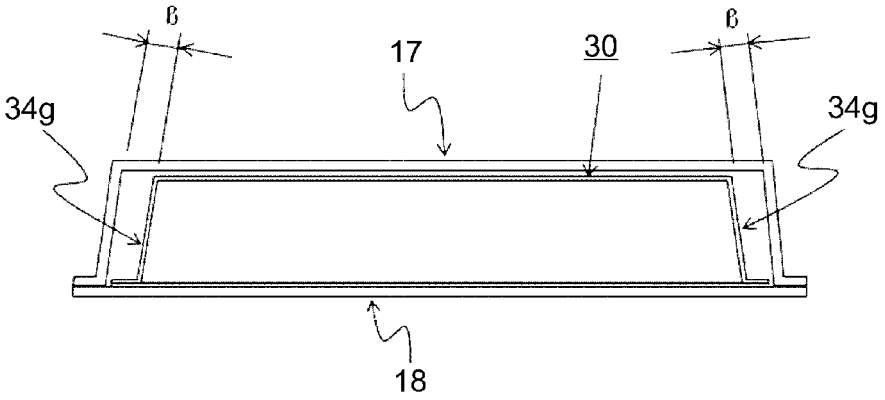
FIG. 43 is a schematic illustration of the openings in the embodiment of the Embodiment 7 of the present invention.
Figure 44:
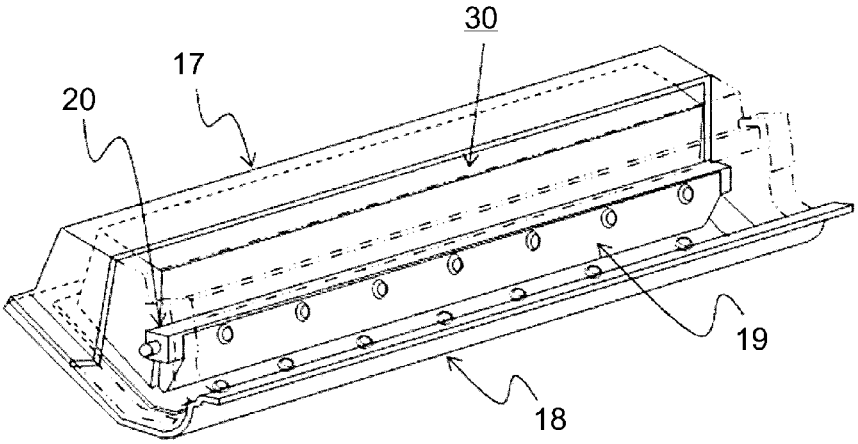
FIG. 44 is a schematic illustration of the openings in the embodiment of Embodiment 7 of the present invention.

As described above, the constitution of the gap α in the cross section perpendicular to the rotation center axis of the urging member 21 has been described, but next, by using FIG. 42, FIG. 43 and FIG. 44, a constitution of a gap β in the cross section with respect to a direction parallel to the rotation center axis of the urging member 21 will be described. FIG. 42 is a perspective view of a developer accommodating container 30. FIG. 43 is a VV cross section shown in FIG. 41. FIG. 44 is a perspective view obtained by cutting only the frame 17 shown in FIG. 41 along V-V line.

As shown in FIG. 42, the side 34*e* continuous with the side 34*f* including the openings via the bent portion 34*d* and sides (surfaces) 34*g* are 3 sides provided in both sides with respect to the rotation center axis direction of the urging member 21 and at a surface opposing the air permeable portion 34*b*.

Here, as shown in FIG. 43, a gap is provided each of between a side 34*g* with respect to a longitudinal direction of the rotation center axis of the urging member 21 and the frame 17 and between another side 34*g* with respect to the longitudinal direction of the rotation center axis of the urging member 21 and the frame 17. A gap setting manner is similar to that in the above-described cross section perpendicular to the rotation center axis of the urging member.

Further, the developer circulating function is similar to the function (action) described in Embodiment 1.

INDUSTRIAL APPLICABILITY

As described in the foregoing, there are provided a developer accommodating container, a developer accommodating unit, a process cartridge and an electrophotographic image forming apparatus which are capable of further activating circulation of the developer in the developer bag 16.

The invention claimed is:

1. A developer accommodating container for accommodating developer, said developer accommodating container comprising:

a flexible container including an injection port for permitting entrance of the developer and a plurality of openings for permitting discharge of the developer; and a sealing member mounted on said flexible container in a state in which said sealing member seals the plurality of openings and capable of exposing the plurality of openings by being moved in an unsealing direction, wherein the plurality of openings are provided at different positions along a direction perpendicular to the unsealing direction, and wherein the flexible container is deformable to change a shape of the openings when the sealing member is removed.

2. A developer accommodating container according to claim 1, wherein a first distance of the plurality of openings extending in the unsealing direction is shorter than a second distance of the plurality of openings extending in the direction perpendicular to the unsealing direction.

3. A developer accommodating container according to claim 1, wherein said sealing member has a free end portion in an end side with respect to the unsealing direction, and further comprising an unsealing member with a portion-to-be-engaged for moving the sealing member provided at the free end portion.

4. A developer accommodating container according to claim 3, further comprising an unsealing member for moving said sealing member, wherein the unsealing member includes an engaging portion engaging with a portion-to-be-engaged of said sealing member.

5. A developer accommodating container according to claim 1, wherein said developer accommodating container is a bag.

6. A developer accommodating container according to claim 1, wherein said developer accommodating container is a sheet.

7. A developer accommodating container according to claim 6, wherein a thickness of the sheet is 0.03 mm to 0.15 mm.

8. A developer accommodating container according to claim 1, wherein said developer accommodating container includes a portion having air-permeability.

9. A developer accommodating container according to claim 1, wherein said developer accommodating container includes any of polyethylene terephthalate (PET), polyethylene (PE), and polypropylene (PP).

10. A developer accommodating container in which developer used for image formation is accommodated, said developer accommodating container comprising:

a flexible container including a plurality of openings for permitting discharge of the accommodated developer; and a sealing member mounted on said flexible container in a state in which said sealing member seals the plurality of openings and capable of exposing the plurality of openings by being moved in an unsealing direction, wherein the plurality of openings are provided at different positions along a direction perpendicular to the unsealing direction, and wherein the flexible container is deformable to change a shape of the openings when the sealing member is removed.

11. A developer accommodating container according to claim 10, wherein a first distance of the plurality of openings extending in the unsealing direction is shorter than a second distance of the plurality of openings extending in the direction perpendicualar to the unsealing direction.

12. A developer accommodating container according to claim 10, wherein said sealing member has a free end portion in an end side with respect to the unsealing direction.

13. A developer accommodating container for accommodating developer, said developer accommodating container comprising:

a flexible container including an injection port for permitting entrance of the developer and a plurality of openings for permitting discharge of the developer;

a sealing member mounted on said flexible container in a state in which said sealing member seals the plurality of openings and capable of exposing the plurality of openings by being moved; and a portion-to-be-engaged provided in an end side of said sealing member with respect to a direction substantially perpendicular to a direction in which the plurality of openings are arranged, and wherein the flexible container is deformable to change a shape of the openings when the sealing member is removed.

14. A developer accommodating unit comprising:

a developer accommodating container comprising a flexible container including a plurality of openings for permitting discharge of accommodated developer, and a sealing member mounted on the flexible container in a state in which the sealing member seals the plurality of openings and capable of exposing the plurality of openings by being moved in an unsealing direction;

an unsealing member for moving said sealing member; and a frame for accommodating said developer accommodating container and said unsealing member, wherein the plurality of openings are provided at different positions along a direction perpendicular to the unsealing direction, and wherein the flexible container is deformable to change a position of the openings relative to the frame when the sealing member is removed.

15. A developer accommodating unit according to claim 14, wherein a first distance of the plurality of openings extending in the unsealing direction is shorter than a second distance of the plurality of openings extending in the direction perpendicular to the unsealing direction.

16. A developer accommodating unit according to claim 14, wherein said unsealing member is provided rotatably in said frame, and moves the sealing member by rotation.

17. A developer accommodating unit according to claim 16, wherein said unsealing member winds the sealing member therearound by rotation to peel the sealing member from the flexible container, thereby to expose the openings.

18. A developer accommodating unit according to claim 14, further comprising a developer carrying member for carrying the developer for developing a latent image.

19. A developer accommodating unit according to claim 14, wherein said developer accommodating container is a bag.

20. A developer accommodating unit according to claim 14, wherein said developer accommodating container is a sheet.

21. A developer accommodating unit according to claim 20, wherein a thickness of the sheet is 0.03 mm to 0.15 mm.

22. A developer accommodating unit according to claim 14, wherein said developer accommodating container incudes a portion having air-permeability.

23. A developer accommodating unit according to claim 14, wherein said developer accommodating container incudes any of polyethylene terephthalate (PET), polyethylene (PE) and polypropylene (PP).

24. A developer accommodating unit in which a developer used for image formation is accommodated, said developer accommodating unit comprising:

a developer accommodating container comprising a flexible container including a plurality of openings for permitting discharge of an accommodated developer, and a sealing member mounted on the flexible container in a state in which the sealing member seals the plurality of openings and capable of exposing the plurality of openings by being moved in an unsealing direction;

a frame for accommodating said developer accommodating container and said sealing member, wherein the plurality of openings are provided at different positions along a rotational axis of said unsealing member, and wherein the flexible container is deformable to change a position of the openings relative to the frame when the sealing member is removed.

25. A developer accommodating unit according to claim 24, wherein a first distance of the plurality of openings extending in the unsealing direction is shorter than a second distance of the plurality of openings extending in the direction perpendicular to the unsealing direction.

26. A developer accommodating unit comprising:

a developer accommodating container in which a developer used for image formation is accommodated, said developer accommodating container comprising a flexible container including a plurality of openings for permitting discharge of an accommodated developer, and a sealing member mounted on the flexible container in a state in which the sealing member seals the plurality of openings and capable of exposing the plurality of openings by being moved in an unsealing direction;

an unsealing member for moving the sealing member; and a frame for accommodating said developer accommodating container and said unsealing member, wherein said unsealing member for moving said sealing member is provided in an end side of said sealing member with respect to a direction substantially perpendicular to a direction in which the plurality of openings are arranged, and wherein the flexible container is deformable to change a position of the openings relative to the frame when the sealing member is removed.

27. A developer accommodating unit according to claim 26, wherein said unsealing member is provided rotatably in said frame and moves the sealing member by rotation.

28. A developer accommodating unit according to claim 27, wherein said unsealing member winds the sealing member therearound by rotation to peel the sealing member from the flexible container, thereby to expose the openings.

29. A developer accommodating container for accommodating developer, said developer accommodating container comprising:

a flexible container including an injection port for permitting entrance of the developer and a plurality of openings for permitting discharge of the developer; and a sealing member mounted on said flexible container in a state in which said sealing member seals the plurality of openings and capable of exposing the plurality of openings by being moved, wherein the flexible container is deformable to change a shape of the openings when the sealing member is removed.

30. A developer accommodating container according to claim 29, wherein a first distance extending in the unsealing direction is shorter than a second distance of the plurality of openings extending in a direction perpendicular to the unsealing direction.

31. A developer accommodating container according to claim 29, further comprising a bonding portion for bonding the injection port for permitting entrance of the developer.

32. A developer accommodating container according to claim 29, wherein the injection port for permitting entrance of the developer and one of the plurality of openings for permitting discharge of the developer are different openings.

33. A developer accommodating container according to claim 29, wherein the injection port for permitting entrance of the developer is larger than one of the plurality of openings for permitting discharge of the developer.

34. A developer accommodating container for accommodating developer, said developer accommodating container comprising:

a flexible container including an injection port for permitting entrance of the developer and an opening for permitting discharge of the developer;

a sealing member mounted on said flexible container in a state in which said sealing member seals the opening and capable of exposing the opening by being moved in an unsealing direction, and a connecting member for connecting an upstream side end and a downstream side end of the opening along the unsealing direction of said sealing member, wherein the flexible container is deformable to change a shape of the opening when the sealing member is removed.

35. A process cartridge comprising:

a developer accommodating unit comprising a developer accommodating container comprising a flexible container including a plurality of openings for permitting discharge of accommodated developer, and a sealing member mounted on the flexible container in a state in which the sealing member seals the plurality of openings and capable of exposing the plurality of openings by being moved in an unsealing direction;

an unsealing member for moving said sealing member; and a frame for accommodating said developer accommodating container and said unsealing member, wherein the plurality of openings are provided at different positions along a direction perpendicular to the unsealing direction, and wherein the flexible container is deformable to change a position of the openings when the sealing member is removed.

36. An image forming apparatus comprising:

a developer accommodating unit comprising a developer accommodating container comprising a flexible container including a plurality of openings for permitting discharge of an accommodated developer, and a sealing member mounted on the flexible container in a state in which the sealing member seals the plurality of openings and capable of exposing the plurality of openings by being moved in an unsealing direction;

an unsealing member for moving said sealing member;

a frame for accommodating said developer accommodating container and said unsealing member; and a developing unit is configured to develop images, said developing unit receiving developer from said developer accommodating unit, wherein the plurality of openings are provided at different positions along a direction perpendicular to the unsealing direction, and wherein the flexible container is deformed to change a position of the openings relative to the frame when the sealing member is removed.

37. A developing apparatus comprising:

a developer carrying member for carrying developer for developing a latent image;

a developer accommodating container comprising a flexible container including a plurality of openings, and a sealing member mounted on the flexible container in a state in which the sealing member seals the plurality of openings and capable of exposing the plurality of openings by being moved in an unsealing direction;

an unsealing member for moving said sealing member; and a frame for accommodating said developer accommodating container and said unsealing member, wherein the plurality of openings are provided at different positions along a direction perpendicular to the unsealing direction, and wherein the flexible container is deformable to change a position of the openings relative to the frame when the sealing member is removed.

38. A developer accommodating container for accommodating developer, said developer accommodating container comprising:

a flexible container including a plurality of openings for permitting discharge of the developer; and a sealing member mounted on said flexible container in a state in which said sealing member seals the plurality of openings and capable of exposing the plurality of openings by being moved, wherein the flexible container is deformable to change a shape of the openings when the sealing member is removed.

39. A developer accommodating container according to claim 38, wherein a first distance of the plurality of openings extending in an unsealing direction is shorter than a second distance of the plurality of openings extending in a direction perpendicular to the unsealing direction.

40. A developer accommodating container according to claim 38, wherein said sealing member has a free end portion in an end side with respect to the unsealing direction, and further comprising an unsealing member with a portion-to-be-engaged for moving the sealing member provided at the free end portion.

41. A developer accommodating container according to claim 38, wherein said developer accommodating container is a bag.

42. A developer accommodating container according to claim 38, wherein said developer accommodating container is a sheet.

43. A developer accommodating container according to claim 42, wherein a thickness of the sheet is 0.03 mm to 0.15 mm.

44. A developer accommodating container according to claim 38, wherein said developer accommodating container incudes a portion having air-permeability.

45. A developer accommodating container according to claim 38, wherein said developer accommodating container incudes any of polyethylene terephthalate (PET), polyethylene (PE), and polypropylene (PP).

46. A developing apparatus comprising:

a developer carrying member for carrying the developer for developing a latent image; and a developer accommodating container according to claim 38.

47. A process cartridge comprising:

an image bearing member for bearing a developer image; and a developer accommodating container according to claim 38.

48. An image forming apparatus comprising:

a developer accommodating container according to claim 38, and wherein an image forming operation is performed by said image forming apparatus.

* * * * *